US006968779B2

(12) United States Patent
Doyle et al.

(10) Patent No.: US 6,968,779 B2
(45) Date of Patent: Nov. 29, 2005

(54) APPARATUS AND METHODS FOR WIRE-TYING BUNDLES OF OBJECTS

(75) Inventors: David R. Doyle, Aberdeen, WA (US); Andrew D. Hall, Aberdeen, WA (US); Darrell D. Robinson, Elma, WA (US); Scott E. McNeal, Aberdeen, WA (US); Donald A. Smith, Aberdeen, WA (US)

(73) Assignee: Enterprises International, Inc., Hoquiam, WA (US)

( * ) Notice: Subject to any disclaimer, the term of this patent is extended or adjusted under 35 U.S.C. 154(b) by 12 days.

(21) Appl. No.: 10/285,361

(22) Filed: Oct. 30, 2002

(65) Prior Publication Data

US 2003/0121424 A1 Jul. 3, 2003

Related U.S. Application Data

(63) Continuation-in-part of application No. 09/525,988, filed on Mar. 15, 2000, now Pat. No. 6,584,891.

(51) Int. Cl.[7] ..... B65B 13/04; B65H 51/22

(52) U.S. Cl. ..... 100/2; 100/26; 100/29; 100/32; 242/364.9; 53/582

(58) Field of Search ..... 100/2, 4, 25–32, 100/33 PB; 53/399, 582, 389.4, 589, 592; 140/123.6, 93.2, 93.4, 150, 152; 242/364.9, 242/366, 410

(56) References Cited

U.S. PATENT DOCUMENTS

| | | | | |
|---|---|---|---|---|
| 2,575,899 | A | 11/1951 | Vining et al. | 100/31 |
| 2,912,099 | A | 11/1959 | Brouse et al. | 203/12 |
| 3,190,613 | A | 6/1965 | Embree | 254/51 |
| 3,196,779 | A | 7/1965 | Embree | 100/4 |
| 3,447,448 | A | 6/1969 | Pasic | 100/4 |
| 3,566,778 | A | 3/1971 | Vilcins | 100/2 |
| 3,735,555 | A | 5/1973 | Pasic | 53/124 D |
| 3,884,139 | A | 5/1975 | Pasic | 100/26 |
| 3,889,584 | A | 6/1975 | Wiklund | 100/26 |

(Continued)

FOREIGN PATENT DOCUMENTS

| | | |
|---|---|---|
| DE | 456 146 | 2/1928 |

(Continued)

*Primary Examiner*—Derris H. Banks
*Assistant Examiner*—Jimmy T Nguyen
(74) *Attorney, Agent, or Firm*—Seed IP Law Group PLLC

(57) ABSTRACT

Systems and methods for threading and feeding a length of wire into a wire-tying track, for withdrawing at least some of the wire from the wire-tying track to tension the wire around one or more objects, and for extracting waste wire from the system. The object of the invention herein being a feed and tension mechanism comprising a feed and tension wheel, an accumulator disk, a primary nip mechanism for frictionally engaging the wire at the contact region between the primary nip and the feed and tension wheel, a drive system having two independently operable motors, and wire guiding devices for directing and routing the wire through the feed and tension mechanism. The present invention may further comprise a supplementary nip mechanism to facilitate the threading of the wire into the mechanism, a wire stripping mechanism for extracting any waste wire from the mechanism, and a series of wire sensing devices in communication with a control system to sequence and control the operational cycles of the system. The feed and tension mechanism further includes a frame that structurally supports the major assemblies and attaches to the wire-tying machine.

29 Claims, 54 Drawing Sheets

U.S. PATENT DOCUMENTS

| | | | | |
|---|---|---|---|---|
| 3,904,171 | A | 9/1975 | Chronister et al. | 251/159 |
| 3,929,063 | A | 12/1975 | Stromberg et al. | 100/26 |
| 4,106,403 | A | 8/1978 | Sutehall | 100/25 |
| 4,252,157 | A | 2/1981 | Ohnishi | 140/93 |
| 4,450,763 | A | 5/1984 | Saylor | 100/31 |
| 4,498,379 | A | 2/1985 | Saylor | 100/2 |
| 4,577,554 | A | 3/1986 | Brouse | 100/26 |
| 4,605,456 | A | 8/1986 | Annis, Jr. | 156/157 |
| 4,912,912 | A | 4/1990 | Tagomori | 53/589 |
| 4,955,180 | A * | 9/1990 | Sakaki et al. | 53/399 |
| 5,027,701 | A | 7/1991 | Izui et al. | 100/26 |
| 5,031,523 | A | 7/1991 | Poloni | 100/25 |
| 5,146,847 | A | 9/1992 | Lyon et al. | 100/2 |
| 5,217,049 | A | 6/1993 | Forsyth | 140/93.6 |
| 5,492,156 | A | 2/1996 | Dyer et al. | 140/123.6 |
| 5,613,432 | A | 3/1997 | Hoshino | 100/26 |
| 5,614,042 | A | 3/1997 | Nishide et al. | 156/53 |
| 5,746,120 | A | 5/1998 | Jonsson | 100/4 |
| 5,778,772 | A | 7/1998 | Schwede | 100/26 |
| 5,870,950 | A | 2/1999 | Wiedel | 100/33 R |
| 5,921,290 | A | 7/1999 | Dyer et al. | 140/123.6 |
| 5,947,166 | A | 9/1999 | Doyle et al. | 140/119 |
| 6,073,516 | A | 6/2000 | Westerlund | 74/569 |
| 6,126,102 | A | 10/2000 | Mycielski et al. | 242/128 |
| 2003/0121424 | A1 | 7/2003 | Doyle et al. | 100/29 |

FOREIGN PATENT DOCUMENTS

| | | |
|---|---|---|
| DE | 1 198 730 | 8/1965 |
| DE | 1 266 208 | 4/1968 |
| DE | 296 12 531 U1 | 10/1996 |
| EP | 1 151 921 A2 | 11/2001 |
| GB | 1124366 | 8/1968 |
| WO | WO 01/68450 A2 | 9/2001 |

* cited by examiner

Wire feeding from external source

Insertion of wire from external source (b) Wire accumulation onto drum at 225 degrees of rotation (a) Initiation of tension cycle.

(c) Wire accumulation onto drum at 2 drum revolutions (b) Wire feeding from drum accumulation at 225 degrees (a) Wire feeding from drum accumulation at 2 revolutions (c) Return to feed from external wire source.

Cross-section through drum, hub, and axle illustrating feed path through axle

Wire feeding from external source.

Wire accumulation onto drum at 225 degrees of rotation.

Initiation of tension cycle.

Wire accumulation onto drum at 2 drum revolutions.

Wire feeding from drum accumulation at 225 degrees.

Wire feeding from drum accumulation at 2 revolutions

Return to feed from external wire source.

APPARATUS AND METHODS FOR WIRE-TYING BUNDLES OF OBJECTS

This is a Continuation In Part of application Ser. No. 09/525,988, filed on Mar. 15, 2000, now U.S. Pat. No. 6,584,891.

TECHNICAL FIELD

This invention relates to apparatus and methods for wire-tying one or more objects, including, for example, wood products, newspapers, magazines, pulp bales, waste paper bales, rag bales, pipe, or other mechanical elements.

BACKGROUND OF THE INVENTION

A variety of automatic wire-tying machines have been developed, such as those disclosed in U.S. Pat. No. 5,027,701 issued to Izui and Hara, U.S. Pat. No. 3,889,584 issued to Wiklund, U.S. Pat. No. 3,929,063 issued to Stromberg and Lindberg, U.S. Pat. No. 4,252,157 issued to Ohnishi, and U.S. Pat. No. 5,746,120 issued to Jonsson. The wire-tying machines disclosed by these references typically include a track that surrounds a bundling station where a bundle of objects may be positioned, a feed assembly for feeding a length of wire about the track, a gripping assembly for securing a free end of the length of wire after it has been fed about the track, a tensioning assembly for pulling the length of wire tightly about the bundle of objects, a twisting assembly for tying or otherwise coupling the length of wire to form a wire loop around the bundle of objects, a cutting assembly for cutting the length of wire from a wire supply, and an ejector for ejecting the wire loop from the machine.

One drawback to conventional wire-tying machines is their complexity. For example, a variety of elaborate hydraulically-driven, or pneumatically-driven actuation systems are commonly used for performing such functions as securing the free end of the length of wire, for cutting the length of wire from the wire supply, and for ejecting the wire loop from the machine. Track assemblies also typically require some type of spring-loaded hydraulic or pneumatic system to actuate the track between a closed position for feeding the wire about the track, and an open position for tensioning the wire about the bundle of objects.

Such hydraulic or pneumatic actuation systems require relatively expensive cylinder and piston actuators, pressurized lines, pumps, valves, and fluid storage facilities. These components not only add to the initial cost of the wire-tying machine, but also require considerable maintenance. The handling, storage, disposal, and cleanup of fluids used in typical hydraulic systems also presents issues related to safety and environmental regulations.

SUMMARY OF THE INVENTION

This invention relates to improved apparatus and methods for wire-tying one or more objects. In one aspect of the invention, an apparatus includes a track assembly, a feed and tension assembly, and a twister assembly having a gripping mechanism engageable with the length of wire, a twisting mechanism including a twisting motor operatively coupled to a twist pinion engageable with the length of wire, the twist pinion being rotatable to twist a portion of the length of wire to form a knot, a cutting mechanism engageable with the length of wire proximate the knot, and an ejecting mechanism engageable with the length of wire to disengage the length of wire from the twister assembly. The gripping mechanism includes a gripper block having a wire receptacle formed therein, an opposing wall positioned proximate the wire receptacle, and a gripper disc constrained to move toward the opposing wall to frictionally engage with the length of wire disposed within the wire receptacle, the gripper disc being driven into frictional engagement with the length of wire and pinching the length of wire against the opposing wall when the drive motor is operated in the tension direction. Thus, the wire is secured using a simple, passive, economical, and easily maintained gripping mechanism.

While a combination of various subcombination assemblies combine to make this overall wire-tying apparatus and method, several of the sub-assemblies are themselves unique and may be employed in other wire tying apparatus and methods. Thus, the invention is not limited to only one combination apparatus and method.

For example, a unique passive wire gripping sub-assembly includes a wire receptacle having a slot sized to receive a first passage of wire in one portion thereof and a second passage of wire in another portion thereof, a passive gripper disk being frictionally engageable with the second passage of wire to hold the free end of the wire.

In the twister assembly, the assembly includes a multi-purpose cam rotatably driven by the twister motor, and the gripping mechanism includes a gripper release engageable with the gripper disk and actuatable by the multi-purpose cam.

A unique feature of the track assembly includes multiple ceramic or high hardness steel sections or segments disposed proximate to a corner guide at the corners of the track assembly, the sections each having a curved face at least partially surrounding the wire guide path to redirect the motion of the length of wire about the corners. The sections resist gouging from the relatively sharp free end of the length of wire as it is guided along the wire path, reducing mis-feeds, improving reliability, and enhancing durability of the apparatus. The sections are less expensive to manufacture for replacement and, by adding more sections to larger corner guides, the corner radius of the wire path may be increased with little cost increase.

In one aspect of the invention, an apparatus includes a track assembly, a feed and tension assembly, and a twister assembly having a twist motor coupled to a rotatable twist axle having a first multi-purpose cam, an ejector cam, a drive gear, and a second multi-purpose cam attached thereto, a gripping mechanism engageable with the length of wire and having a gripper cam follower engageable with the second multi-purpose cam, the gripping mechanism being actuatable by the second multi-purpose cam, a twisting mechanism having a twist pinion engageable with the length of wire, the twist pinion being actuatable by the drive gear and rotatable to twist a portion of the length of wire to form a knot, a cutting mechanism engageable with the length of wire proximate the knot and having a cutting cam follower engageable with the first multi-purpose cam, the cutting mechanism being actuatable by the first multi-purpose cam; and an ejecting mechanism engageable with the length of wire to disengage the length of wire from the twister assembly and having an ejecting cam follower engageable with the ejector cam, the ejecting mechanism being actuatable by the ejector cam. Thus, the primary functions of the twisting assembly are cam-actuated, eliminating more expensive and complex actuating mechanisms, and improving the economy of the apparatus.

Another aspect of the invention is a unique wire accumulation drum through which the length of wire is axially fed and from which the length of wire tangentially exits at its periphery to be engaged by a drive wheel. The accumulator drum is shown in alternative forms.

Another aspect of the invention is a unique feed and tension assembly pulling wire axially through a drum, then tangentially off the drum to a feed drive wheel and then back onto the periphery of the drum when tensioning the wire. Alternative forms are shown.

Another aspect of the invention is a simple shaft driven drive for twisting the wire, gripping the wire, releasing the twisted wire, and cutting the wire.

Another aspect of the invention is a passive wire gripper that uses the friction of the wire to cause the wire free end to be squeezed and held against movement out of the twister mechanism. The passive wire gripper has several alternative forms.

These and other benefits of the present invention will become apparent to those skilled in the art based on the following detailed description.

BRIEF DESCRIPTION OF THE DRAWINGS

FIGS. 4-1 through 4-8 are schematic operational views of one embodiment of the feed and tension assembly.

FIGS. 4A-1 through 4A-9 are schematic operational schematics of the embodiment of FIG. 4A.

FIG. 5 is an exploded isometric view of an accumulator of the feed and tension assembly of FIG. 4.

FIG. 6 is an exploded isometric view of a drive unit of the feed and tension assembly of FIG. 4.

FIG. 7 is an exploded isometric view of a stop block of the feed and tension assembly of FIG. 4.

FIG. 8 is an isometric view of a wire feed path of the feed and tension assembly of FIG. 4.

FIG. 9 is an isometric view of a twister assembly of the wire-tying machine of FIG. 1.

In the drawings, identical reference numbers identify identical or substantially similar elements or steps.

DETAILED DESCRIPTION OF THE INVENTION

The present disclosure is directed toward apparatus and methods for wire-tying bundles of objects. Specific details of certain embodiments of the invention are set forth in the following description, and in FIGS. 1–25, to provide a thorough understanding of such embodiments. A person of ordinary skill in the art, however, will understand that the present invention may have additional embodiments, and that the invention may be practiced without several of the details described in the following description.

Figure 1:
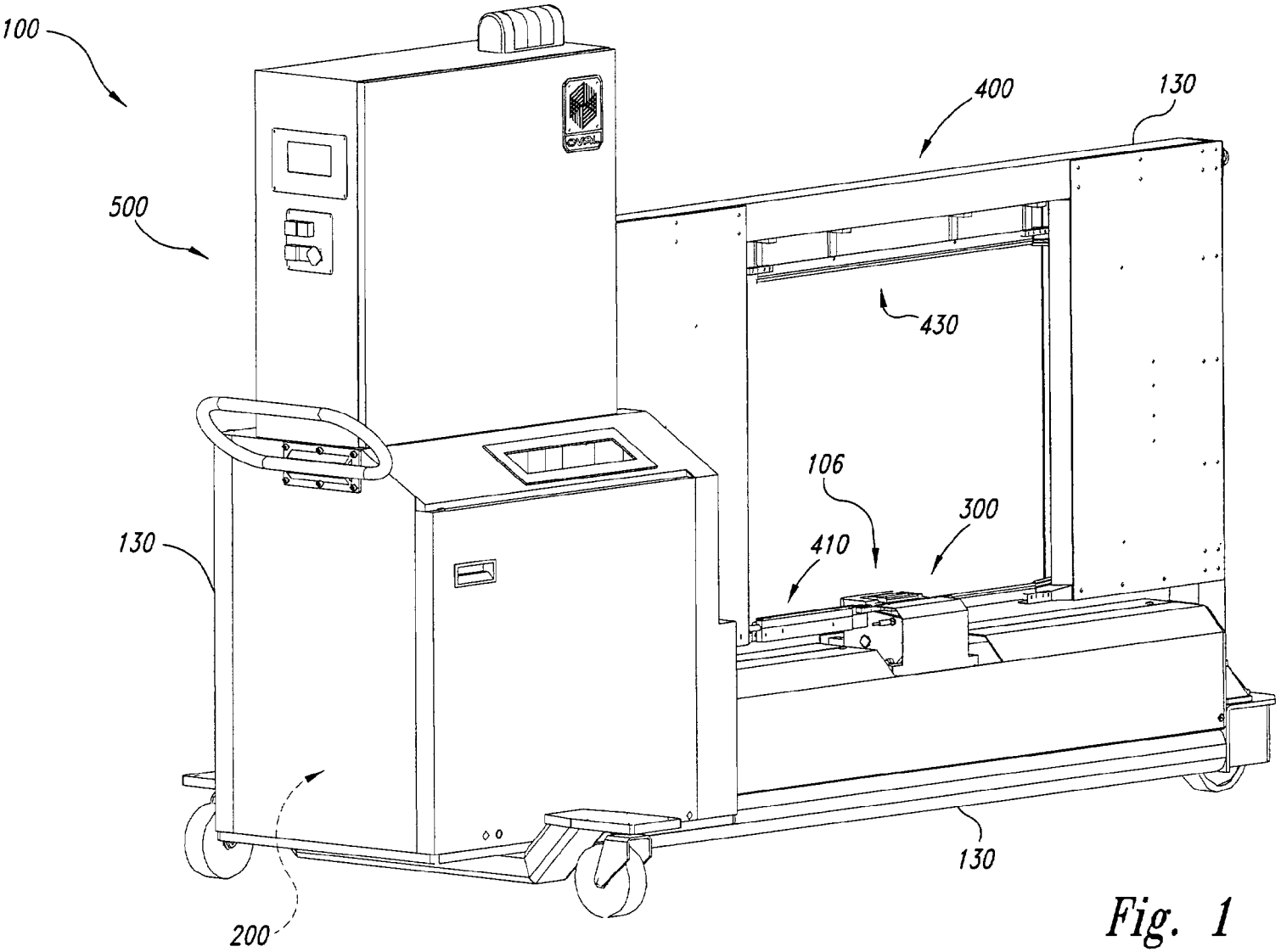
FIG. 1 is a front isometric view of a wire-tying machine in accordance with the invention.
Figure 2:
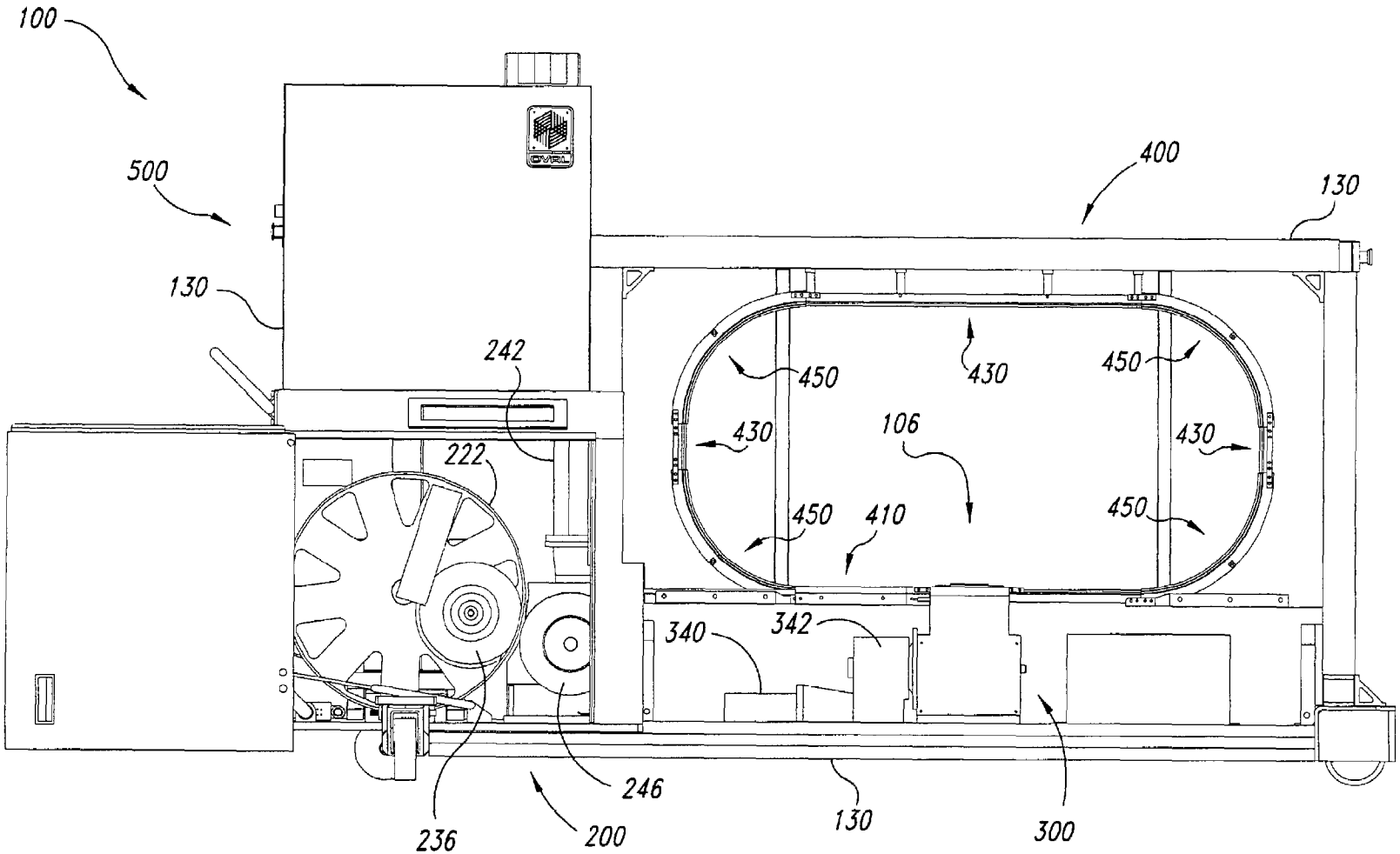
FIG. 2 is a front elevational view of the wire-tying machine of FIG. 1.
Figure 3:
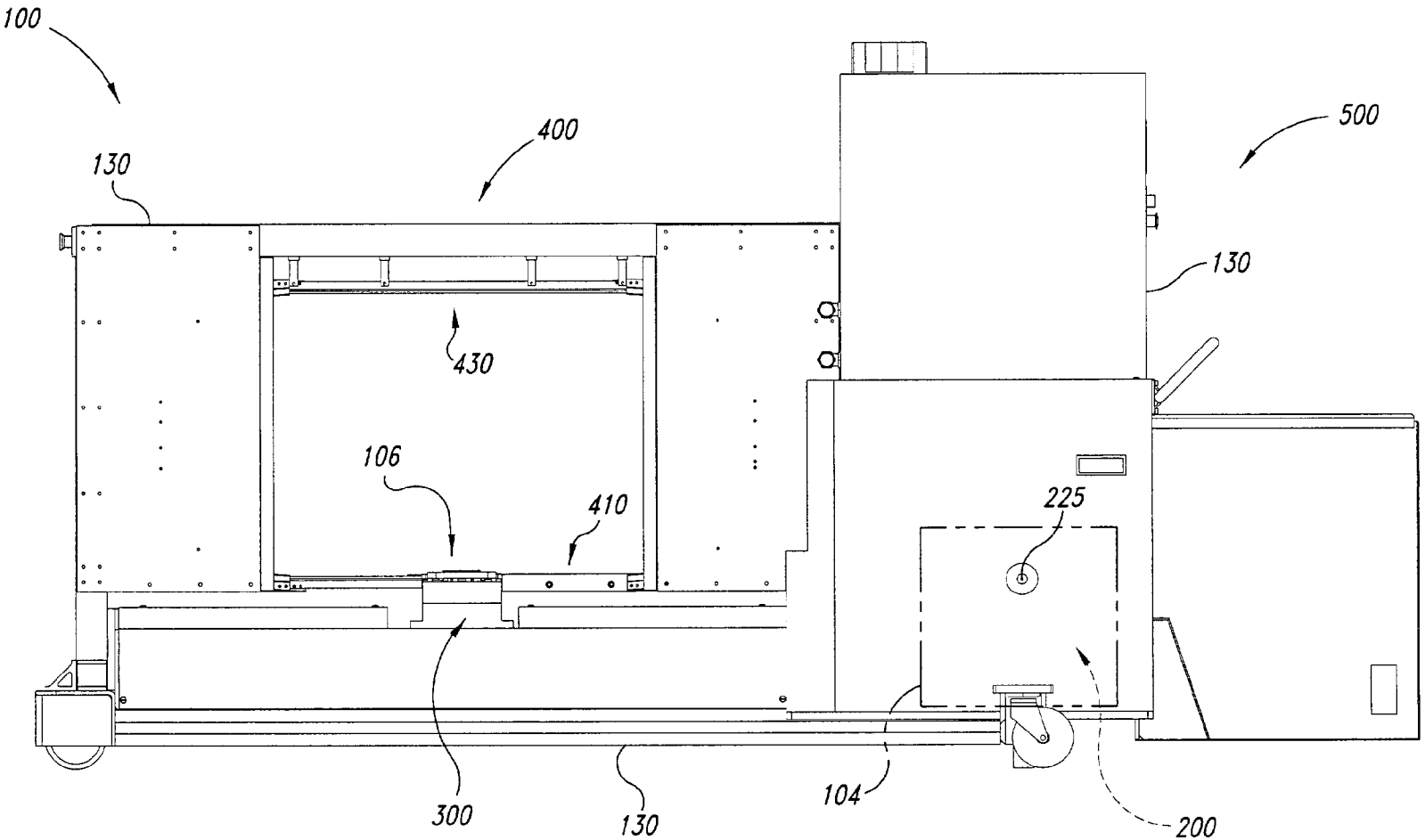
FIG. 3 is a back elevational view of the wire-tying machine of FIG. 1.

FIG. 1 is a front isometric view of a wire-tying machine 100 in accordance with an embodiment of the invention. FIGS. 2 and 3 are front partial sectional and back elevational views, respectively, of the wire-tying machine 100 of FIG. 1. The wire-tying machine 100 has several major assemblies, including a feed and tension assembly 200, a twister assembly 300, a track assembly 400, and a control system 500. The wire-tying machine 100 includes a housing 130 that structurally supports and/or encloses the major subassemblies of the machine.

In brief, the overall operation of the wire-tying machine 100 begins with the feed and tension assembly 200 drawing a length of wire 102 from an external wire supply 104 (e.g., a spool or reel, not shown) into the wire-tying machine 100 past the ring sensor 412. The length of wire 102 is then fed by depressing a manual feed button switch actuator, whereupon, the free end of the length of wire 102 is pushed through the twister assembly 300, into and about the track assembly 400, and back into the twister assembly 300. The track assembly 400 forms a wire guide path 402 that substantially surrounds a bundling station 106 where one or more objects may be positioned for bundling.

Once the length of wire 102 has been completely fed about wire path 402, manual or automatic operation is possible. The control system 500 signals the feed and tension assembly 200 to tension the length of wire 102 about the one or more objects. During a tension cycle, the feed and tension assembly 200 pulls the length of wire 102 in a direction opposite the feed direction. The track assembly 400 opens releasing the length of wire 102 from the wire guide path 402, allowing the length of wire 102 to be drawn tightly about the one or more objects within the bundling station 106. An excess length of wire 114 is retracted back into the feed and tension assembly 200 and accumulated about the accumulator drum 222 until the control system 500 signals the feed and tension assembly 200 to stop tensioning, as described more fully below.

After the tension cycle is complete, (the free end 108 of the length of wire 102, having been securely retained by the gripper subassembly 320 of the twister assembly 300 during the tension cycle) the twister assembly 300 joins the free end 108 of the length of wire 102*b* to an adjacent portion of the length of wire 102*a* forming a fixed constricting wire loop 116 about the one or more objects forming a bundle 120. The wire loop 116 is secured by twisting the free end of the length of wire 102*b* and the adjacent portion of the length of wire 102*a* about one another to form a knot 118. The twister assembly 300 then severs the knot 118, and the formed wire loop 116, from the length of wire 102. The twister assembly 300 then ejects the knot 118 and returns all components of the twister assembly 300 to the home position. A feed cycle is subsequently initiated, at which time, the bundle 120 may be removed from the bundling station 106. All succeeding feed cycles will thus re-feed any accumulated wire 102 from about the accumulator drum 222 prior to again drawing sufficient added wire 102 from the external wire source 104 (not shown) to complete said feed cycles, until the external wire source 104 has been depleted and the load cycle must be repeated. At the completion of any feed cycle the overall sequence of cycles may be re-initiated.

Generally, there are five operational cycles utilized by the wire-tying machine 100: the load cycle, the feed cycle, the tension cycle, the twist cycle, and the wire reject cycle. The wire tying machine 100 may be operated in a manual mode or in an automatic mode. The feed, tension, and twist cycles normally operate in the automatic mode, but may be operated in the manual mode, for example, for maintenance and clearing wire from the machine. These cycles may also overlap at various points in the operation. The load and wire reject cycles are usually operated in the manual mode only. The five operational cycles and the two operating modes of the wire-tying machine 100 are described in greater detail below.

Figure 4:
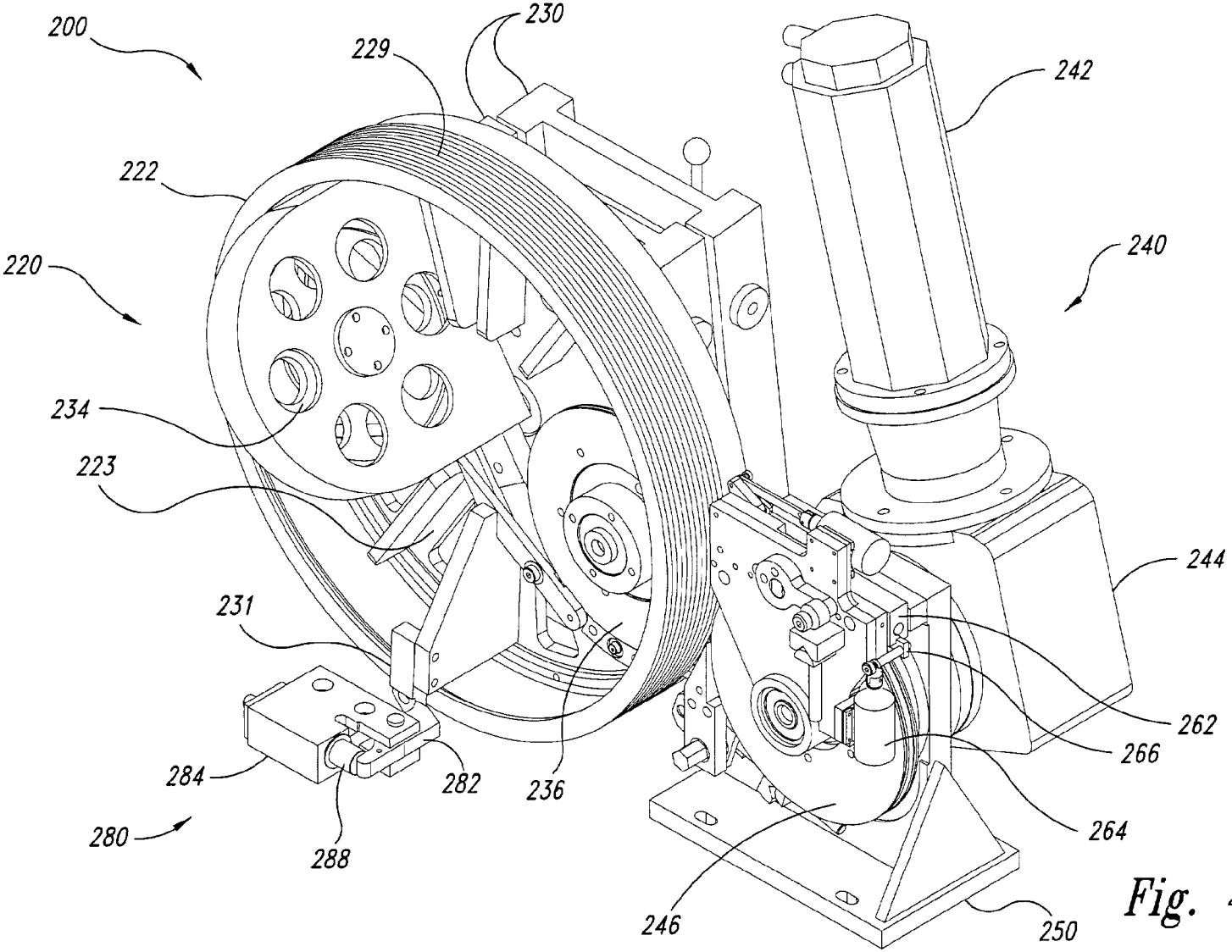
FIG. 4 is a front isometric view of a feed and tension assembly of the wire-tying machine of FIG. 1.
Figures 2, 4:
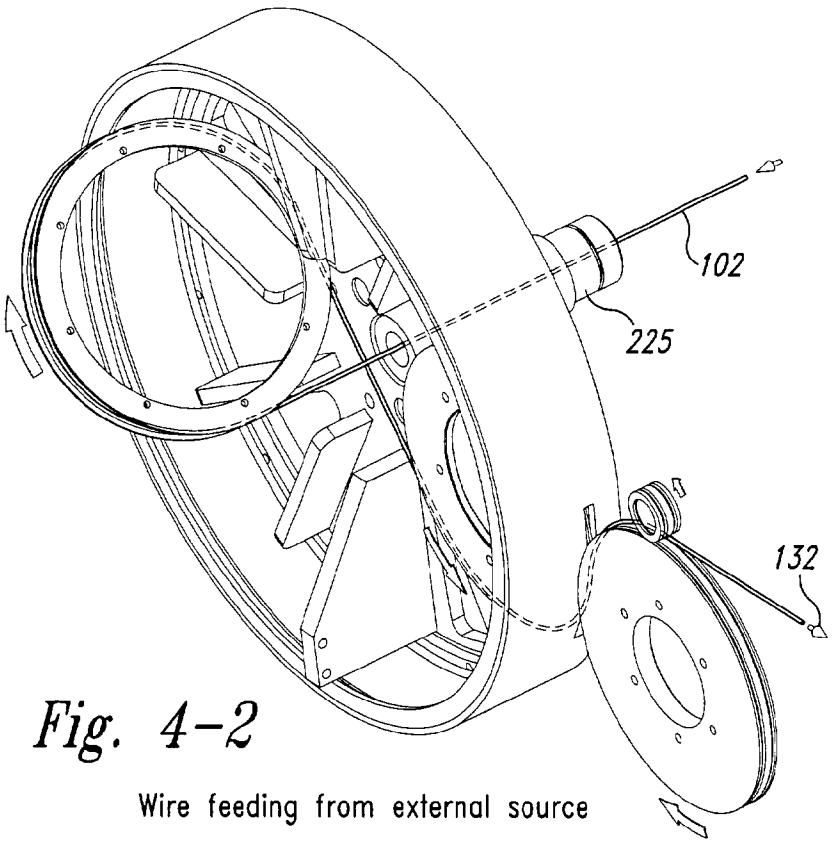
Figures 1, 4:
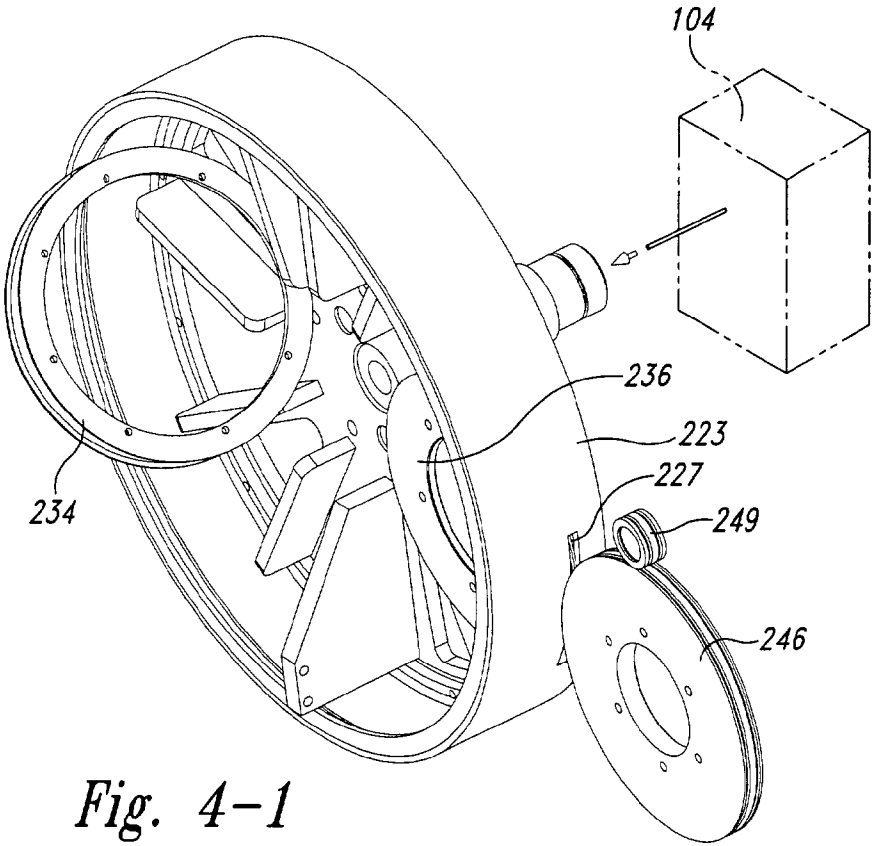
Figure 4:
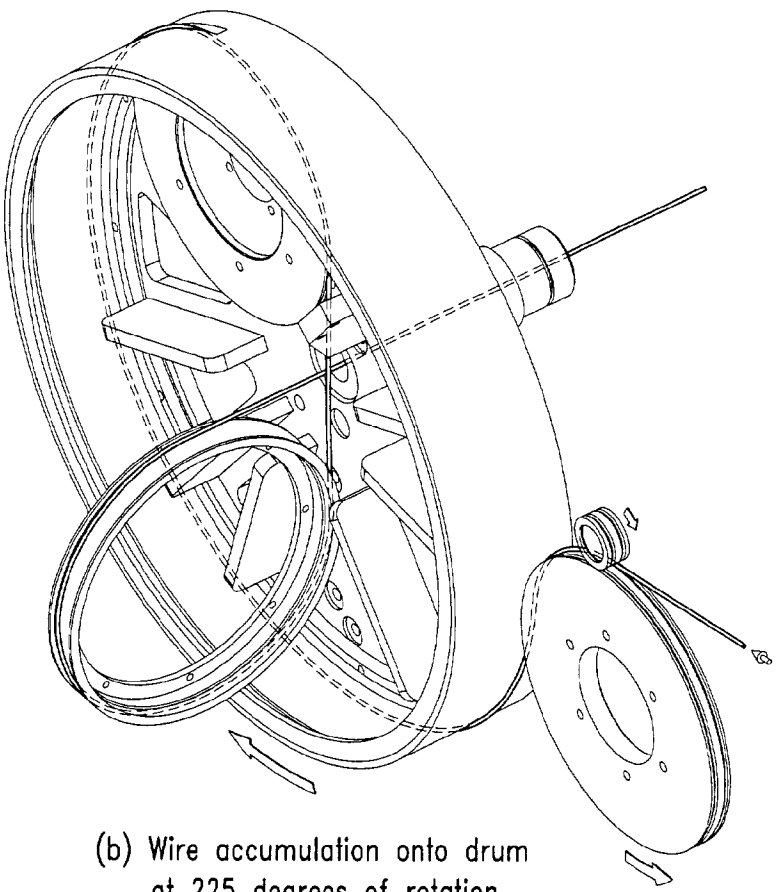
Figures 3, 4:
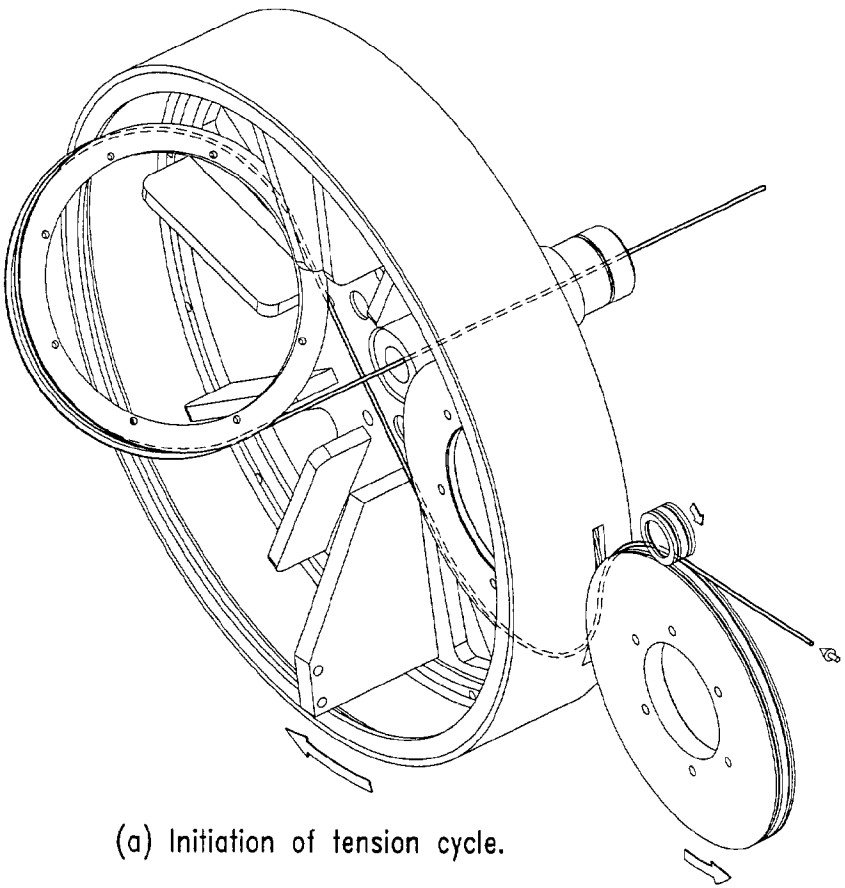

FIG. 4 is a front isometric view of the feed and tension assembly 200 of the wire-tying machine 100 of FIG. 1. As shown in FIG. 4 the feed and tension assembly 200 includes an accumulator subassembly 220, a drive subassembly 240, and a stop block subassembly 280. The accumulator subassembly 220 provides greater capacity than that necessary to accumulate all of the length of wire 102 fed into the largest wire-tying machine currently envisioned. The drive subassembly 240 provides the driving force requisite for feeding and tensioning the length of wire 102. Further, the interaction between the accumulator subassembly 220 and the drive subassembly 240 produce a compressive impingement upon the length of wire 102 which efficiently transfers the driving force frictionally into the length of wire 102. The stop block subassembly 260 indexes the accumulator subassembly 220 in its neutral home position and damps the motion of the accumulator drum 222 at the transition between feeding the length of wire 102 from the accumulator drum 222 to feeding the length of wire 102 from the external wire source 104. In some instances of the feed and tension assembly 200, the stop block subassembly 280 may be incorporated into the accumulator subassembly 220 and the drive subassembly 240, as shown in FIG. 4A.

Figures 4, 5:
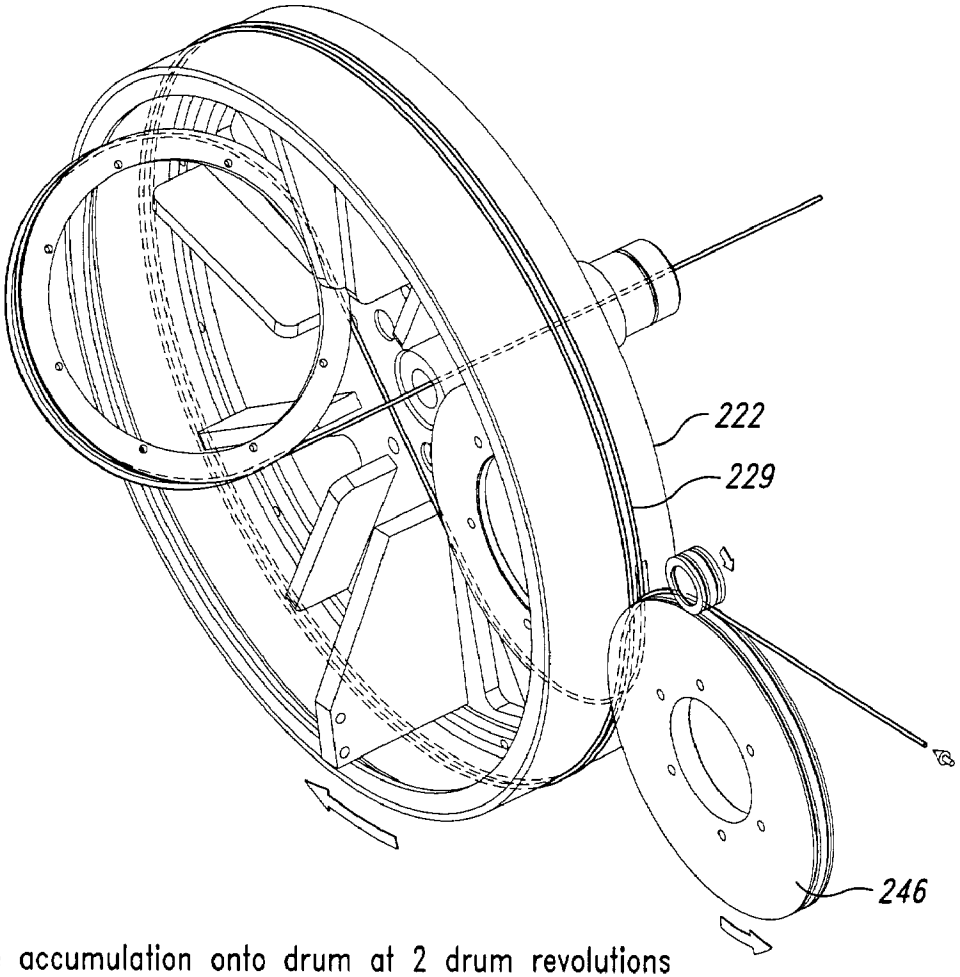
Figures 4, 5, 6, 7:
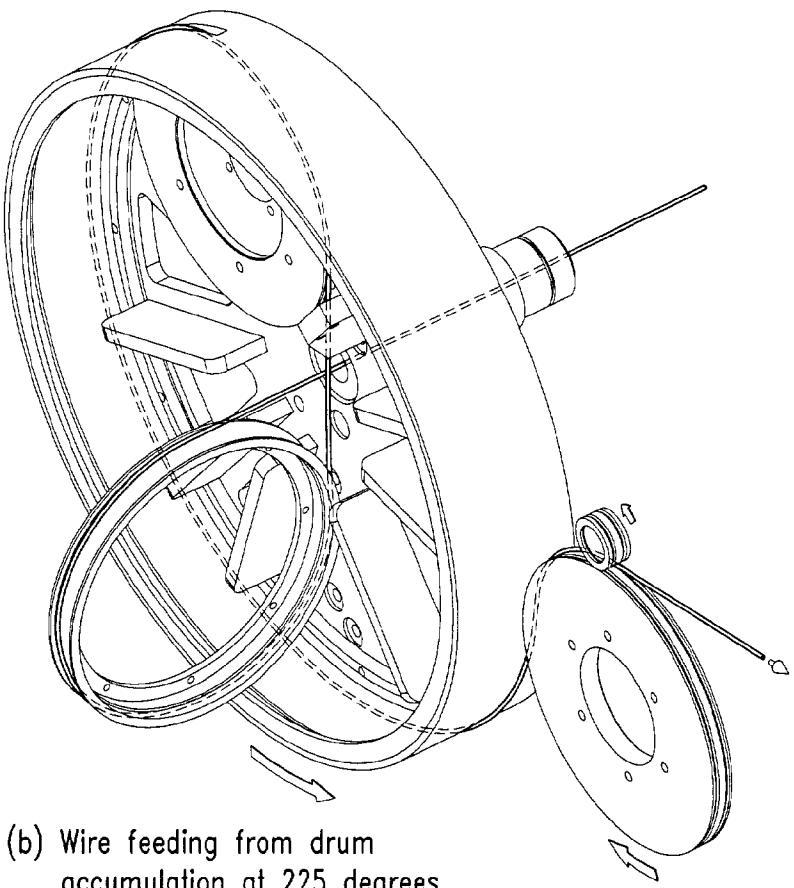
Figures 4, 5, 6:
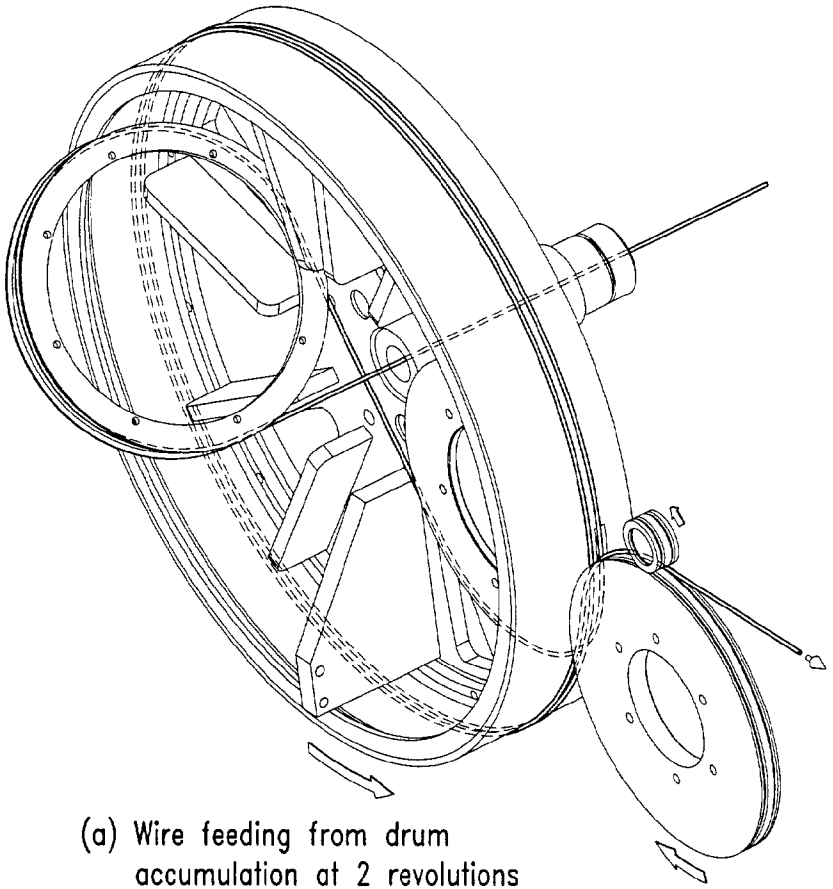
Figures 4, 5, 6, 7, 8:
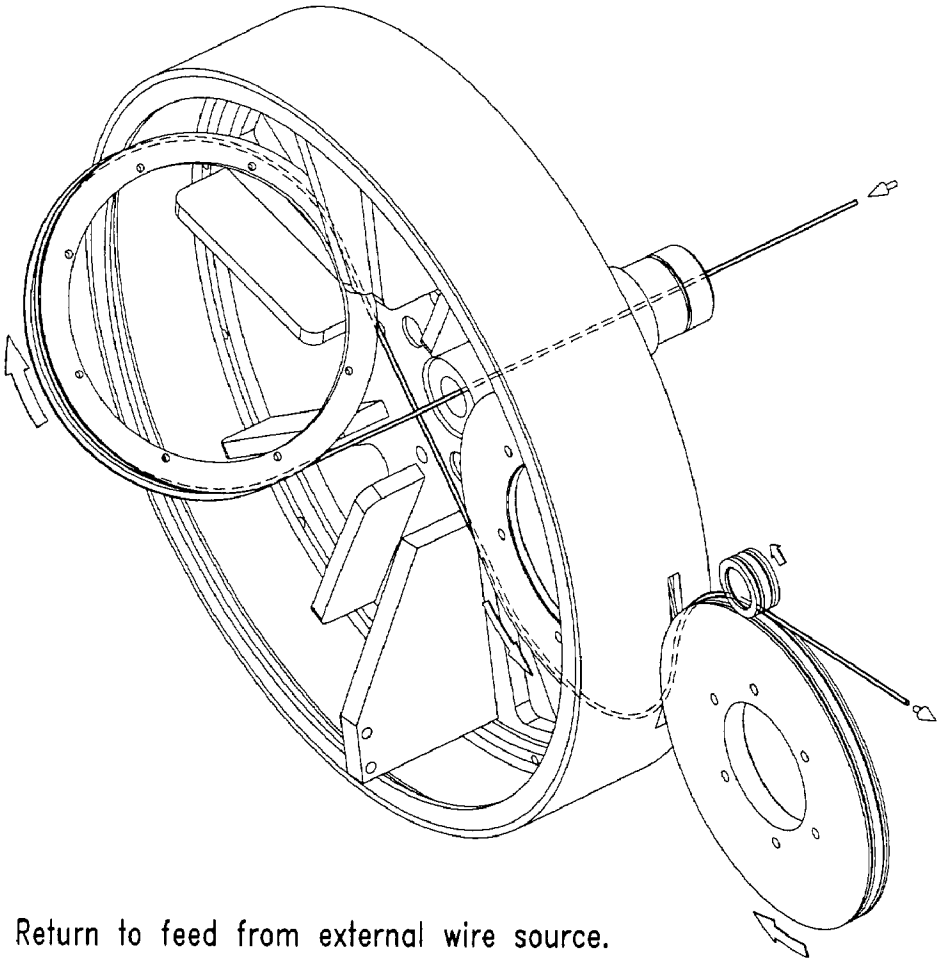
Figure 4A:
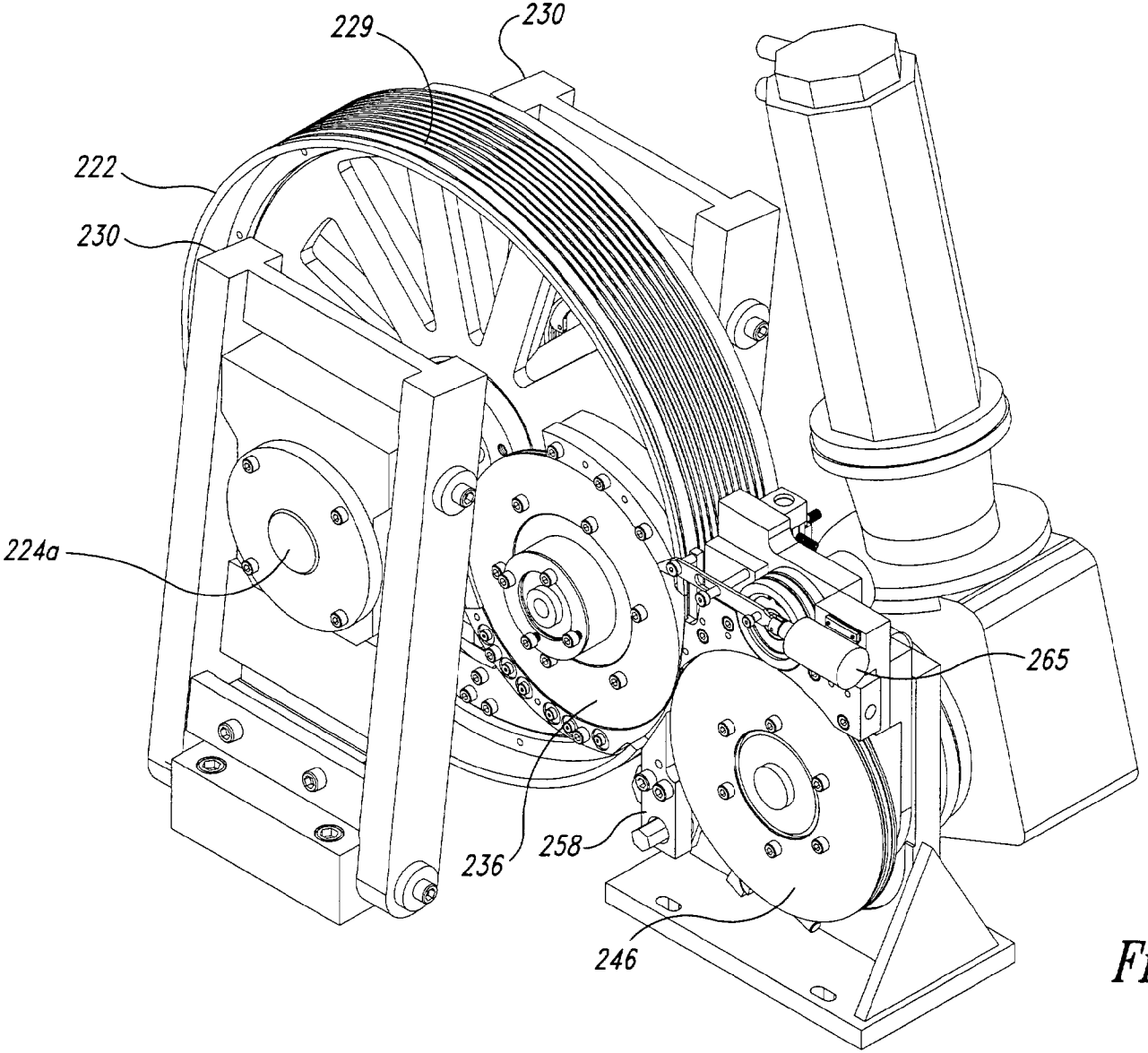
FIG. 4A is an alternative form of feed and tension assembly.
Figures 2, 4A:
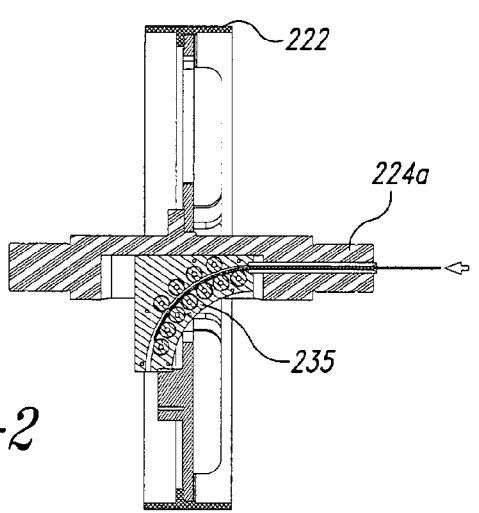
Figures 1, 4A:
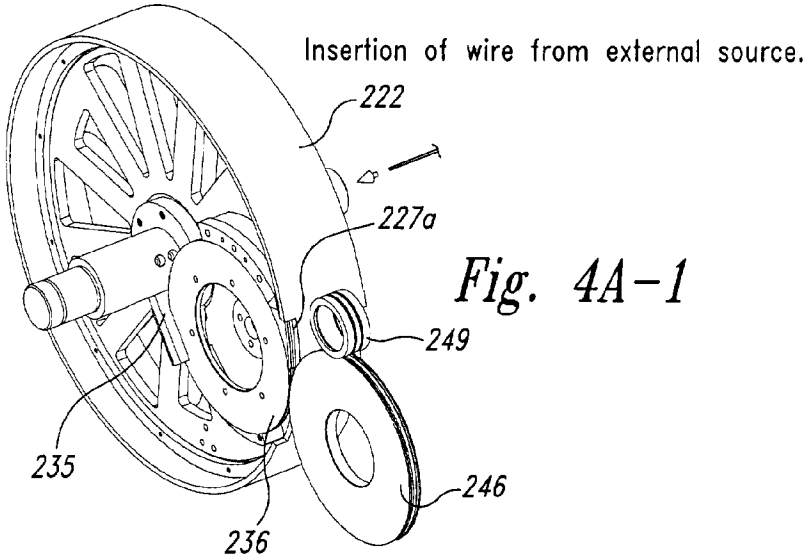
Figures 3, 4A:
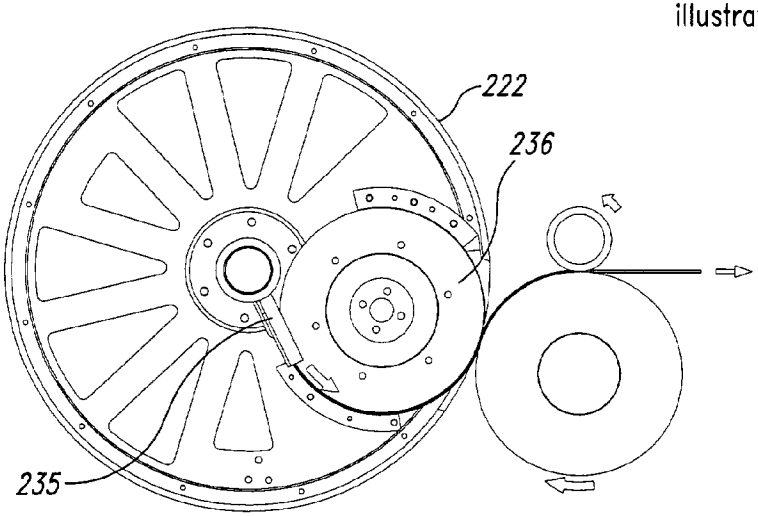
Figures 4, 4A, 5:
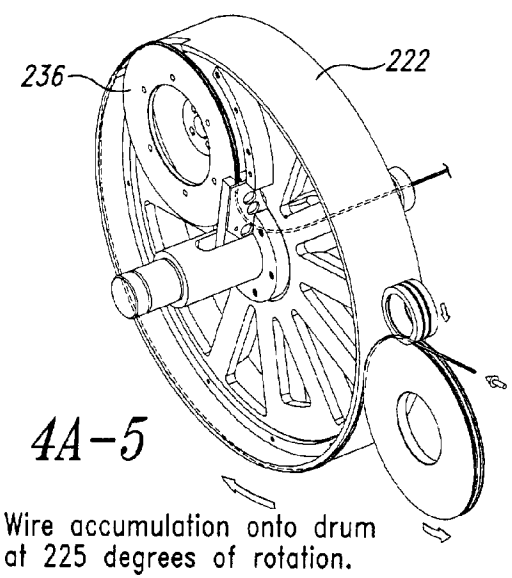
Figures 4, 4A:
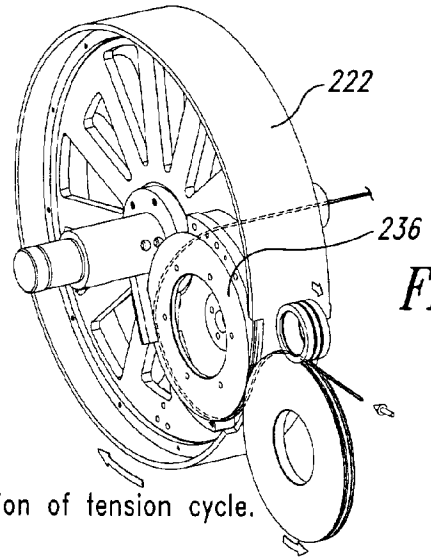
Figures 4, 4A, 5, 6:
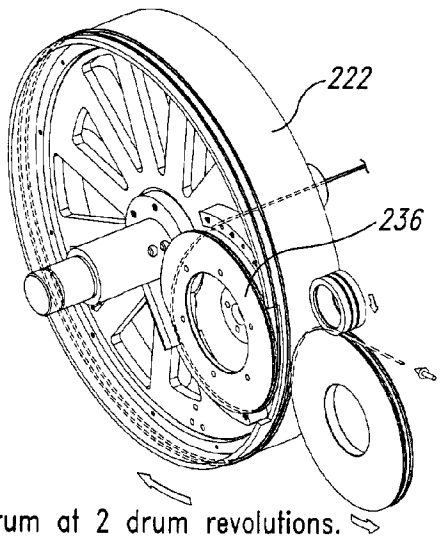
Figures 4, 4A, 5, 6, 7, 8:
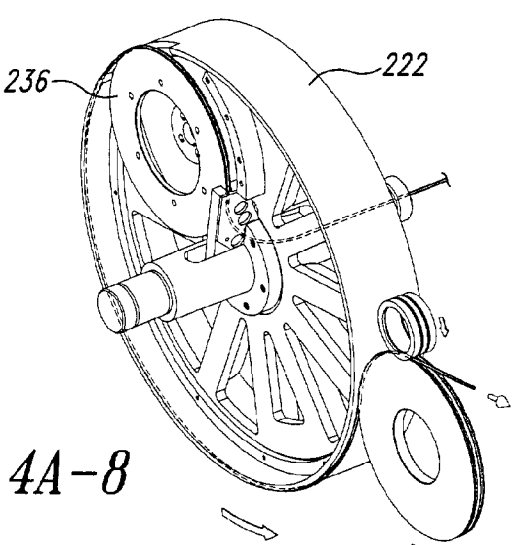
Figures 4, 4A, 5, 6, 7:
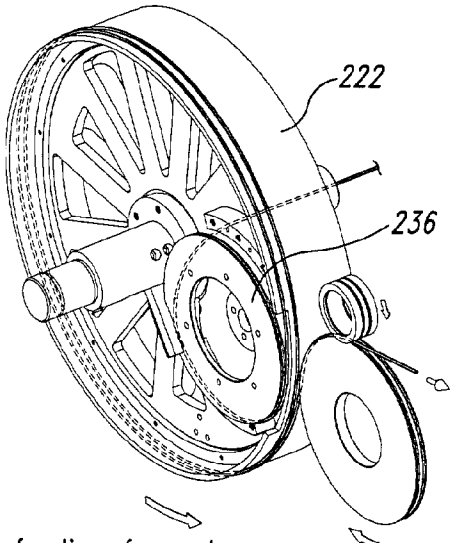

FIG. 5 is an exploded isometric view of the accumulator subassembly 220 of the feed and tension assembly 200 of FIG. 4. FIG. 6 is an exploded isometric view of the drive assembly 240 of the feed and tension assembly 200 of FIG. 4. FIG. 7 is an exploded isometric view of the stop block subassembly 280 of the feed and tension assembly 200 of FIG. 4. FIG. 8 is an isometric view of a wire feed path 202 of the feed and tension assembly 200 of FIG. 4.

As best seen in FIGS. 4, 5 and 8, the accumulator subassembly 200 includes an accumulator drum 222 mounted on an accumulator hub 223 that is concentrically supported on an accumulator axle 224. A wire inlet tube 225 is disposed through the center of the accumulator axle 224, and a wire passage 227 is disposed in the accumulator drum 222. Thus, as can be seen the wire enters the drum axially. Also, a continuous helical groove 229 is disposed within an outer surface of the accumulator drum 222, and a stop finger 231 is attached to a lateral edge of the accumulator drum 222.

A bearing block 226 houses a pair of accumulator bearings 228 that rotatably support the accumulator axle 224 in cantilevered fashion. A pair of supports 230 are pivotably coupled to the bearing block 226 and to a mounting plate 232 that is secured to the housing 130, allowing the accumulator drum 222 to move laterally (side-to-side) within the housing 130 during the feeding and tensioning of the length of wire 102.

Figure 5:
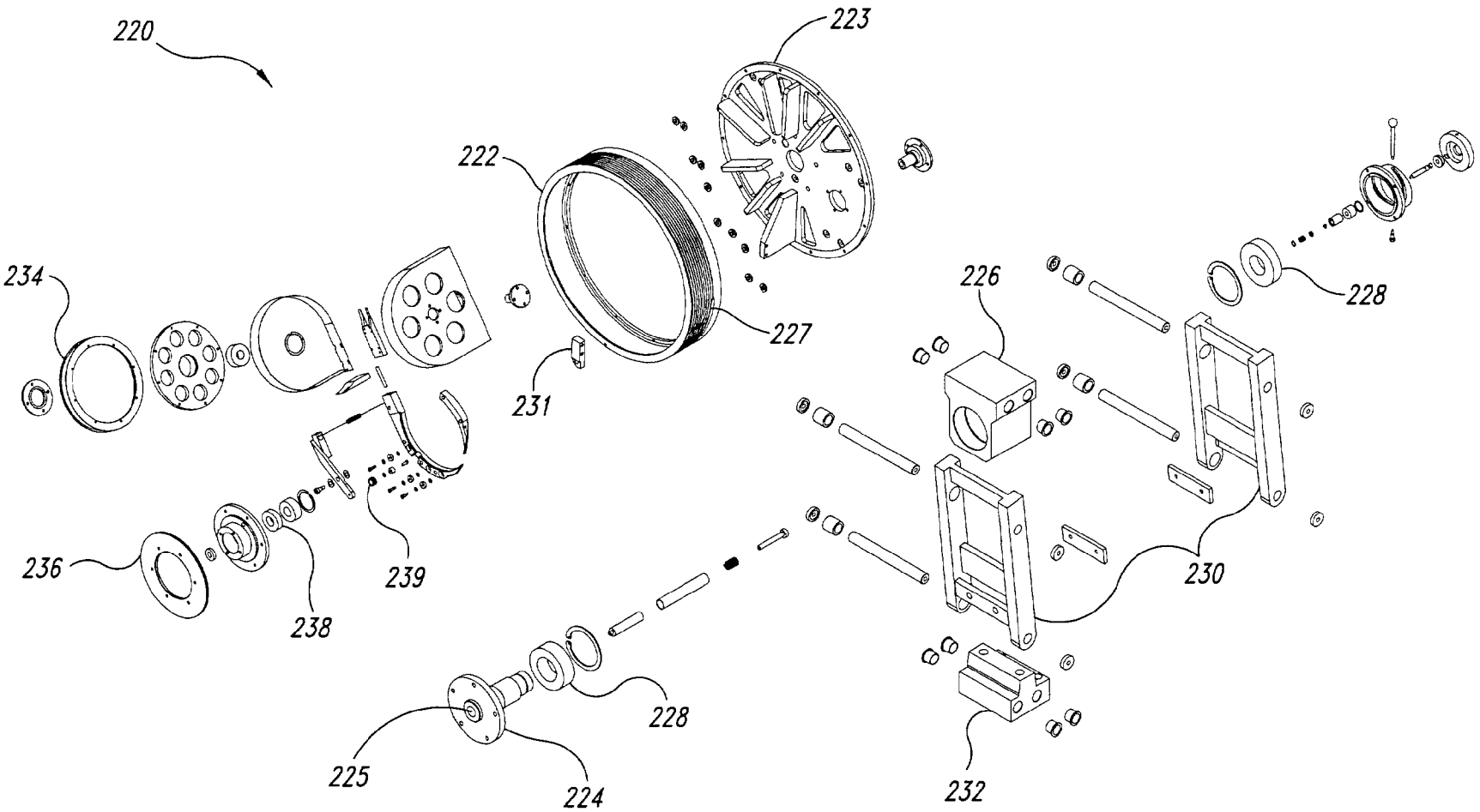
Figure 5A:
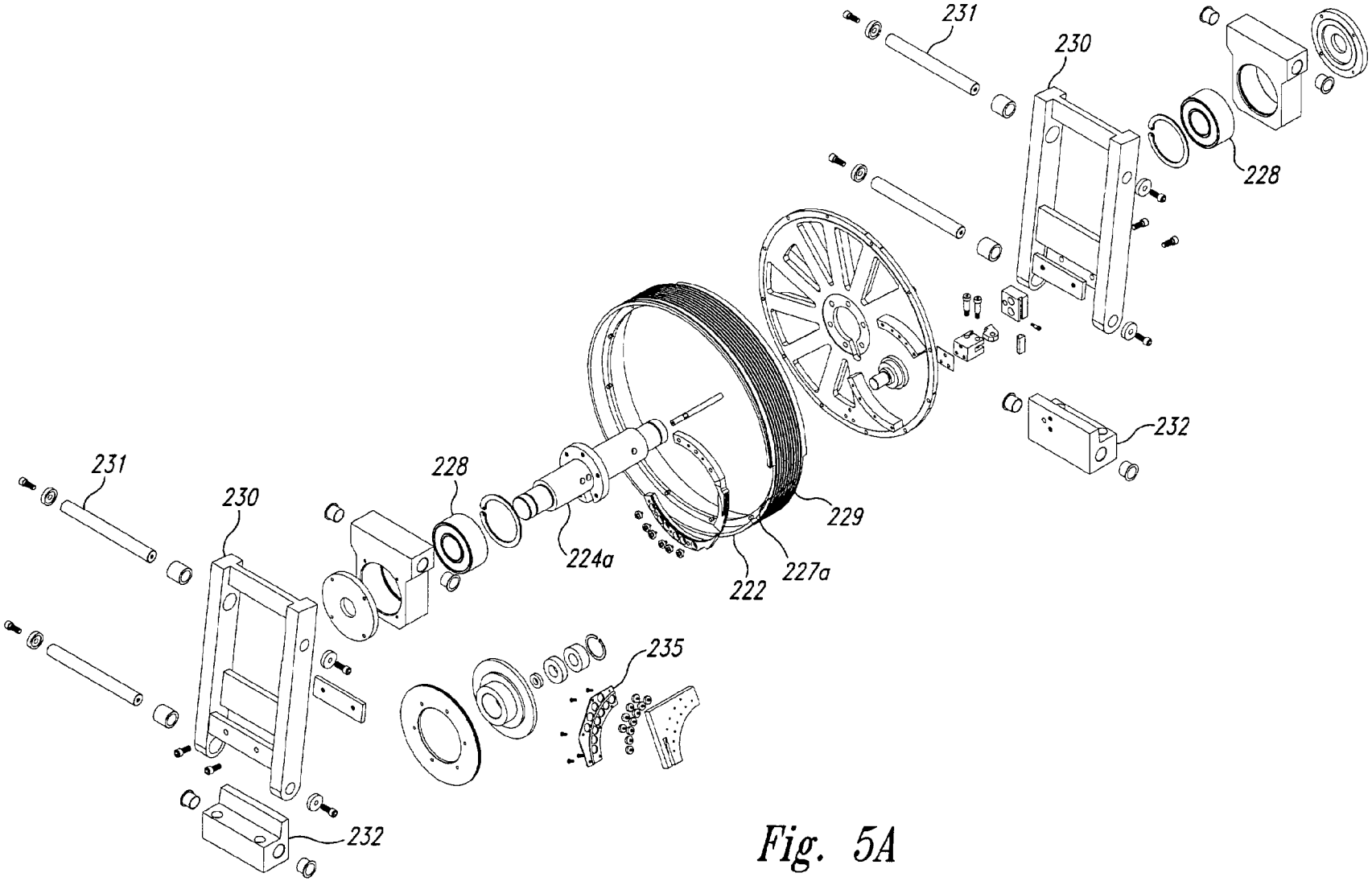
FIG. 5A is a schematic exploded isometric view of a modified form of the accumulator.

As shown in FIGS. 4A and 5A, in the alternative, the drum 222 can be mounted on an axle 224*a*, that is rotatably mounted on supports 230 that are on either side of the accumulator drum rather than on one side as in FIG. 4. The supports are pivotally mounted in mounting plates 232 that have bearings 228 that are swing mounted on pins 231. Thus, the drum can be freely swung transversely along its rotational axis to allow the wire to wrap into the helical groove 229 on the drum.

The feeding of wire axially through the hub of the accumulation drum and then tangentially out to the drive wheel as shown in both embodiments is a unique feature of the invention. It provides for fast delivery of the wire to the track and fast and easy accumulation of the wire free from kinking or buckling as in other accumulating techniques. The drum also eliminates the need for prior art type accumulation compartments that need to be re-sized when tracks get larger for larger bundles.

A transverse wheel or transverse guide wheel 234 is affixed to the accumulator hub 223 adjacent to the wire inlet tube 225. A tangent guide wheel 236 is mounted on a one-way clutch 238 that is also affixed to the accumulator hub 223. The clutch 238 restricts rotation of the tangent guide wheel 236 to the feed direction only. A tangent pinch roller 239 is springably biased against the tangent guide wheel 236.

As shown in FIGS. 4-1 and 4-2, the length of wire 102 is passed into and through the wire inlet tube 225 during the initial feed cycle (load cycle), approximately 270 degrees about the transverse wheel 234, and thence, approximately 132 degrees about the tangent wheel 236. The transverse wheel 234 diverts the incoming length of wire 102 into the plane of the accumulator hub 223. The tangent wheel 236 accepts the length of wire 102, which then passes about the tangent wheel 236 and under the pinch roller 239 (FIG. 5). Upon reaching the nip point between the tangent pinch roller 239 and the tangent wheel 236, power is transferred from the slowly rotating tangent wheel 236, being driven by frictional contact with the drive wheel 246, and carries the length of wire 102 through the wire passage 227 (FIG. 5) discharging the length of wire 102 approximately tangent the periphery of the accumulator drum 222. The length of wire 102 is then drawn about the drive wheel 246 and through the drive subassembly 240.

As best shown in FIG. 6, the drive subassembly 240 includes a drive motor 242 coupled to a 90° gear box 244. Although a variety of drive motor embodiments may be used, including hydraulic and pneumatic motors, the drive motor 242 preferably is an electric servo-motor. A drive wheel 246 is driveably coupled to the gear box 244 by a drive shaft 248. A drive base 250 supports a drive eccentric 251 that includes a drive bearing 252 which rotatably supports the drive shaft 248. The drive base 250 is attached to the housing 130 of the wire-tying machine 100. A drive pinch roller 249 is biased against the drive wheel 246, assisting in the transfer of power from the drive wheel 246 to the length of wire 102 during a feed cycle.

A drive tension spring 254 exerts an adjustable drive force on the drive eccentric 251, thereby biasing the drive wheel 246 against the tangent guide wheel 236 (or the accumulator drum 222). In this embodiment, the drive tension spring 254 is adjusted by adjusting the position of a nut 255 along a threaded rod 256. The threaded rod 256 is coupled to a drive tension cam 258. The drive force from the drive wheel may be disengaged by rotating the drive tension cam 258 from its over-center position to allow the drive wheel to be spaced away from the accumulator drum. This is done manually by engaging the hex-shaped pin on the cam 258 with a wrench. By removing the drive engagement between the drive wheel and the accumulator drum, wire can be removed by hand from the feed and tension assembly.

The drive subassembly 240 further includes a drive entry guide 260 and a drive exit guide 262 positioned proximate the drive wheel 246 and the drive pinch roller 249. Together with the drive pinch roller 249, the drive entry guide 260 and drive exit guide 262 maintain the path of the length of wire 102 about the drive wheel 246. In this embodiment, the length of wire 102 contacts the drive wheel 246 over an approximately 74.5° arc, although the arc length of the contact area may be different in other embodiments. An exhaust solenoid 264 is coupled to an exhaust pawl 266 that engages the drive exit guide 262. The exhaust solenoid 264 may be actuated to move the exhaust pawl 266, causing the drive exit guide 262 to deflect the wire 102 from its normal wire feed path 202 (FIG. 8) into an exhaust feed path 204 as necessary, such as when it is necessary to remove wire stored on the accumulator drum 222. Similarly, a drive solenoid 265 (FIG. 6) is coupled to a feed pawl 267 for directing the length of wire 102 onto the drive wheel 246 during the load cycle which cycle terminates shortly after the length of wire 102 has passed through the drive subassembly 240.

The length of wire 102 must be fed through the twister assembly 300, about the track assembly 400, and back into the twister assembly 300 to be ready to bind the one or more objects within the bundling station 106. At the start of the load cycle the accumulator drum 222 of the accumulator subassembly 220 is in the home position and the drive wheel 246 is aligned with the tangent wheel 236. In this position the length of wire 102 is compressed between the drive wheel 246 and the tangent wheel 236. The drive motor 242 is actuated causing the drive wheel 246 to rotate in the feed direction 132 (see arrows 132 in FIGS. 4–2). Motion is imparted to the length of wire 102 and to the tangent wheel 236 through friction. The length of wire 102 is thus pushed through the twister assembly 300, about the track assembly 400, and back into the twister assembly 300, at which time the drive motor 242 is halted.

FIGS. 4-3 through 4-5 show the wire path during the tension cycle. When the tension cycle is initiated, the drive motor 242 starts rotating the drive wheel 246 in the tension direction. The length of wire 102, being compressed between the drive wheel 246 and the tangent wheel 236 is forced in the direction opposite of the feed direction. Because the tangent wheel 236 is constrained to rotate only in the feed direction, and because the tangent wheel 236 is rotatably affixed to the accumulator hub 223, the transfer of motion from the drive wheel 246 and through the length of wire 102 causes the accumulator drum 222 to rotate in the tension direction. The length of wire 102 is thus wound into the helical groove 229 of the accumulator drum 222. The drive wheel 246 delivers its torque through the drive eccentric 251 such that the drive wheel 246 produces increased compressive loading on the length of wire 102 as the imparted torque increases. This reduces the possibility of drive wheel 246 slippage during tensioning.

FIGS. 4-6 through 4-8 show a typical feed cycle. The feed cycle is initiated as soon as the twist cycle has been completed, as described more fully below. At the start of the feed cycle, the drive wheel 246 is activated in the feed direction. The length of wire 102 is typically compressed between the drive wheel 246 and the accumulator drum 222, and is entrained in the helical groove 229 thereon, and is thus fed from about the accumulator drum 222. As the accumulator drum 222 returns to the home position, the tangent wheel 236 re-aligns with the drive wheel 246 and the stop finger impinges on the stop block subassembly 280 slowing the motion of the accumulator drum 222 to a stop. The length of wire 102 continues to feed, but the path is returned to feeding from the external wire reservoir 104 (not shown). This continues as described for the load cycle above until the feed cycle is terminated. The feed and tension assembly 200 is now ready to duplicate overall procedure from the start of the tension cycle.

Referring to FIG. 7, the stop block subassembly 280 includes a stop pawl 282 pivotably attached to a stop block base 284 by a pawl pivot pin 286. The stop block base 284 is rigidly attached to the housing 130 of the wire-tying machine 100. A stop plunger 288 is disposed within a stop spring 290 and is partially constrained within the stop block base 284. The stop plunger 288 engages a first end 292 of the stop pawl 282. A stop pawl return spring 294 is coupled between the stop block base 284 and a second end 296 of the stop pawl 282.

The stop block subassembly 280 is rigidly affixed to the housing 130 to check rotation of the accumulator drum 222 and to index its position relative to the drive wheel 246 when no wire is stored on the accumulator subassembly 220. In operation, the second end 296 of the stop pawl 282 engages the stop finger 231 to slow and stop rotation of the accumulator drum 222. When the stop finger 231 strikes the stop pawl 282 it depresses the stop plunger 288 and the stop spring 290. The stop spring 290 absorbs the shock prior to bottoming out and stopping the movement of the accumulator drum 222. The stop pawl 282 is free to deflect clear of the stop finger 231 if struck in the wrong direction, such as may happen, for example, in a rare instance when the feed and tension assembly 200 malfunctions by skipping out of the helical groove 229 of the accumulator drum 222 during tensioning.

FIGS. 4A, 4A-1 through 4A-9, 5A, and 6A show an alternative form of feed and tension assembly. In this embodiment, the transverse guide wheel is eliminated and a curved roller axle tube 235 (FIG. 5A) feeds the wire through the hub of the accumulation drum and guides the wire directly into the rim of the tangent guide wheel 236. Further, in some instances of the feed and tension assembly 200, the elements and functions of the stop block subassembly 280 are incorporated into the accumulator subassembly 220 and the drive subassembly 240. In this preferred embodiment, the operation is best shown in FIGS. 4A-1 to 4A-9. Again, the wire feeds axially through the drum axle 224*a*, then through the curved roller axle tube 235, exiting at the tangent guide wheel 236, then through the slot 227*a* (FIG. 5A), about the drive wheel 246, and between the pinch roller 249 and the drive wheel 246.

In the tension cycle in FIGS. 4A-4 to 4A-6, the wire is retracted by the drive wheel and lays the wire in the groove of the rotating accumulator drum 222. As the wire feeds into the helical groove on the drum, the drum moves freely laterally (along its axis of rotation).

As best shown in FIGS. 4A-7 to 4A-9, when wire is to be re-fed into the track, the wire is first fed from the accumulator drum, until all accumulated wire is off the periphery of the drum and then additional wire is fed from the supply.

Figure 6:
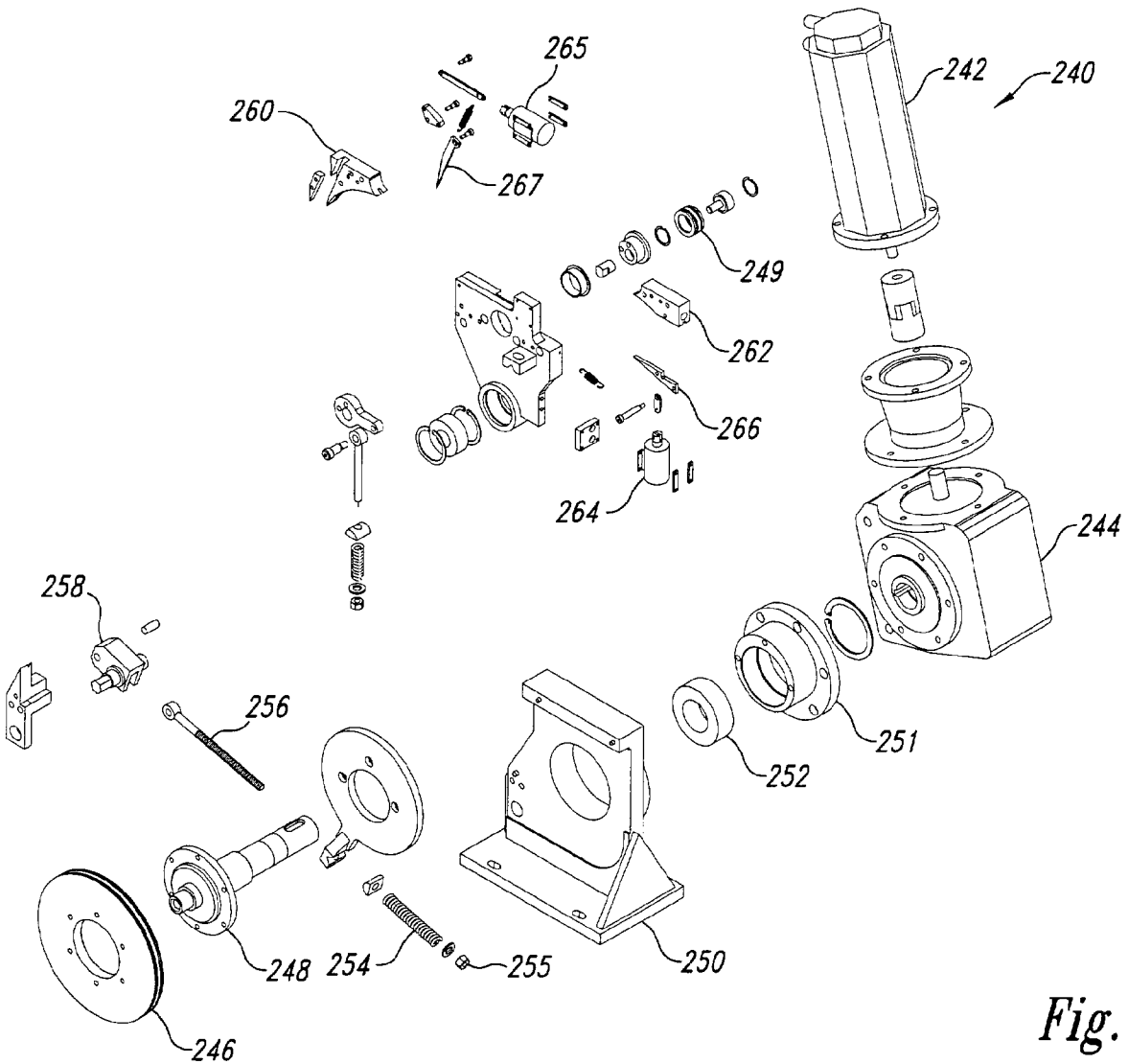
Figure 6A:
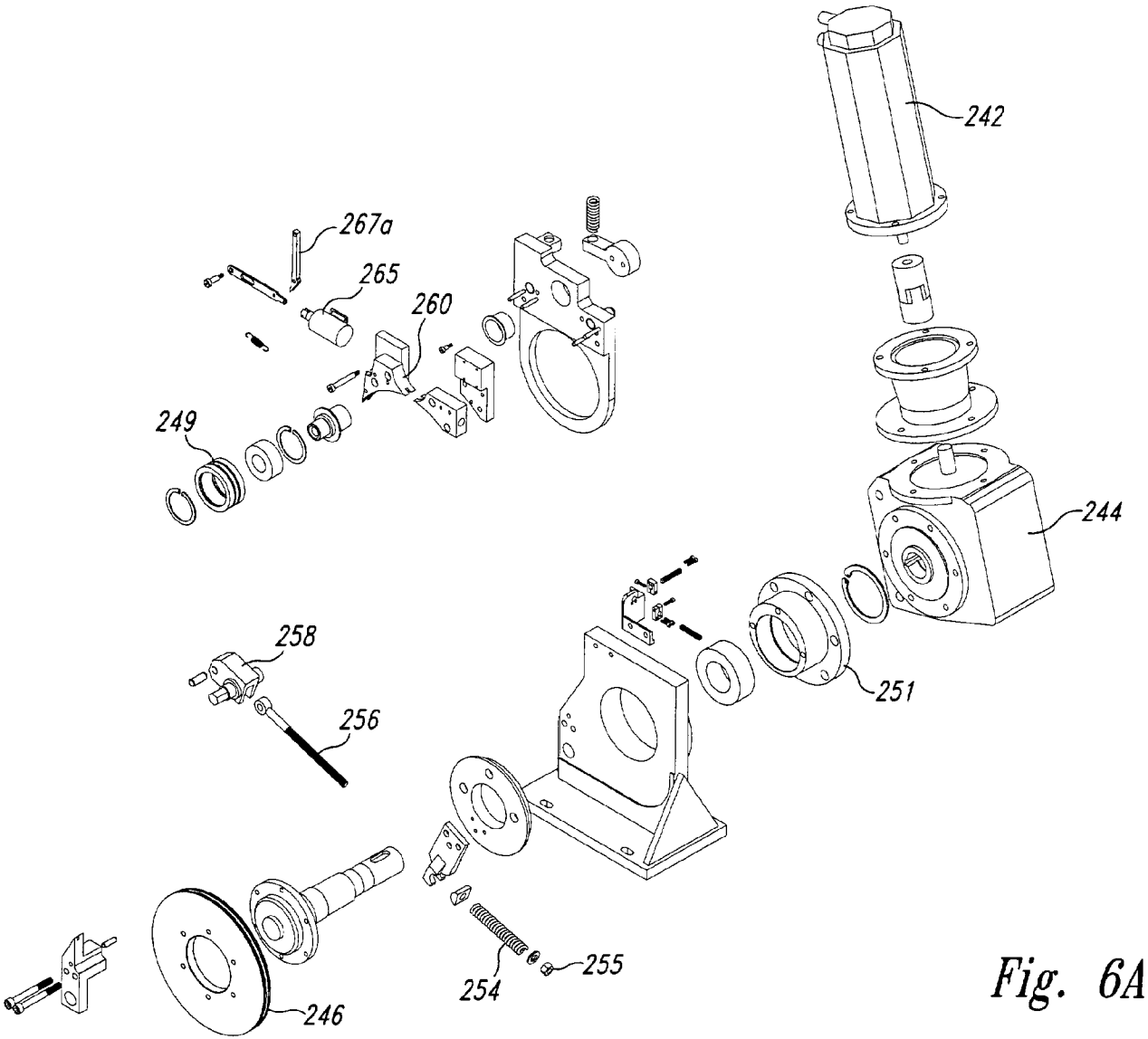
FIG. 6A is an exploded isometric view of a modified form of feed and tension assembly.
Figure 7:
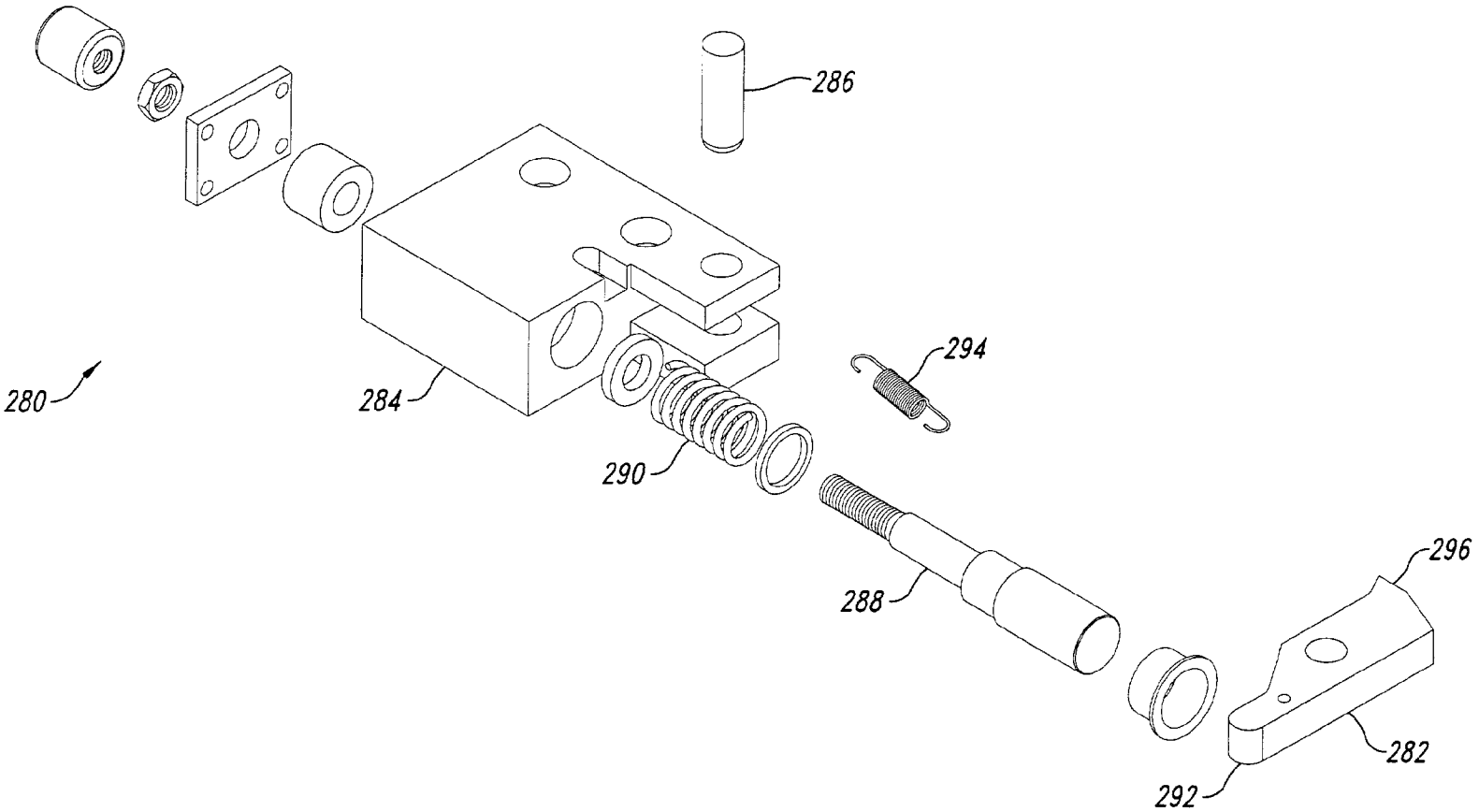
Figure 8:
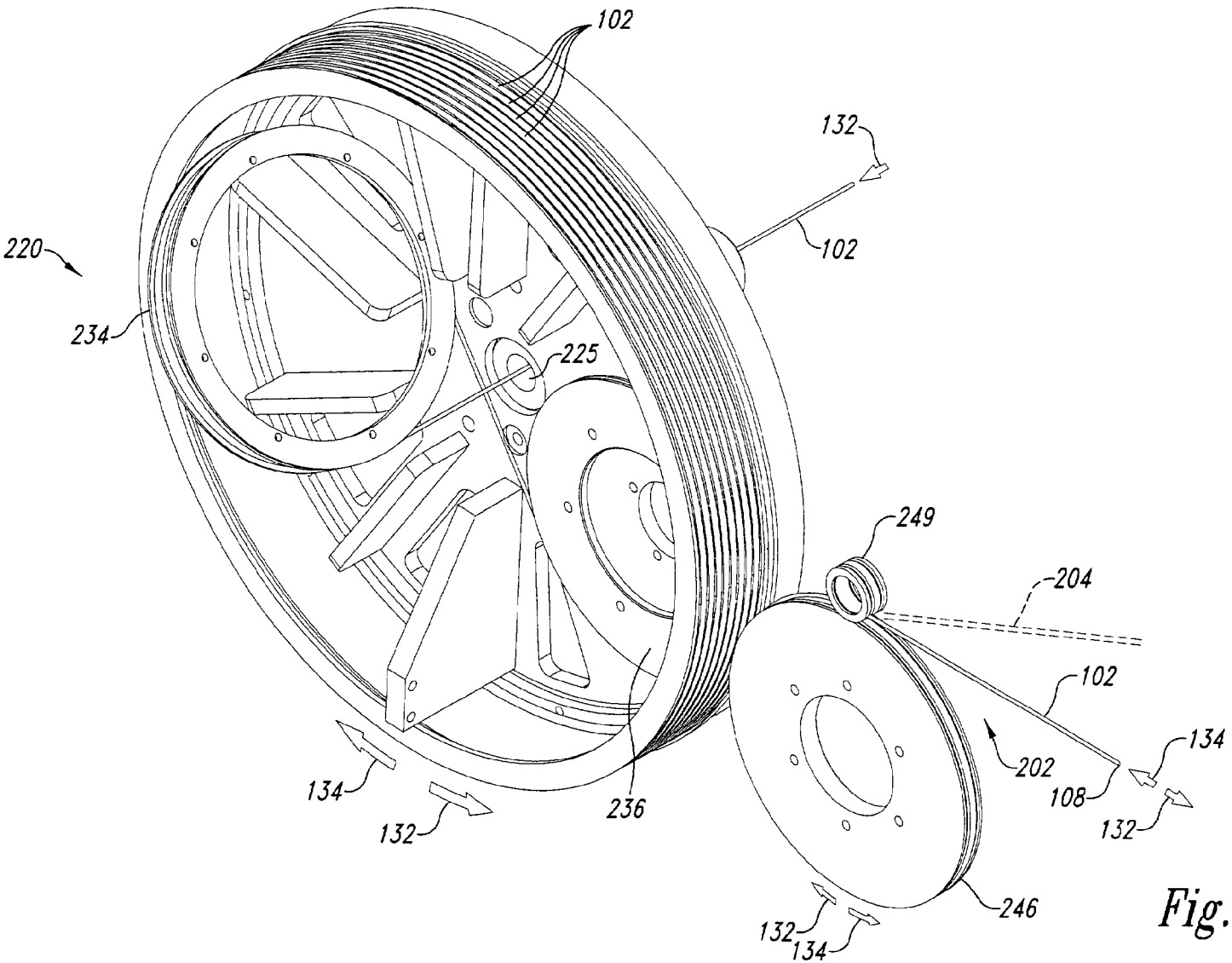
Figure 9:
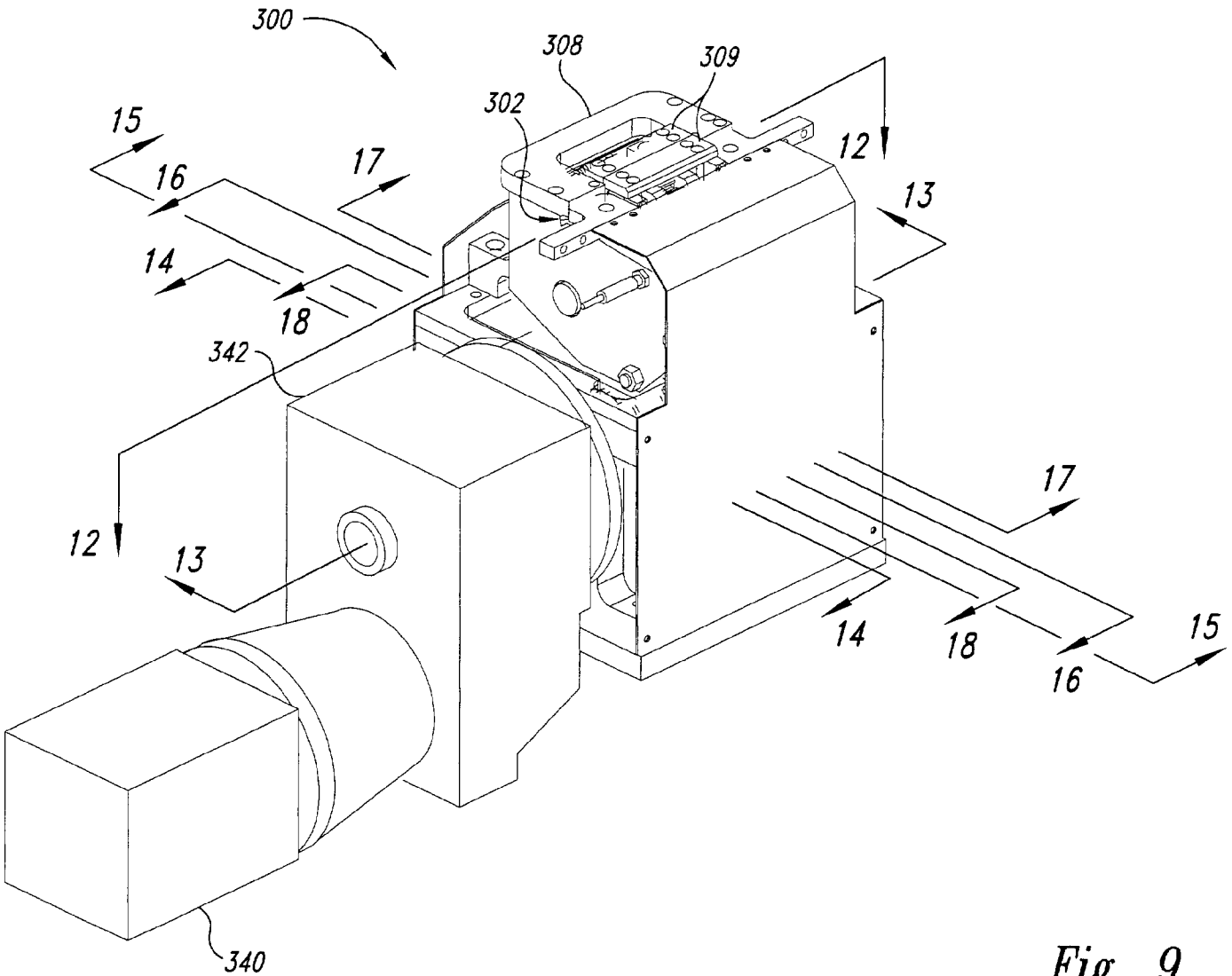
Figure 9A:
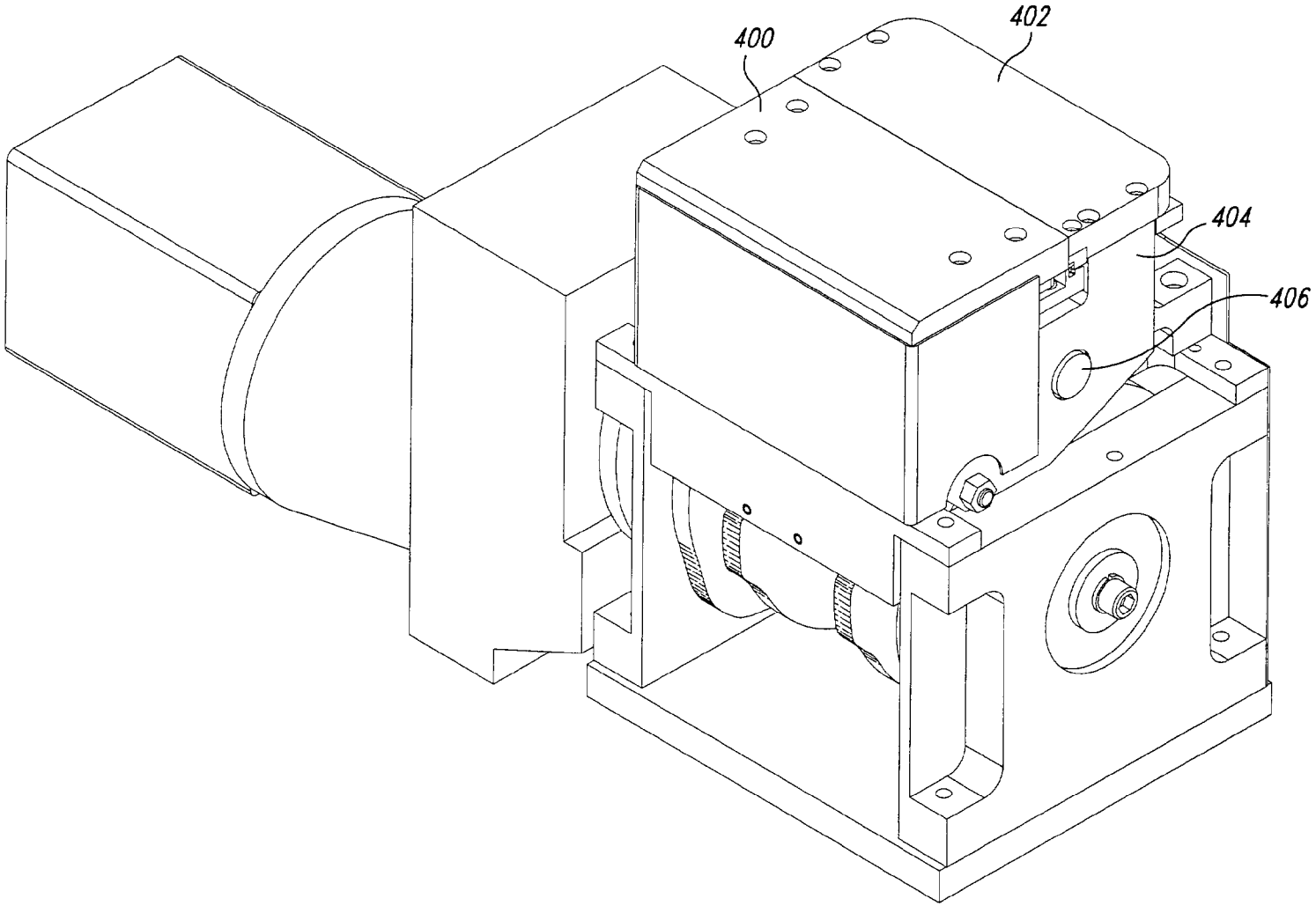
FIG. 9A is an isometric of a modified form of twister assembly.

FIGS. 4A and 6A show further details of the second embodiment of the feed and tension assembly. In this embodiment the feed pawl 267*a* is modified and is actuated during the load cycle to move down close to the drive wheel 246 to guide the incoming wire from the tangent wheel 236 into the nip between the drive wheel and the drive entry guide 260. After the wire is fed about the drive wheel the feed pawl is moved away from the drive wheel by the solenoid 265.

Figures 4, 4A, 5, 6, 7, 8, 9:
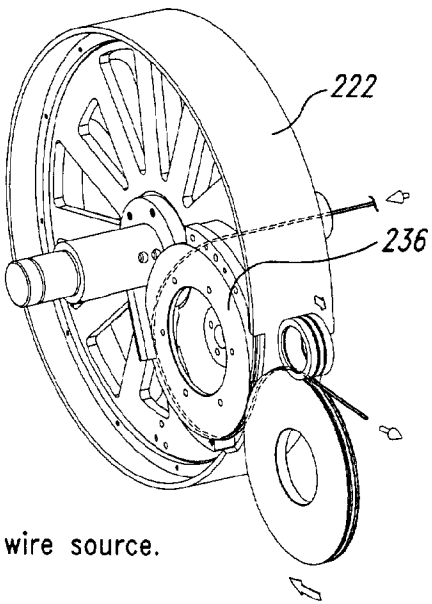
Figure 10:
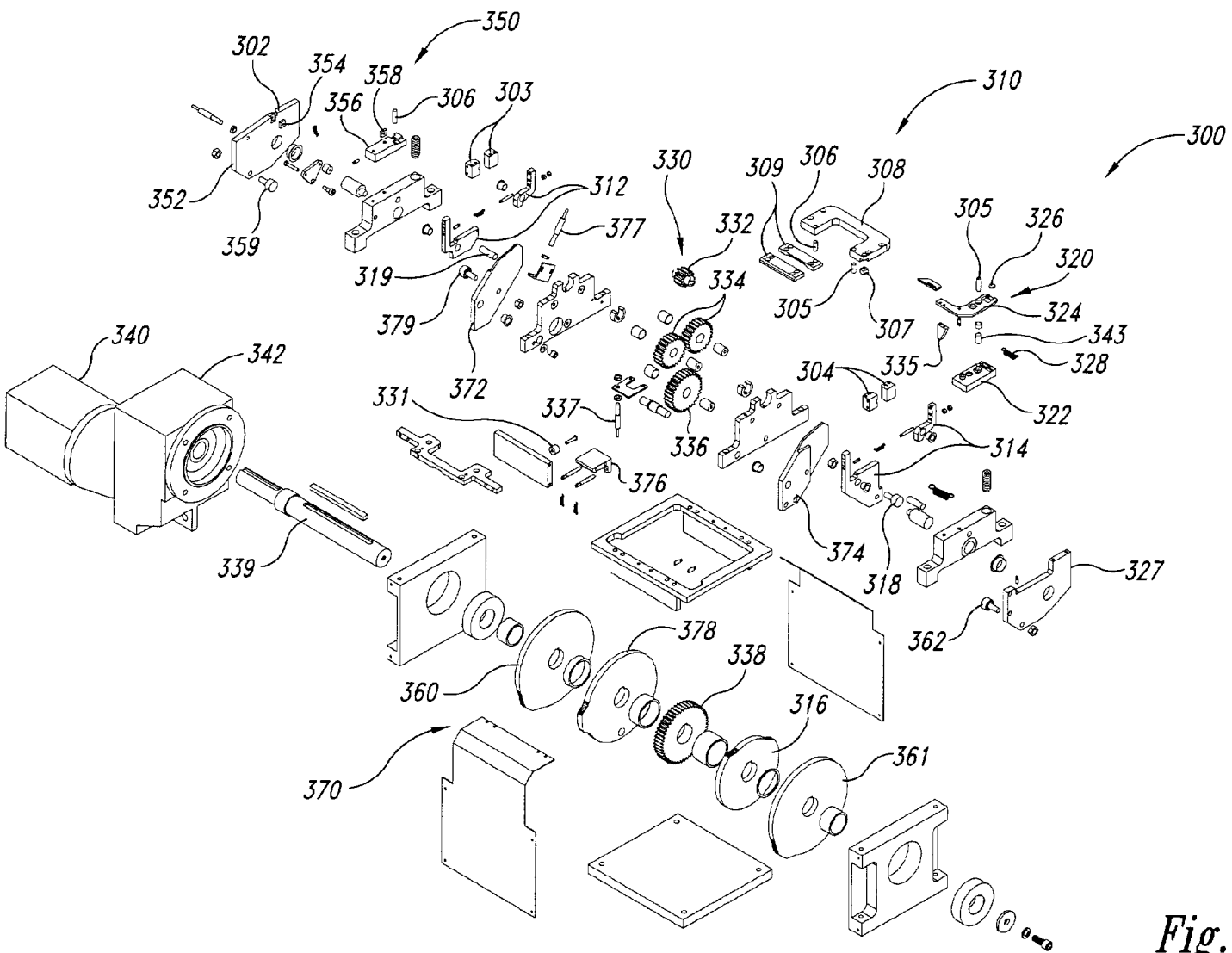
FIG. 10 is an exploded isometric view of the twister assembly of FIG. 9.
Figure 10A:
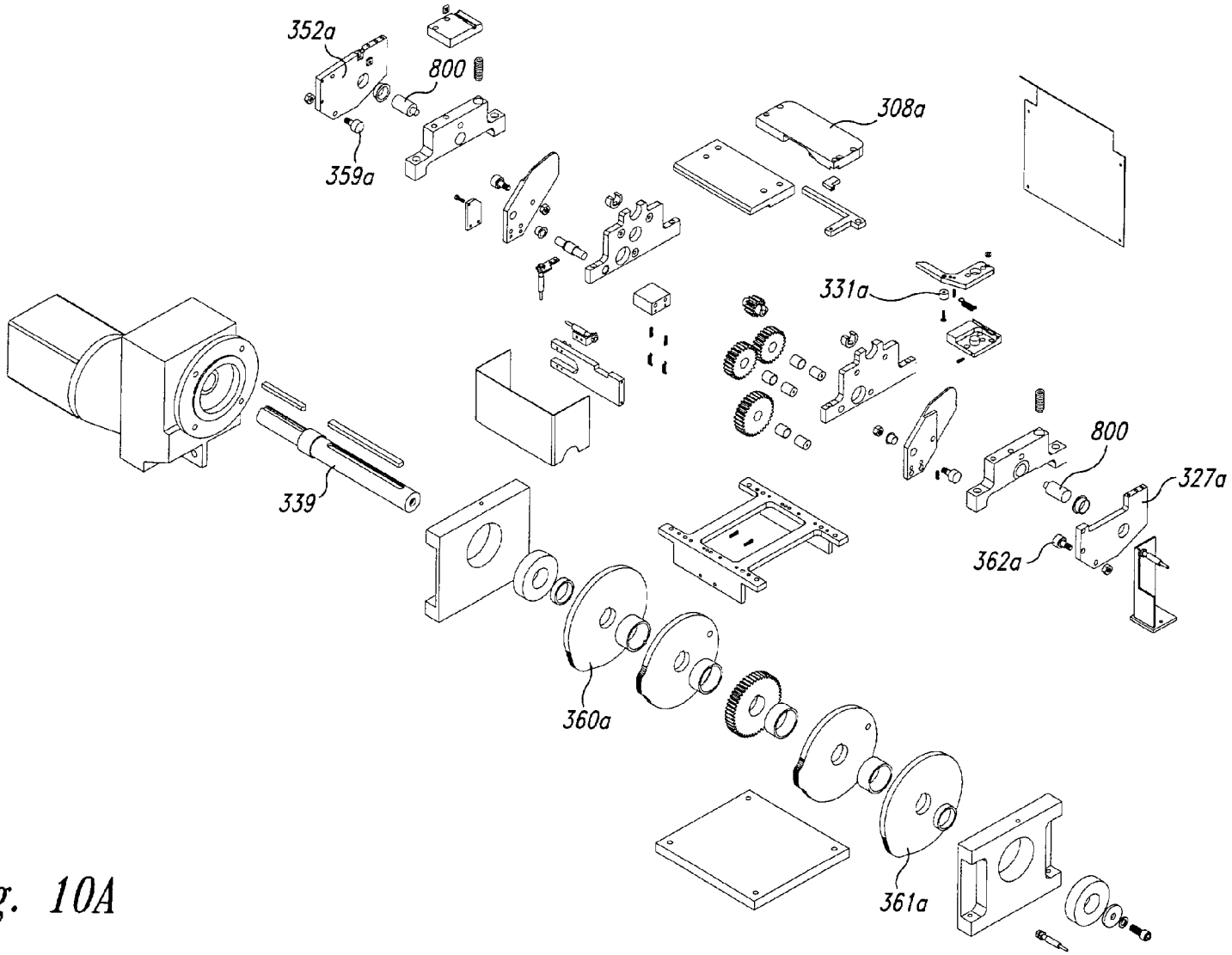
FIG. 10A is an exploded isometric of the modified form of the twister assembly.
Figure 11:
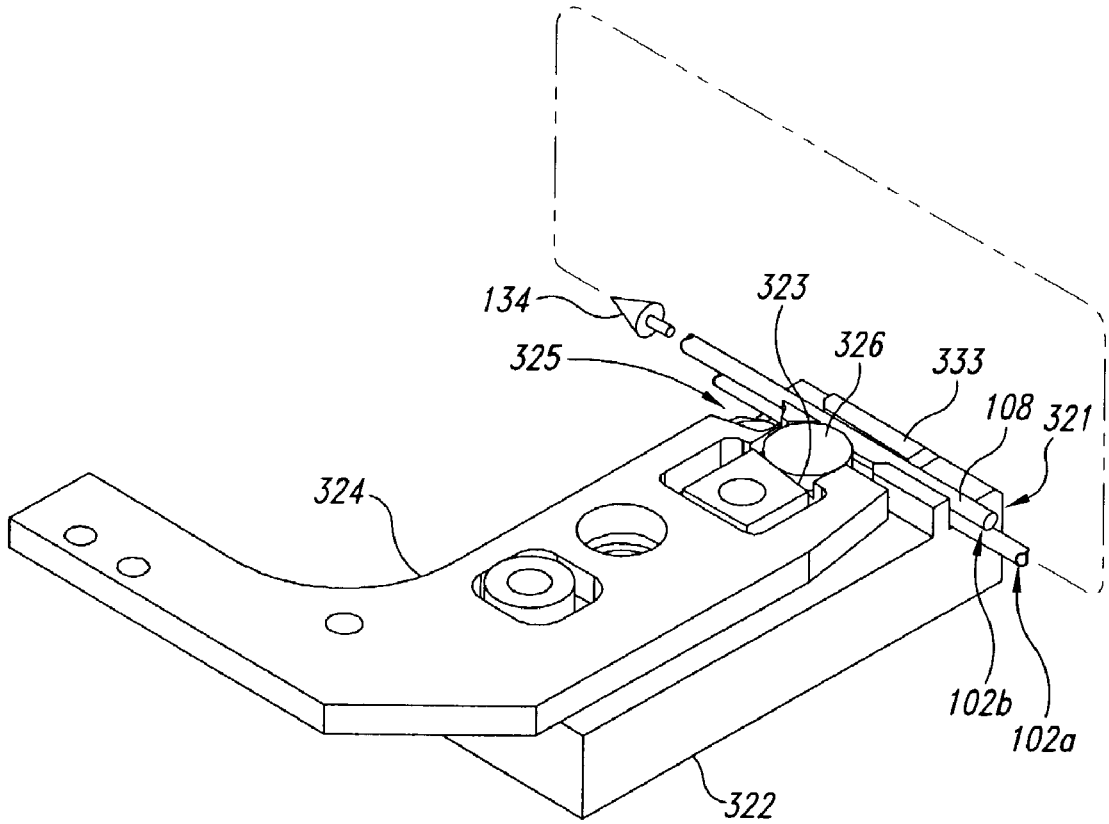
FIG. 11 is an enlarged isometric partial view of a gripper subassembly of the twister assembly of FIG. 9.

FIG. 9 is an isometric view of the twister assembly 300 of the wire-tying machine 100 of FIG. 1. FIG. 10 is an exploded isometric view of the twister assembly 300 of FIG. 9. FIG. 11 is an enlarged isometric partial view of a gripper subassembly 320 of the twister assembly 300 of FIG. 9. FIGS. 12 through 18 are various cross-sectional views of the twister assembly 300 of FIG. 9. FIG. 19 is a partial isometric view of a knot 118 produced by the twister assembly 300 of FIG. 9. As best seen in FIG. 10, the twister assembly 300 includes a guiding subassembly 310, a gripping subassembly 320, a twisting subassembly 330, a shearing subassembly 350, and an ejecting subassembly 370.

Figure 15:
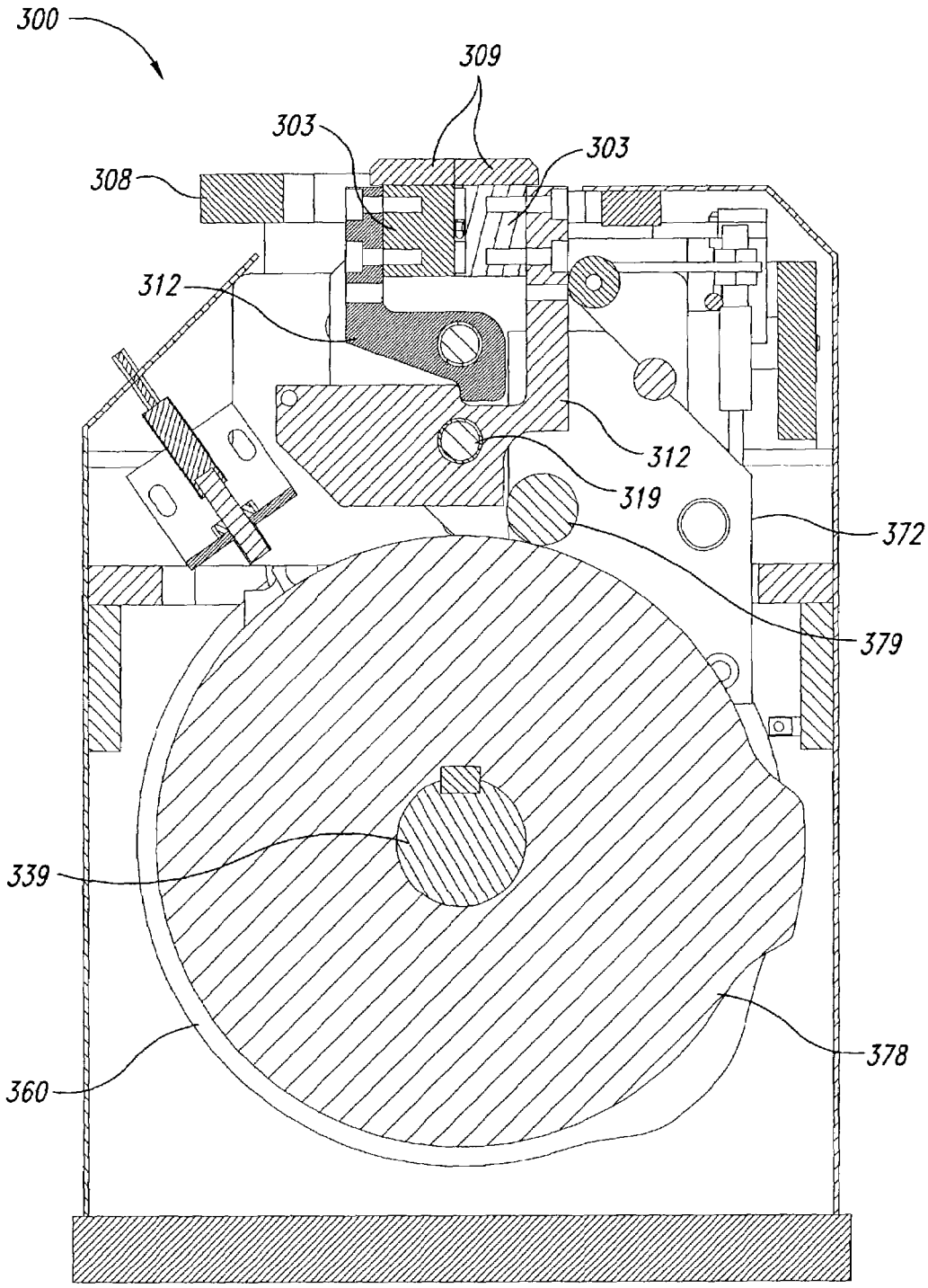
FIG. 15 is a right elevational cross-sectional view of the twister assembly of FIG. 9 taken along line 15—15.

Referring to FIGS. 9, 10, 15, and 16, the guiding subassembly 310 includes a twister inlet 302 that receives the length of wire 102 fed from the feed and tension assembly 200. As best shown in FIG. 15, a pair of front guide blocks 303 are positioned proximate the twister inlet 302 and are coupled to a pair of front guide carriers 312. A pair of rear guide pins 305 and a pair of front guide pins 306 are secured to a head cover 308 at the top of the twister assembly 300. A pair of rear guide blocks 304 are positioned near the head cover 308 opposite from the front guide blocks 303, and are coupled to a pair of rear guide carriers 314. A diverter stop block 307 is secured to the head cover 308 proximate the rear guide pins 305.

Figure 16:
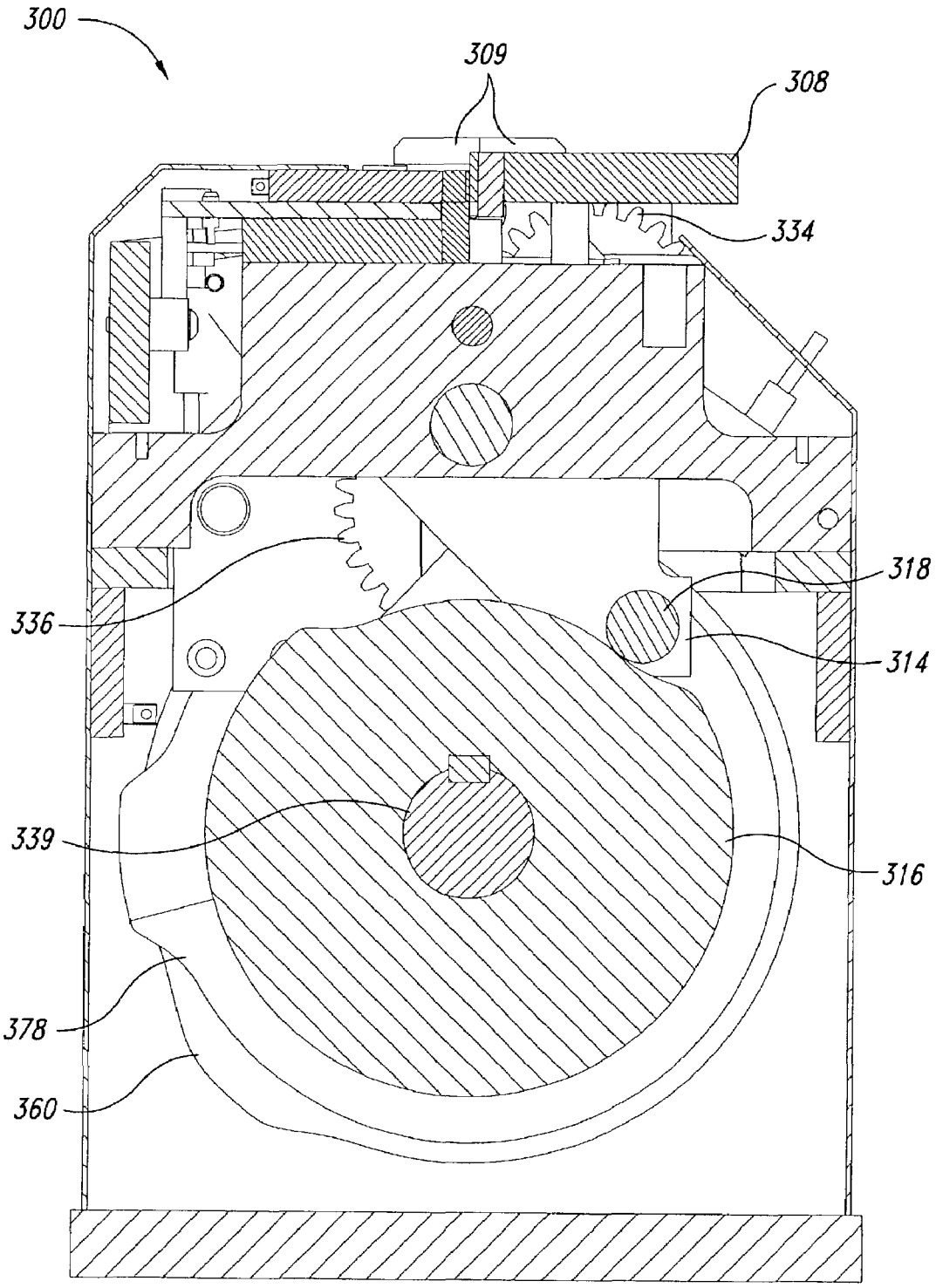
FIG. 16 is a right elevational cross-sectional view of the twister assembly of FIG. 9 taken along line 16—16.

A pair of guide covers 309 are positioned adjacent the head cover 308 and together form the bottom of the bundling station 106 (FIGS. 1–3). A guide cam 316 is mounted on a twister shaft 339 and engages a guide cam follower 318 coupled to one of the rear guide carriers 314. As best seen in FIG. 15, one of the front guide carriers 312 is pivotably coupled to a guide shaft 319, and the front guide carriers 312 are positioned to pivot simultaneously. As shown in FIG. 16, the guide cam 316 and guide cam follower 318 actuate the rear guide carriers 314. The front guide carrier 312 is rigidly connected to the rear carrier 314 by the guide cover 309 such that the guide cam 316 operates both front and rear carriers 312, 314 simultaneously.

Figure 12:
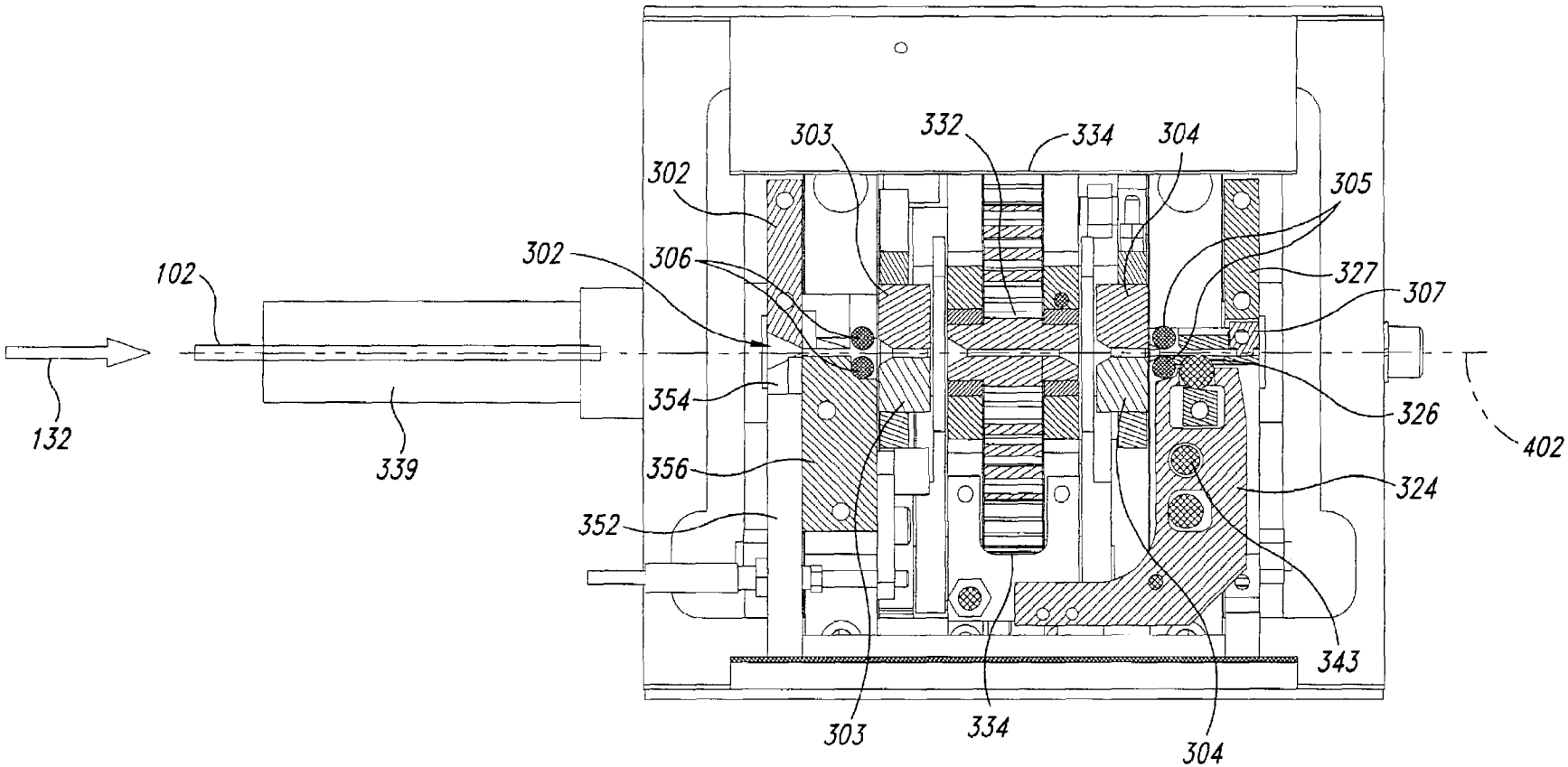
FIG. 12 is a top cross-sectional view of the twister assembly of FIG. 9 taken along line 12—12.
Figure 17:
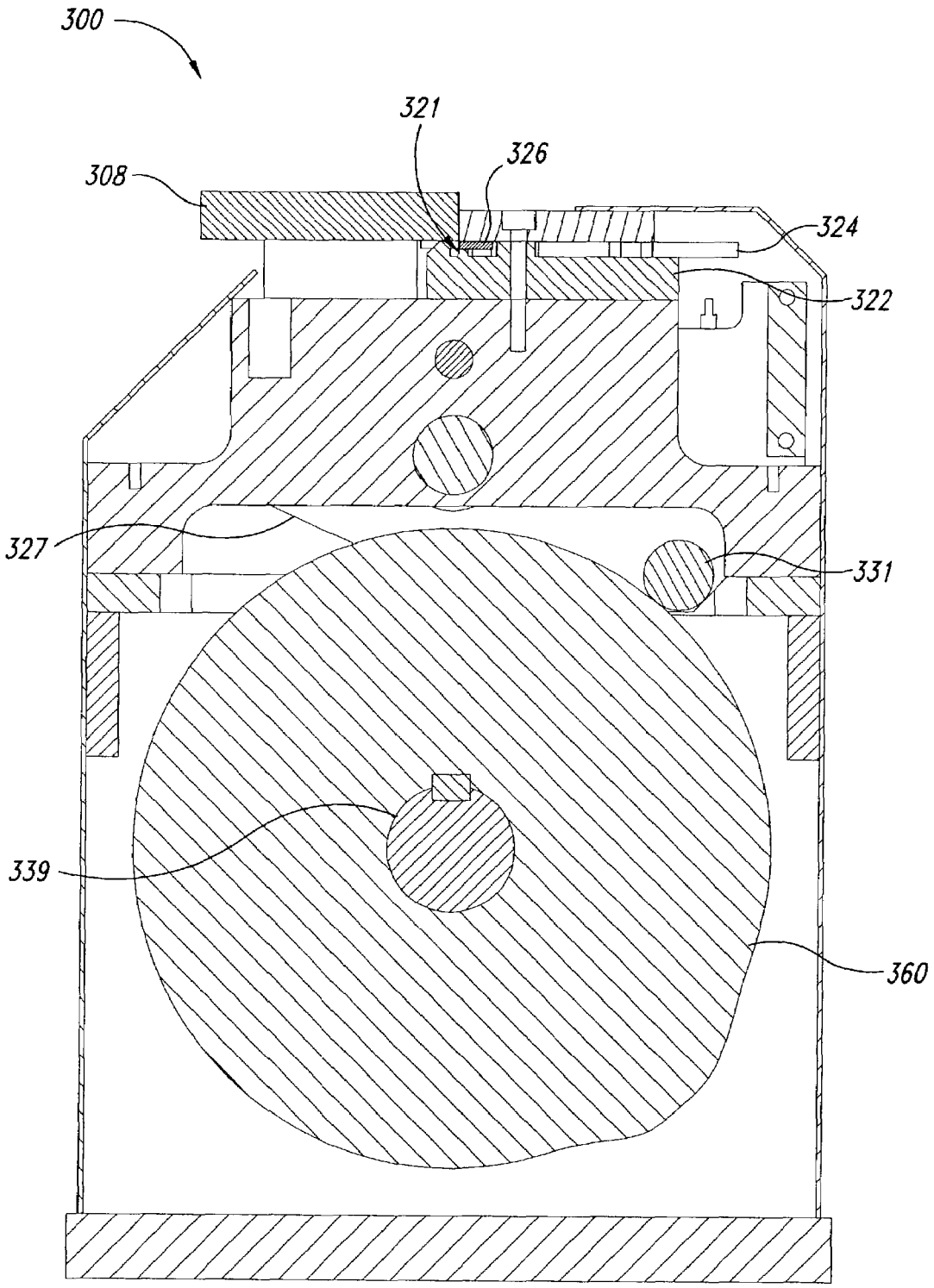
FIG. 17 is a right elevational cross-sectional view of the twister assembly of FIG. 9 taken along line 17—17.

Referring to FIGS. 10 and 17, the gripping subassembly 320 includes a gripper block 322 having a gripper release lever 324 pivotally attached thereto. As best seen in FIGS. 11 and 12, the gripper block 322 also has a wire receptacle 321 disposed therein, and a gripper opposite wall 333 adjacent the wire receptacle 321. A tapered wall 323 projects from the gripper block 322 proximate to the wire receptacle 321, forming a tapered gap 325 therebetween. A gripper disc 326 is constrained to move within the tapered gap 325 by the gripper release lever 324. A gripper return spring 328 is coupled to the gripper release lever 324. A pair of multi-purpose cams 360, 361 are mounted on the twister shaft 339. One of the multi-purpose cams 360 indirectly activates a gripper cam follower 331 through a gripper release rocker 327. The gripper release rocker 322 in turn engages a gripper release cam block 335 which, in turn, engages the gripper release lever 324. A feed stop switch 337 (FIG. 10) is positioned proximate the gripper release lever 324 to detect the movement thereof.

Figure 18:
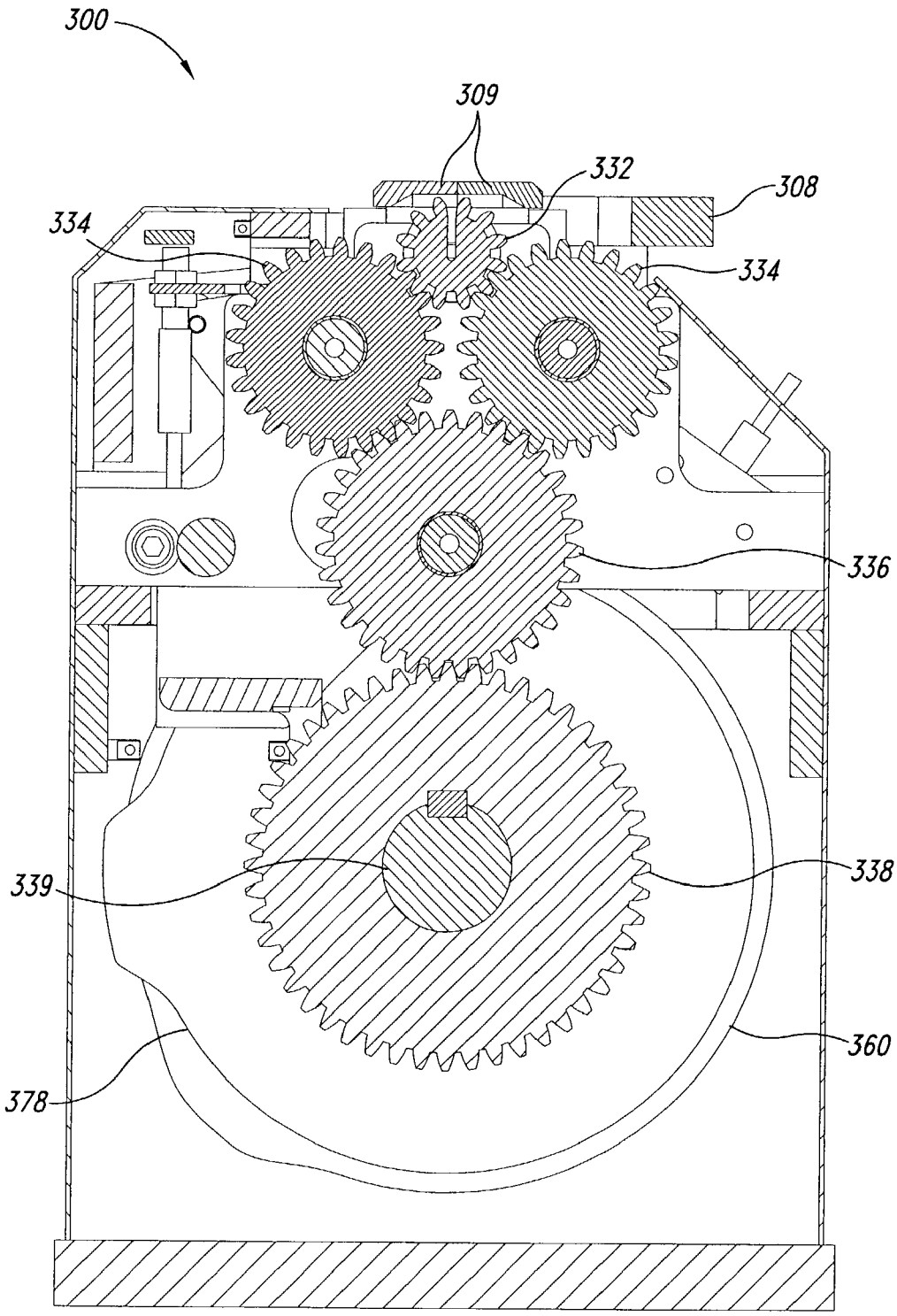
FIG. 18 is a right elevational cross-sectional view of the twister assembly of FIG. 9 taken along line 18—18.
Figure 19:
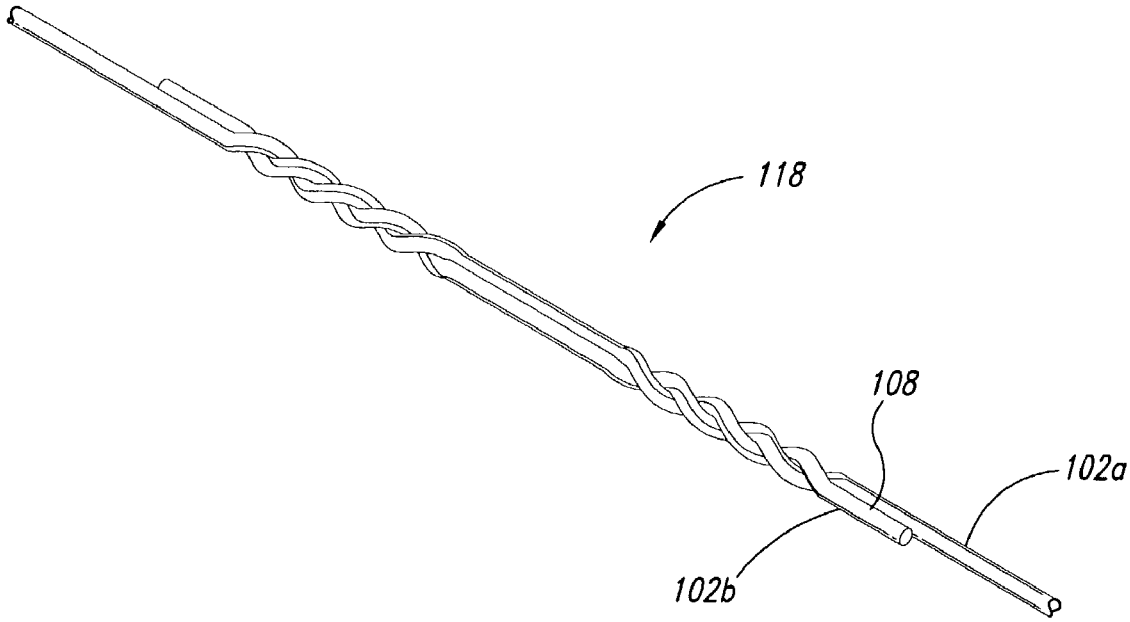
FIG. 19 is a partial isometric view of a knot produced by the twister assembly of FIG. 9.

Referring to FIGS. 10, 12, 13, and 18, the twisting subassembly 330 includes a slotted pinion 332 driven by a pair of idler gears 334. As best seen in FIG. 18, the idler gears 334 engage a driven gear 336 which in turn engages a drive gear 338 mounted on the twister shaft 339. A twister motor 340 coupled to a gear reducer 342 drives the twister shaft 339. Although a variety of motor embodiments may be used, the twister motor 340 preferably is an electric servomotor.

Figure 14:
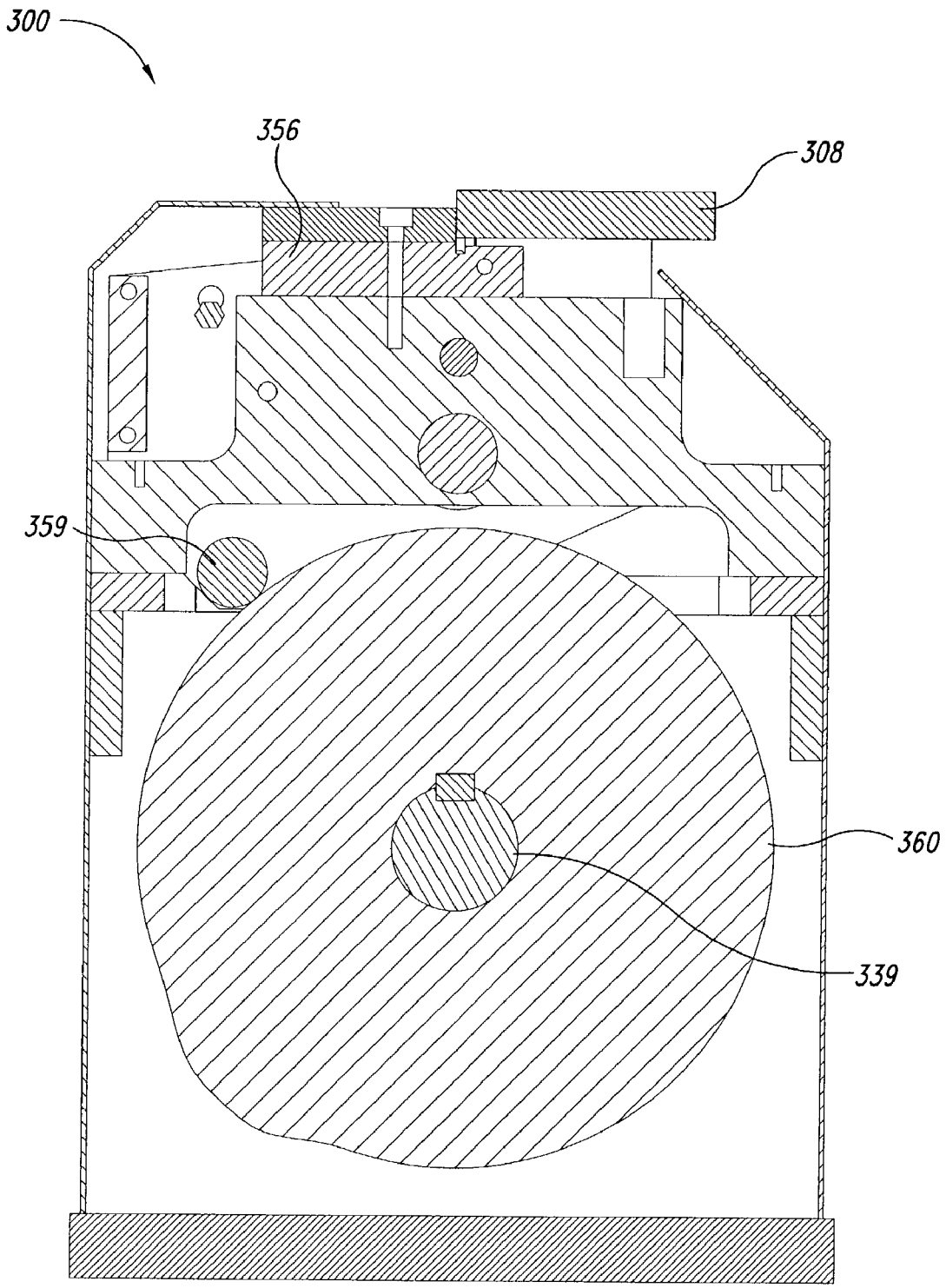
FIG. 14 is a right elevational cross-sectional view of the twister assembly of FIG. 9 taken along line 14—14.

As best seen in FIGS. 10 and 14, the cutting subassembly 350 includes a moveable cutter carrier 352 having a first cutter insert 354 attached thereto proximate the twister inlet 302. A stationary cutter carrier 356 is positioned proximate the moveable cutter carrier 352. A second cutter insert 358 is attached to the stationary cutter carrier 356 and is aligned with the first cutter insert 354. One of the multi-purpose cams 360 mounted on the twister shaft 339 engages a cutter cam follower 359 attached to the moveable cutter carrier 352.

Referring to FIGS. 10 and 15, the ejecting subassembly 370 includes a front ejector 372 pivotally positioned near the front guide blocks 303, and a second ejector 374 pivotally positioned near the rear guide blocks 304. An ejector cross support 376 (FIG. 10) is coupled between the front and rear ejectors 372, 374, causing the front and rear ejectors 372, 374 to move together as a unit. An ejector cam 378 is mounted on the twister shaft 339 and engages an ejector cam follower 379 coupled to the front ejector 372. A home switch 377 is position proximate the ejector cam 378 for detecting the position thereof.

Generally, the twister assembly 300 performs several functions, including gripping the free end 108 of the length of wire 102, twisting the knot 118, shearing the closed wire loop 116 from the wire source 104, and ejecting the twisted knot 118 while providing a clear path for the passage of the wire 102 through the twister assembly 300. As described more fully below, these functions are performed by a single unit having several innovative features, an internal passive gripper capability, replaceable cutters, and actuation of all functions by a single rotation of the main shaft 339.

Figure 13:
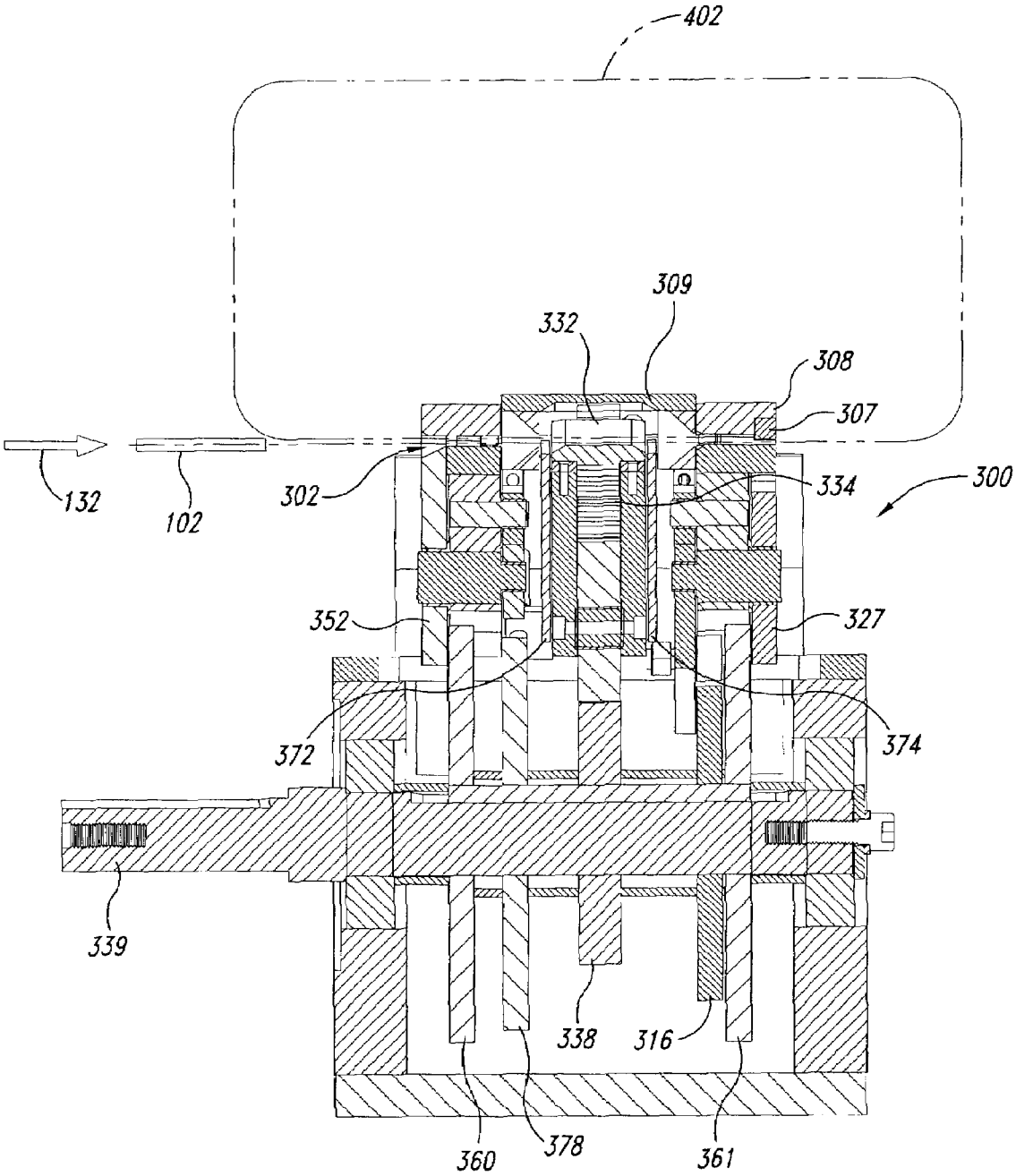
FIG. 13 is a side cross-sectional view of the twister assembly of FIG. 9 taken along line 13—13.
Figure 13A:
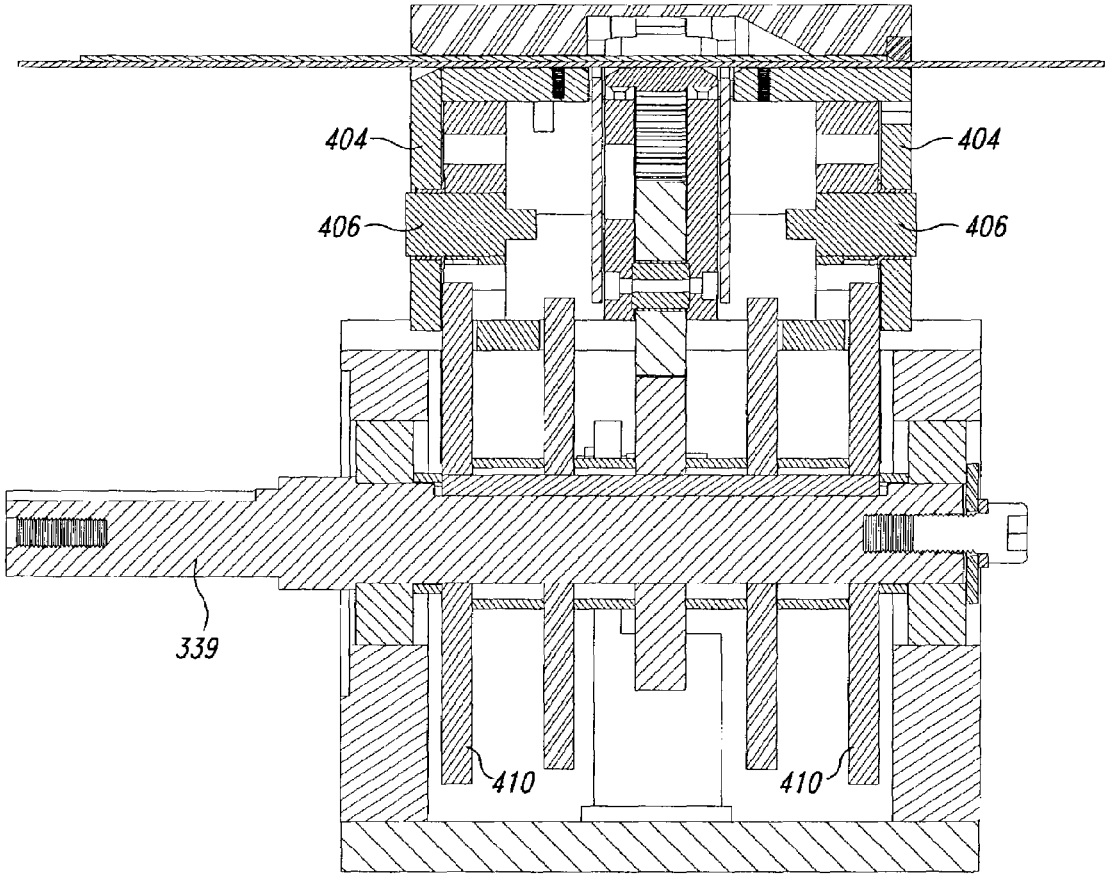
FIG. 13A is a cross-sectional view of the modified twister assembly of FIG. 9A.

During the feed cycle, the free end 108 of the length of wire 102 is fed by the feed and tension assembly 200 through the twister inlet 302 of the twister assembly 300. As best seen in FIG. 12, the free end 108 passes between the front guide pins 306, and between the front guide blocks 303, and through the slotted pinion 332. The free end 108 continues along the wire feed path 202, passing between the rear guide blocks 304, between the rear guide pins 305, and through the wire receptacle 321 in the gripper block 322 (FIG. 11). The free end 108 then exits from the twister assembly 300 to travel around the track assembly 400 along the wire guide path 402, as shown in FIG. 13, described more fully below.

After passing around the track assembly 400, the free end 108 reenters the twister inlet 302 (as the upper wire shown in FIGS. 11, 11A and 11B) above the first passage of wire 102*a* (FIG. 11). The free end 108 again passes between the front guide pins 306, between the front guide blocks 303, through the slotted pinion 332, and between the rear guide blocks 304 and rear guide pins 305. As best seen in FIG. 11, the free end 108 then reenters the wire receptacle 321 and passes above the first passage of wire 102*a*, past the gripper disc 326 and stops upon impact with the diverter stop block 307. The feed cycle is then complete.

Figure 11A:
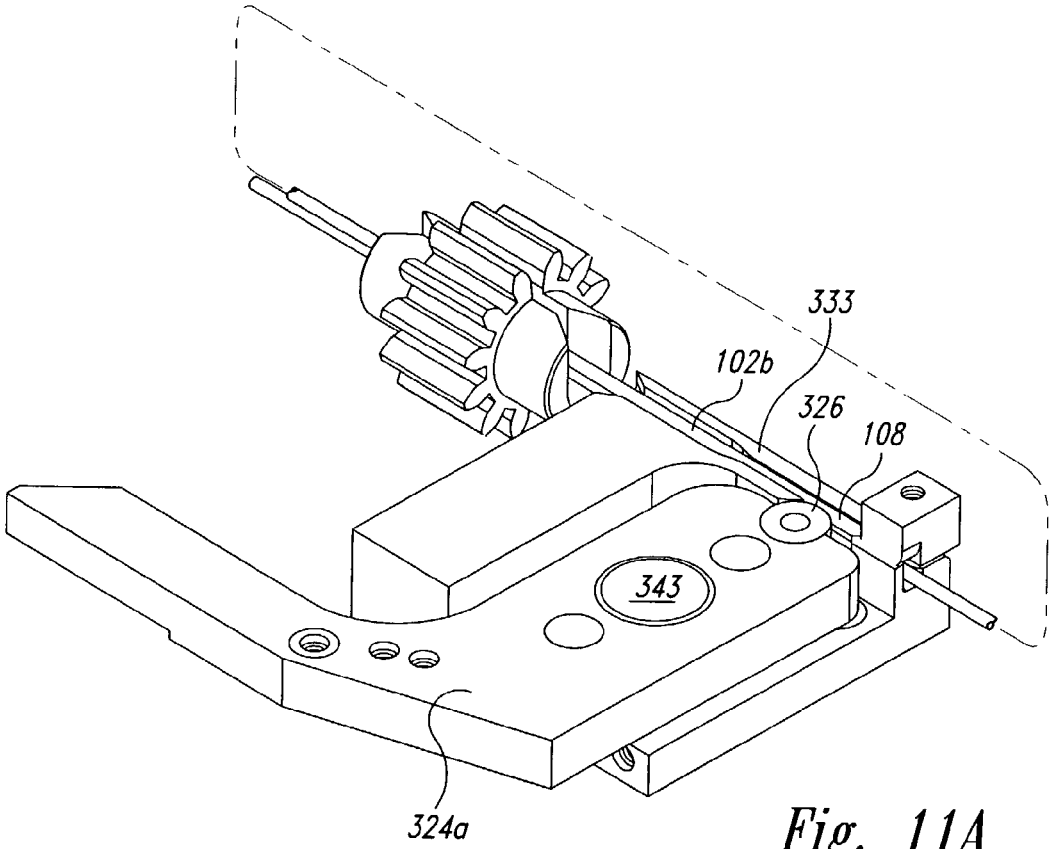
FIG. 11A is an alternative form of a gripper subassembly.
Figure 11B:
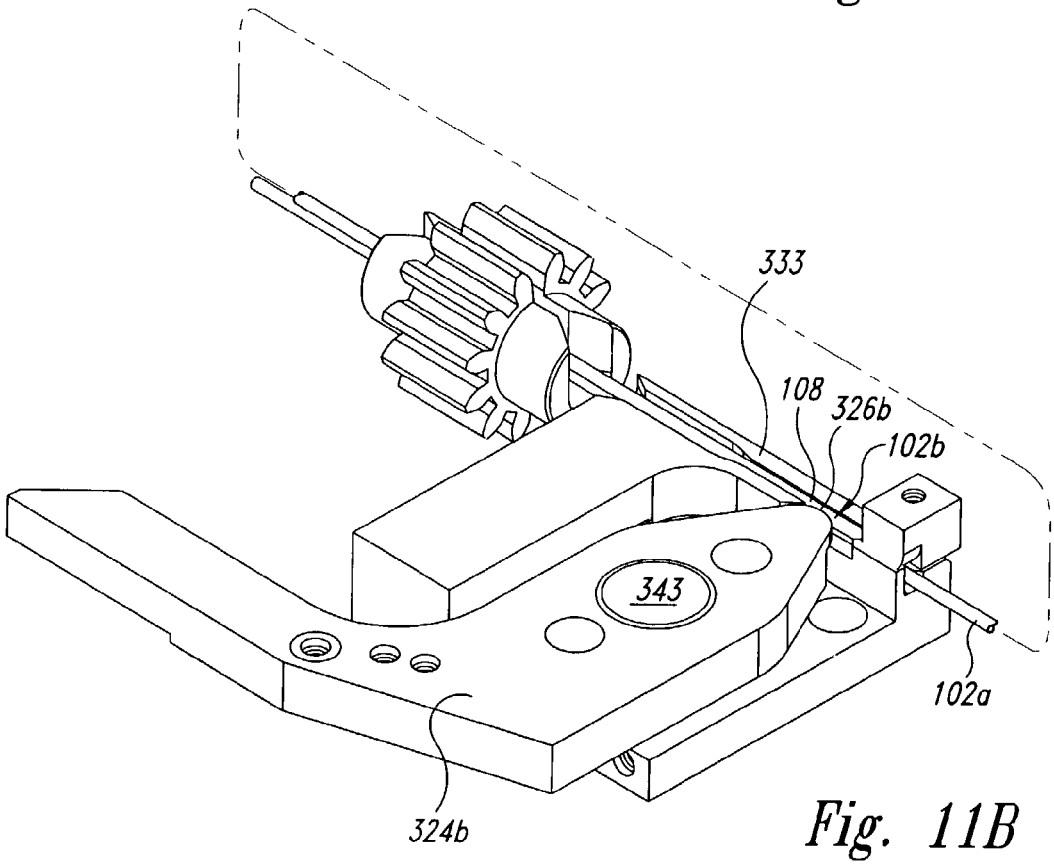
FIG. 11B is another alternative form of a gripper subassembly.

A dot-dashed line is shown in FIGS. 11, 11A and 11B to show schematically the completion of the loop of wire around the track. The now free end 108 is above the lower wire pass 102*a* and has been stopped in the twister. The lower wire pass 102*a* remains connected to the accumulator to be pulled back and tighten the wire around the bundle in the track.

The twister assembly 300 advantageously provides a feed path having a second passage of wire 102*b* (the free end 108) positioned over a first passage of wire 102*a* (that goes to the accumulator). This over/under wire arrangement reduces wear on the components of the twister assembly 300, especially the head cover 308, during feeding and tensioning. Because the length of wire 102 is pushed or pulled across itself instead of being drawn across the inside of the head cover 308 or other component, wear of the twister assembly 300 is greatly reduced, particularly for the tension cycle.

At the end of the feed cycle, the free end 108 (or the upper passage of wire 102*b*) of the length of wire 102 is aligned adjacent to the gripper disc 326. The gripper disc 326 (FIG. 11) is constrained to move within the gap 325 by the gripper release lever 324, the tapered wall 323, and the back wall; both walls being within the gripper block 322. At the initiation of the tension cycle, the second passage of wire 102*b* begins to move in the tension direction (arrow 134) and frictionally engages the gripper disc 326, moving the gripper disc 326 in the tension direction and forcing the gripper disc 326 into increasingly tight engagement between the wire's free end 102*b* and the tapered wall 323. As the wire's free end 102*b* is drawn toward the narrow end of the tapered wall 323, the wire's free end 102*b* is simultaneously forced into the back wall 333 increasing the frictional force and securely retaining the wire's free end 102*b*. Also, as best shown in FIG. 12, the gripper release lever is pivotally mounted on an offset pivot pin 343 so that the friction force between the wire and the disc 326 create an increasing moment pivoting the lever counter clockwise and closer to the opposite wall 333.

Although the gripper disk 326 may be constructed from a variety of materials, including, for example, tempered tool steel and carbide, a fairly hard material is preferred to withstand repeated cycling.

FIGS. 11A and 11B show alternative embodiments of the gripper release lever 324. In FIG. 11A the gripper disc 326 is rotatably fixed in the gripper release lever 324*a*. The gripper release lever 324*a* is pivoted on pivot pin 343 such that movement of the wire pass 102*b* to the left as viewed in FIG. 11A will cause the disc 324 to frictionally engage the wire, causing the gripper release lever 324*a* to pivot counter clockwise about the pin pivot 343, pressing the disc 326 against the wire 102*b*. Here the wire becomes squeezed between the disc 326 and the opposite wall 333.

In FIG. 11B the disc 326 is eliminated and only the end of the gripper release lever 324*b* is formed to a curved point 326*b*. Here the gripper release lever 324*b* is also pivoted about the pivot pin 343 such that movement of the upper wire pass 102*b* to the left in FIG. 11B will cause the point 326*a* to frictionally engage the wire, and pivot the lever arm counter clockwise in FIG. 11B, squeezing the upper pass of wire 102*b* between the point and the opposite wall 333.

In the embodiment of FIGS. 11A and 11B no tapered gap is employed. The friction caused between the pivoting gripper lever arm and the opposite wall 333 is sufficient to positively lock the free end 108 (102*b*) of the wire against movement.

All of these embodiments uniquely accomplish gripping of the free end of the wire with a passive gripper that requires no separate powered solenoids or actuators. The gripper release lever is biased by spring 328 to normally pivot counter clockwise. The friction then between the wire, the wall, and the gripper disc provides the holding power.

Figure 12A:
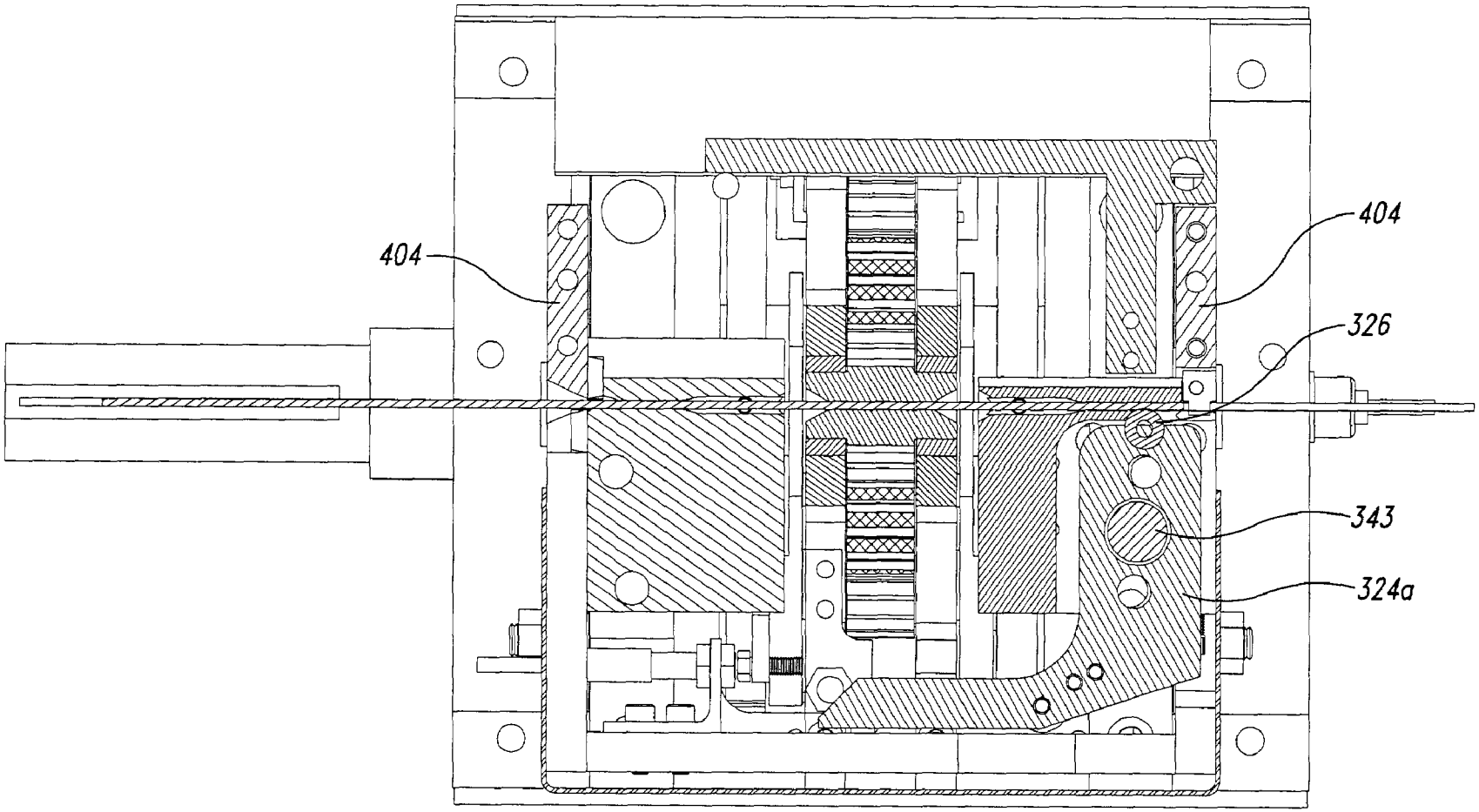
FIG. 12A is a cross-sectional view of the modified twister assembly of FIG. 9A.

After the wire loop 116 has been tensioned, and the knot 118 twisted and severed from the length of wire 102, the magnitude of the imparted force wedging the disc 326 into the narrow end of the tapered gap 325 is reduced and the direction with which the wire end 108 engages the gripper disc 326 is altered. This allows the wire end 108 to slip transversally up from between the disc 326 and the wall 333. To speed the release of the wire end 108 from the gripper subassembly 320, the cam block 335 is engaged by the gripper release cam follower 331 at the end of the twist cycle forcing the gripper release lever 324 to rotate in a clockwise direction, as viewed in FIGS. 12 and 12A, disengaging contact between the gripper disc 326 and the wire end 108. This also opens an unobstructed path for the wire to clear the gripper subassembly 320 at the time of wire ejection.

The twisting subassembly 330 twists a knot 118 in the wire 102 to close and secure the wire loop 116. The twisting is accomplished by rotating the slotted pinion 332. The twister motor 340 rotates the twister shaft 339, causing the drive gear 338 to rotate. The drive gear 338 in turn drives the driven gear 336. The two idler gears 334 are driven by the driven gear 336 and, in turn, drive the slotted pinion 332. The rotation of the slotted pinion 332 twists the first and second passages of wire 102*a*, 102*b* forming the knot 118 shown in FIG. 19.

At the completion of the twist cycle, the wire 102 is severed to release the formed loop 116. The motion of the multi-purpose cams 360, 361 against the cutter cam followers 359, 362 actuates the movable cutter carrier 352 (FIG. 13) relative to the stationary cutter carrier 356, causing the wire 102 to be sheared between the first and second cutters 354, 358. Preferably, the first and second cutters 354, 358 are replaceable inserts of the type commonly used in commercial milling and cutting machinery, although other types of cutters may be used.

The twister assembly 300 advantageously provides symmetrical loading on the pinion 332 by the two idler gears 334. This double drive arrangement produces less stress within the pinion 332, the strength of which is reduced by the slot. Also, the pinion 332 is slotted between gear teeth, which allows complete intermeshing with the idler gears 334. This configuration also results in less stress in the pinion 332. Generally, for heavy wire applications, such as for 11-gauge wire or heavier, an alternate pinion embodiment having a tooth removed may be used to provide clearance for the wire during ejection, as described below.

After the wire 102 has been cut, the tension in the wire 102 restrained by the gripping subassembly 320 is reduced. The rotation of the multi-purpose cams 360, 361 actuates the cutter cam followers 359–362, causing the head cover 308 and guide covers 309 to open. The rotation of the ejector cam 378 actuates the ejector cam follower 379, causing the front and rear ejectors 372, 374 to raise. The rotation of the multi-purpose cams 360–361 also causes the gripper cam follower 331 to engage the gripper release cam block 335, pivoting the gripper release lever 324 and forcing the gripper disc 326 away from the wire 102. This allows the free end 108 to freely escape from the twister assembly 300. The front and rear ejectors 372, 374 push the wire 102 and the knot 118 out of the pinion 332, lifting the wire loop 116 free from the twister assembly 300.

A modified form of twister assembly 300*a* is shown in FIGS. 9A, 10A, 12A and 13A. In this modified twister assembly a movable head cover 308*a* abuts a fixed hard cover. The moveable head cover is attached to a pair of rocker arms 327*a* and 352*a* that pivot on pins 800. A pair of cam followers 362*a* and 359*a* (FIG. 13A) pivot the rocker arms in response to head opening cams 360*a* and 361*a* mounted on the main twister shaft 339. This opens the movable head cover away from the fixed head cover to release the wire.

Thus, the twister assembly 300 advantageously performs the guiding, gripping, twisting, shearing, and ejecting functions in a relatively simple and efficient cam-actuated system. The simplicity of the above-described cam-actuated twister assembly 300 reduces the initial cost of the wire-tying machine 100, and the maintenance costs associated with the twister assembly 300.

Figure 20:
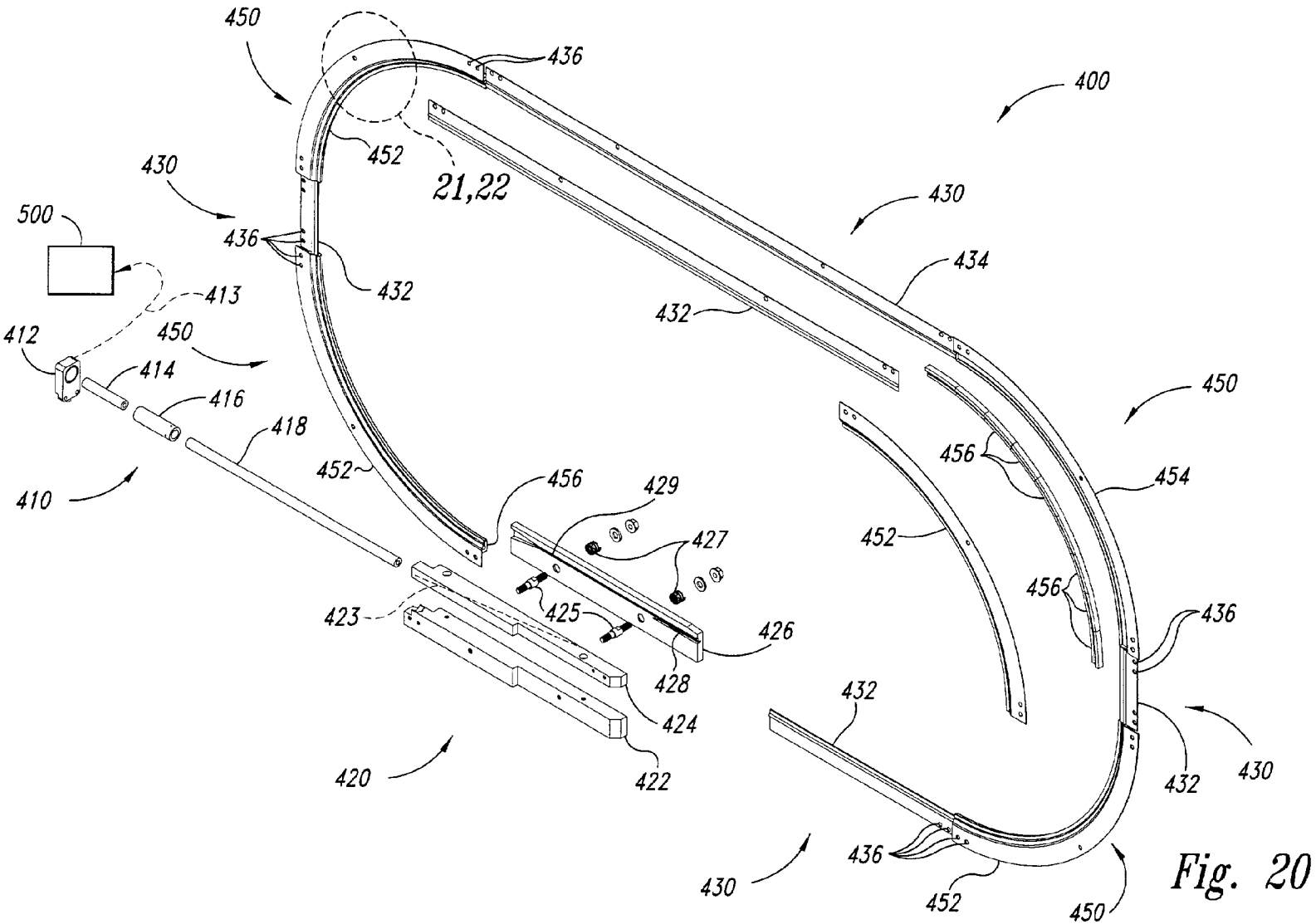
FIG. 20 is an exploded isometric view of a track assembly of the wire-tying machine of FIG. 1.
Figure 20A:
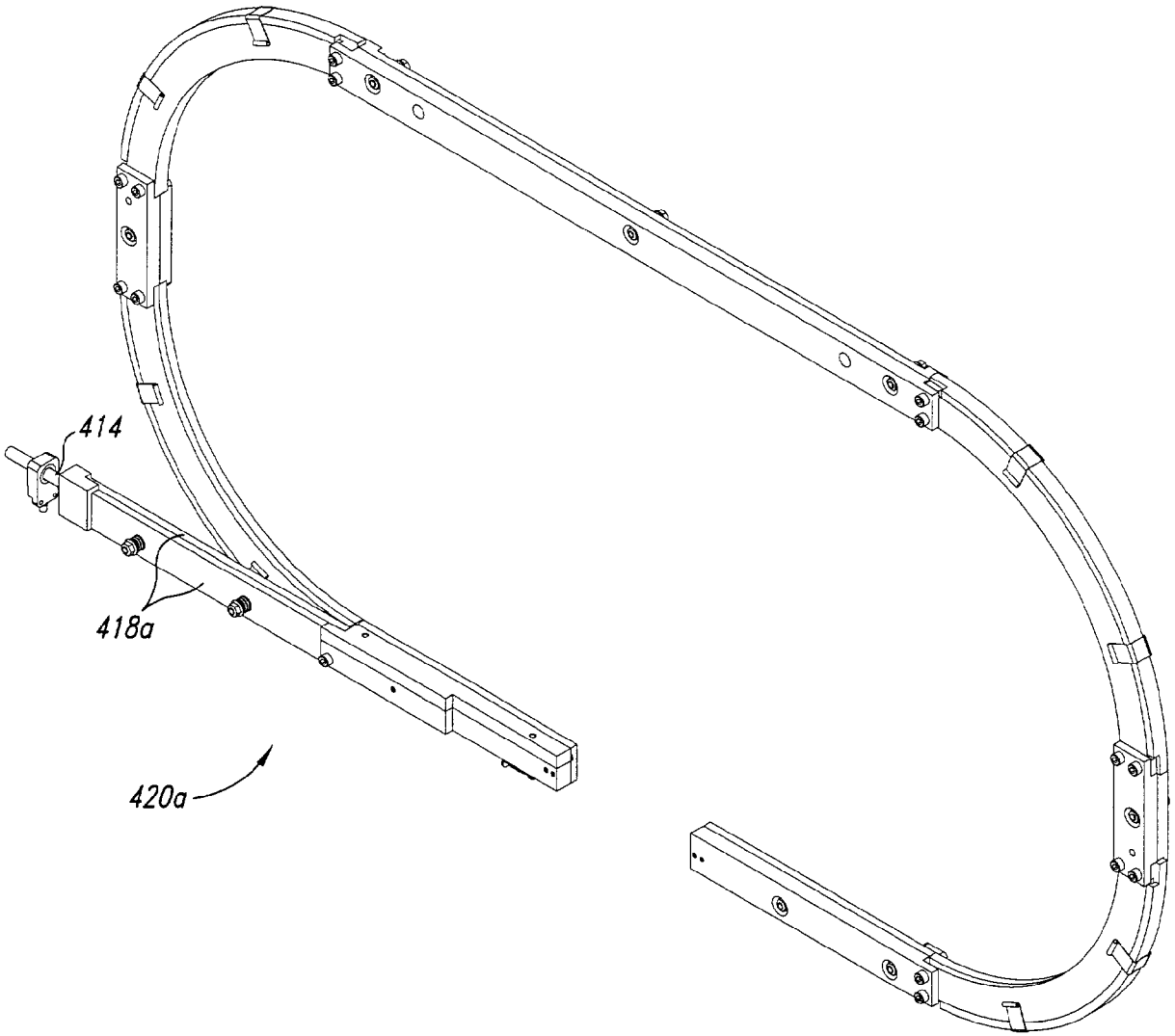
FIG. 20A is an isometric of a modified form of track entry sub-assembly 420*a*.

FIG. 20 is an exploded isometric view of the track assembly 400 of the wire-tying machine 100 of FIG. 1. As best seen in FIG. 20, the track assembly 400 includes a feed tube subassembly 410, a track entry subassembly 420, and alternating straight sections 430 and corner sections 450.

Referring to FIG. 20, the feed tube assembly 410 includes a ring sensor 412 coupled to a non-metallic tube 414. A feed tube coupling 416 couples a main feed tube 418 to the non-metallic tube 414. The main feed tube 418 is, in turn, coupled to the track entry subassembly 420.

The track entry subassembly 420 includes a track entry bottom 422 coupled to a track entry top 424 and a track entry back 426. A groove 423 is formed in a lower surface of the track entry top 424. The track entry back 426 is coupled to the track entry bottom and top 422, 424 by a pair of entry studs 425 and is held in compression against the track entry bottom and top 422, 424 by a pair of entry springs 427 installed over the entry studs 425. A first wire slot 428 and a second wire slot 429 are formed in the track entry back 426. The track entry subassembly 420 is coupled between the feed tube 418, a track corner 452, 456, and the twister assembly 300.

As shown in FIG. 20 the straight section 430 of the track is constructed to guide the wire but to release the wire when tension is applied to the wire.

Figure 21:
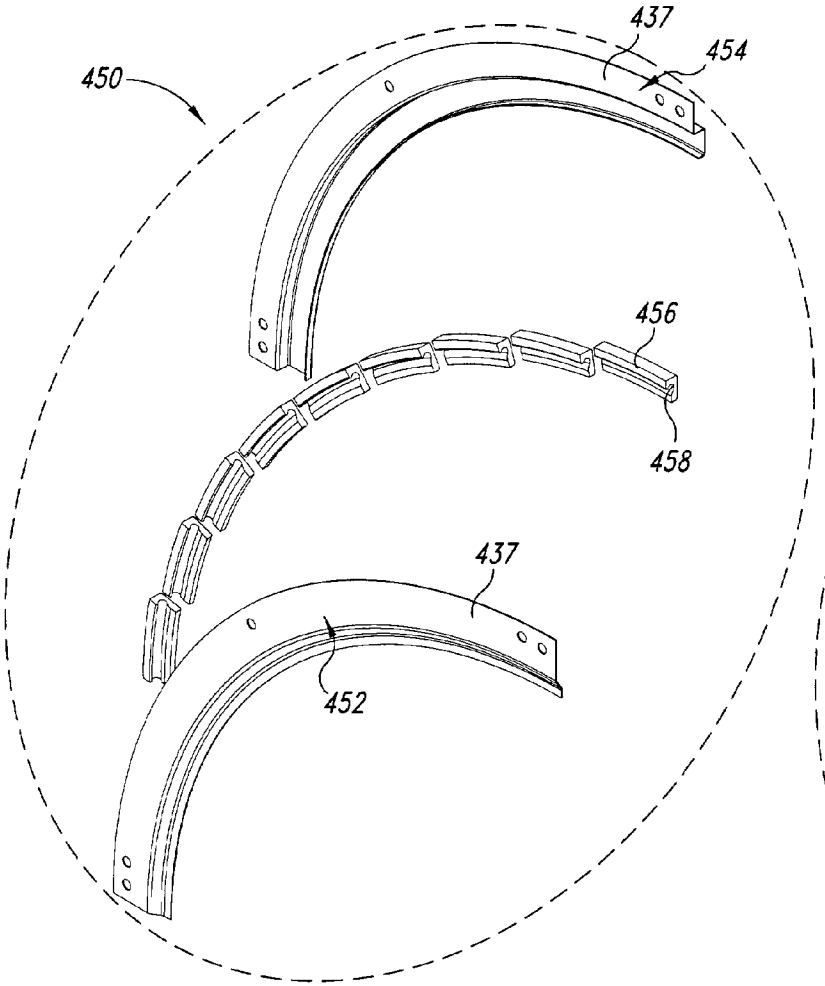
FIG. 21 is an enlarged schematic detail view of a corner section of the track assembly of FIG. 20 taken at detail reference numeral 21.

Referring to the detail of FIG. 21 each corner section 450 includes a corner front plate 452 and a corner back plate 454. The corner front and back plates 452, 454 are held together by fasteners 436 along their respective spine sections 437. A plurality of identical ceramic segments 456 are attached to each corner back plate 454 and are disposed between the corner front and back plates 452, 454. The ceramic sections 456 each include a rounded face 458 that partially surrounds the wire guide path 402.

During the feed cycle, the free end 108 of the length of wire 102 is fed by the feed and tension assembly 200 through the non-metallic tube 414 about which the ring sensor 412 is located. The ring sensor 412 detects the internal presence of the wire 102 and transmits a detection signal 413 to the control system 500. The free end 108 then passes through the feed tube coupling 416, the main feed tube 418 and into the track entry subassembly 420.

In the track entry subassembly 420, the free end 108 initially passes from the main feed tube 418 into the groove 423 cut into the track entry top 424, which is secured to the track entry bottom 422. The free end 108 passes through the groove 423 into and through the first wire slot 428 in the track entry back 426, through the twister assembly 300, and into the first straight section 430 of the track assembly 400.

An alternative form of track entry sub-assembly 420*a* substitutes conventional straight opening track sections 418*a* for the main feed tube 118. This opening track section allows for removal of excess wire from the accumulator drum by opening the twister head and then feeding the wire against the cutter. This causes the wire to bubble out of the track sections 418*a* while controlling both ends of the wire which are to be removed from the machine.

The straight sections 430 maintain the direction of the free end 108 along the wire guide path 402. The straight front and back plates 432, 434 are releasably held together along their respective spine sections 437. The structure allows the sections to separate in a manner to free the wire when tensioned.

From the straight section 430, the free end 108 is fed into the corner section 450. As the free end 108 enters the corner section 450, it obliquely strikes the rounded face 458 of the ceramic sections 456. The ceramic sections 456 change the direction of the free end 108 of the length of wire 102, while preferably imposing minimal friction. Preferably, the ceramic sections 456 are relatively impervious to gouging by the sharp, rapidly moving free end 108. The ceramic sections 456 may be fabricated from a variety of suitable, commercially-available materials, including, for example, pressure formed and fired A94 ceramic. It is understood that the plurality of ceramic sections 456 contained within each corner section 450 may be replaced with a single, large ceramic section.

As with the straight sections 430, the structure of the corner sections 450 provides for the containment of the wire 102 during the feed cycle by the natural elasticity of the corner front and back plates 452, 454, while allowing the wire 102 to escape from the corner section 450 during the tension cycle. Because the rounded face 458 only partially surrounds the wire guide path 402, the wire 102 may escape from between the corner front and back plates 452, 454 during tensioning.

It should be noted that the track assembly 400 need not have a plurality of alternating straight and corner sections 430, 450. The track assembly 400 having the alternating straight and corner sections 430, 450, however, affords a modular construction that may be easily modified to accommodate varying sizes of bundles.

Figure 22:
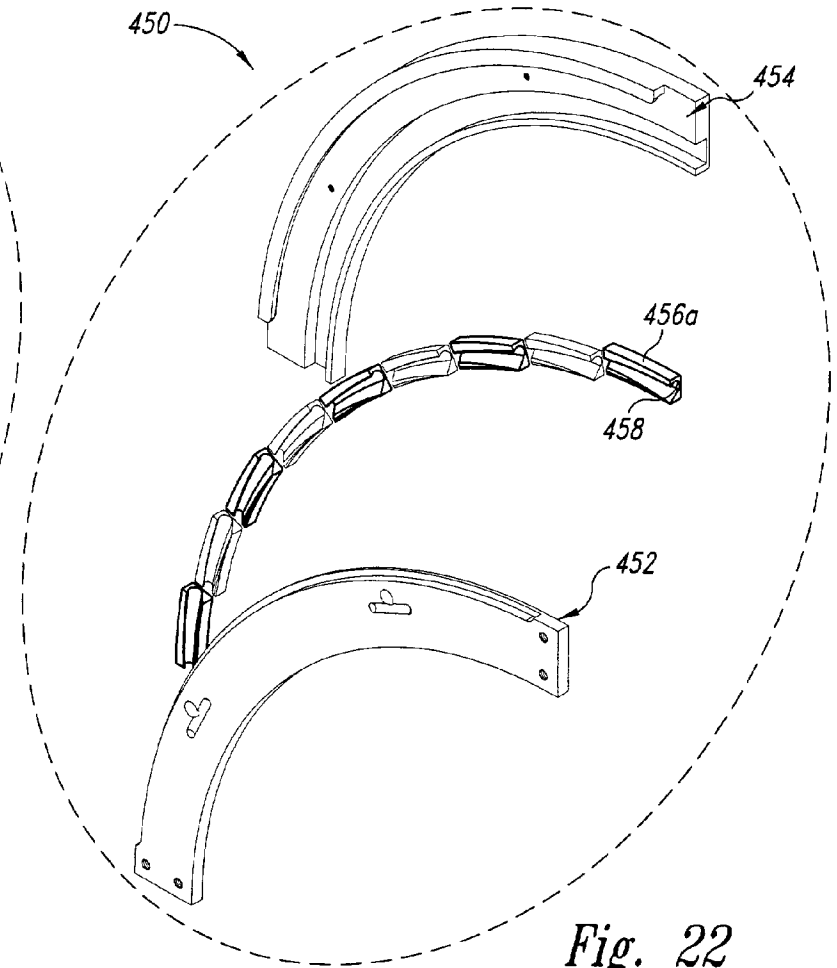
FIG. 22 is an enlarged schematic detail of a modified corner section of the track assembly of FIG. 20 taken also at detail reference numeral 22.

This means as a track is to be expanded to handle larger objects or bundles, new larger single piece corners need not be expensively manufactured. One piece corners of hard metal, for example, are expensive to manufacture. Whereas it is a unique feature of the corners of this invention that they are made of multiple identical segments. FIG. 21 shows ceramic segments and FIG. 22 shows hardened tool steel segments. When it is necessary to enlarge the corners, more segments, all of the same modular shapes, can be inserted into new larger radius corners.

FIG. 22 shows segments 456*a* as hardened tool steel with a rounded face 458*a*. These steel segments are also tapered from entry end to exit end into a funnel shape to guide the wire concentrically into the next abutting segment.

The free end 108 continues to be fed into and through alternating straight and corner sections 430, 450 until it is fed completely around the track assembly 400. The free end 108 then enters the track entry subassembly 420, passing into the second wire slot 429 in the track entry back 426. The free end 108 then reenters the twister assembly 300 and is held by the gripping subassembly 320 as described above. During the tension cycle, the track entry back 426 is disengaged from the track entry top 424 by compression of the entry springs 427 as the wire 102 is drawn upwardly between the track entry back and top 426, 424, releasing the second passage of the wire 102 from the track entry subassembly 420 and allowing the wire 102 to be drawn tightly about the one or more objects located in the bundling station 106. After the twister assembly 300 performs the twisting, cutting, and ejecting functions, the wire loop 116 is free of the track assembly 400.

Figure 23:
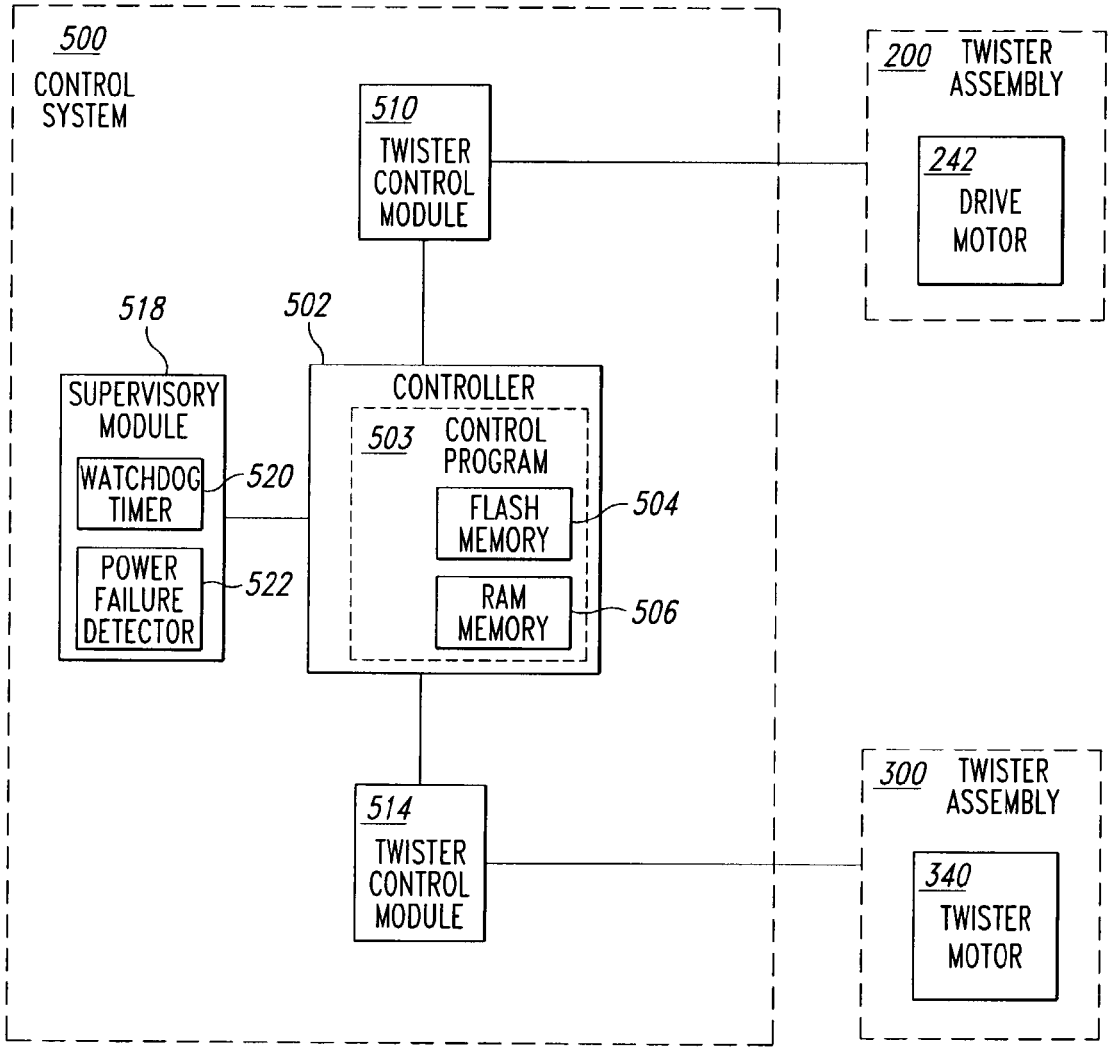
FIG. 23 is a schematic diagram of a control system of the wire-tying machine of FIG. 1.
Figure 24:
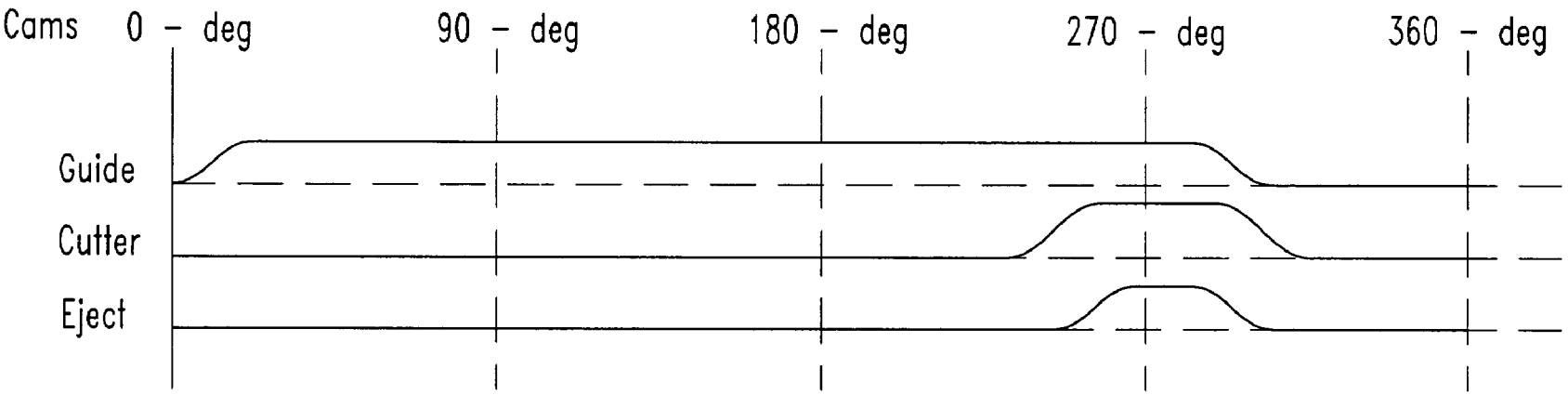
FIG. 24 is a graphical representation of a cam control timing diagram of the twister assembly of FIG. 9.
Figure 25:
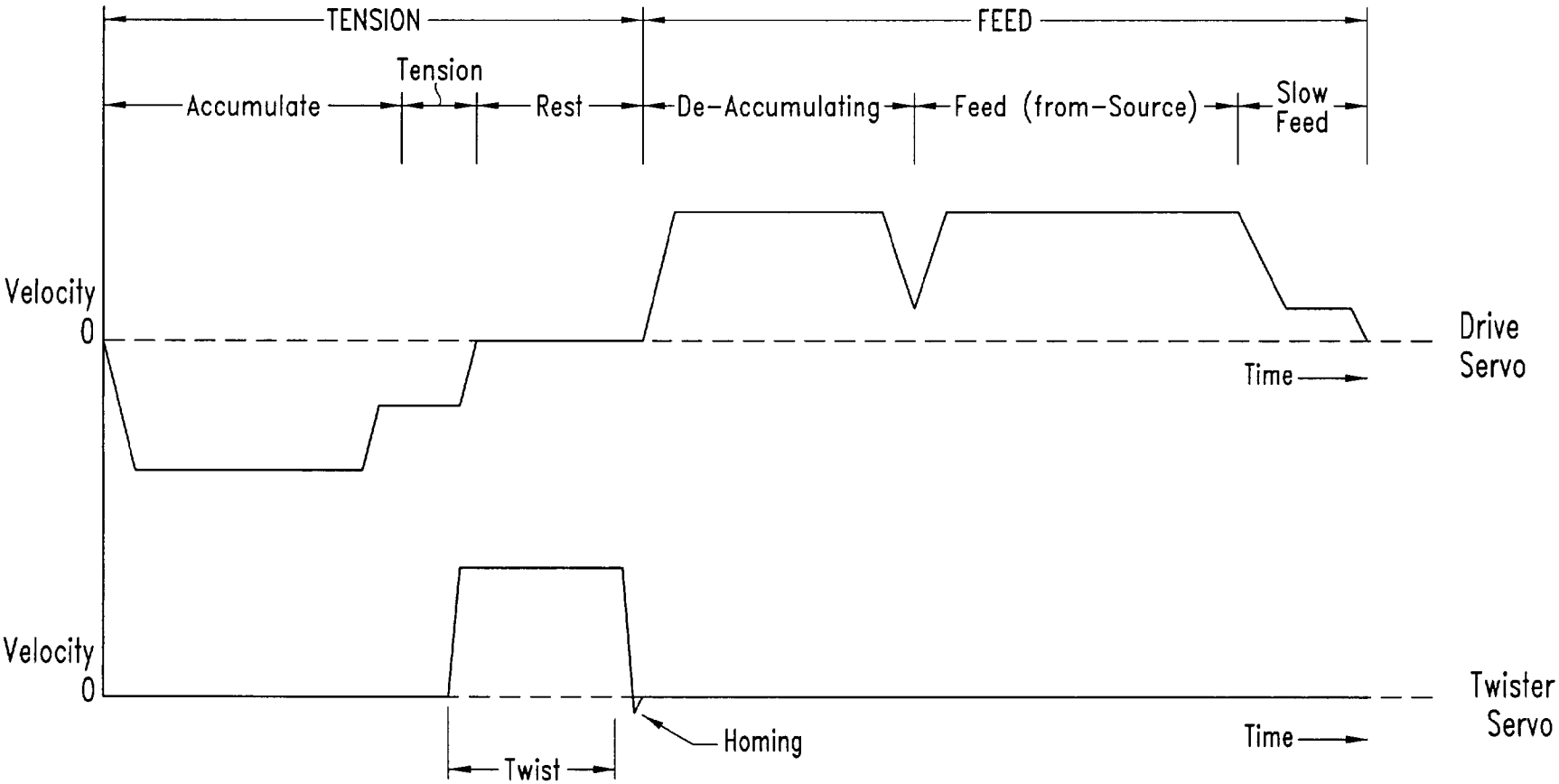
FIG. 25 is a graphical representation of a servo-motor control timing diagram of the twister assembly of FIG. 9.

As described above, all of the functions of the wire-tying machine 100 are activated through two motors: the drive motor 242 (FIG. 4), and the twister motor 340 (FIG. 9). The drive and twister motors 242, 340 are controlled by the control system 500. FIG. 23 is a schematic diagram of the control system 500 of the wire-tying machine 100 of FIG. 1. FIG. 24 is a graphical representation of a cam control timing diagram of the twister assembly 300 of FIG. 9. FIG. 25 is a graphical representation of a twister motor control timing diagram of the twister assembly 300 of FIG. 9.

Referring to FIG. 23, in this embodiment, the control system 500 includes a controller 502 having a control program 503 and being operatively coupled to a non-volatile flash memory 504, and also to a RAM memory 506. The RAM 506 may be re-programmed, allowing the control system 500 to be modified to meet the requirements of varying wire-tying applications without the need to change components. The non-volatile flash memory 504 stores various software routines and operating data that are not changed from application to application.

The controller 502 transmits control signals to the drive and twister control modules 510, 514, which in turn transmit control signals to the drive and twister assemblies 200, 300, particularly to the drive and twister motors 242, 340. A variety of commercially available processors may be used for the controller 502. For example, in one embodiment, the controller 502 is a model 80C196NP manufactured by Intel Corporation of Santa Clara, Calif.; and having features: a) 25 Mhz operation, b) 1000 bytes of RAM register, c) register-register architecture, d) 32 I/O port pins, e) 16 prioritized interrupt sources, f) 4 external interrupt pins and NMI pins, g) 2 flexible 16-bit timer/counters with quadrature counting capability, h) 3 pulse-width modulator (PWM) outputs with high drive capability, i) full-duplex serial port with dedicated baud rate generator, j) peripheral transaction server (PTS), and k) an event processor array (EPA) with 4 high-speed capture/compare channels. Analog feedback signals may also be used, allowing the controller 502 to use a variety of analog sensors, such as photoelectric or ultrasonic measuring devices. The control program 503 determines, for example, the number of rotations, the acceleration rate, and the velocity of the motors 242, 340, and the controller 502 computes trapezoidal motion profiles and sends appropriate control signals to the drive and twister control modules 510, 514. In turn, the control modules 510, 514, provide the desired timing control signals to drive the twister assemblies 200, 300, as shown in FIGS. 24, 25.

A variety of commercially available processors may be used for controllers 510 and 514. For example, in one embodiment, the controllers 510, 514, are model LM628 manufactured by National Semiconductor Corporation of Santa Clara, Calif. The controller 502 may also receive motor position feedback signals from, for example, motor mounted encoders. The controller 502 may then compare positions of the drive motor 242 and the twister motor 340 with desired positions, and may update the control signals appropriately.

The controller 502, for example, may update the control signals at rate of 3000 times per second. Preferably, if the feedback signals are digital signals, the feedback signals are conditioned and optically isolated from the controller 502. Optical isolation limits voltage spikes and electrical noise which commonly occur in industrial environments. Analog feedback signals may also be used, allowing the controller 502 to use a variety of analog sensors, such as photoelectric or ultrasonic measuring devices.

The watchdog timer 520 of the supervisory module 518 interrupts the controller 502 if the controller 502 does not periodically poll the watchdog timer 520. The watchdog timer 520 will reset controller 502 if there is a program or controller failure. The power failure detector 522 detects a power failure and prompts the controller 502 to perform an orderly shutdown of the wire-tying machine 100.

The load cycle is used to thread (or re-thread) the length of wire 102 into the wire tying machine 100 from the wire supply 104. Typically, the load cycle is utilized when the wire supply 104 has been exhausted, or when a fold or break necessitates reinsertion of the wire 102 into the machine 100. Referring to FIG. 6, the feed solenoid 265 is actuated. The wire 102 is then manually fed into the wire tying machine 100 from the remote wire supply 104, through the wire inlet 225 (FIG. 3). The wire 102 is then manually forced through the hollow center of the accumulator axle 224, around the transverse guide wheel 234 (or through the curved roller axle tube 235) and around the tangent guide wheel 236. The wire 102 is forced into the pinch area between the tangent guide wheel 236 and tangent pinch roller 239.

At this point, the drive motor 242 having been actuated by the insertion of wire 102, turns the drive wheel 246 at slow speed in the feed direction 132. The wire 102 is deflected around the tangent guide wheel 236 and between the tangent guide wheel 236 and a drive wheel 246. The feed pawl 267 having been forced down by the feed solenoid 265 deflects the free end 108 of the wire 102 around the drive wheel 246. The load cycle is halted when the wire 102 is detected at the ring sensor 412, or by deactivation of the manual feed.

Initiation of the feed cycle engages the drive wheel 246 to feed the length of wire 102 through the twister assembly 300 and around the track assembly 400. The drive motor 242 rotates the drive shaft 248 and drive wheel 246 through the 90° gear box 244. The wire 102 is fed across the drive wheel 246 adjacent to the drive entry guide 260, under the drive pinch roller 249, and adjacent to the drive exit guide 262 where the exhaust pawl 266 is located. The wire 102 is then fed through the feed tube subassembly 410, through the twister assembly 300, around the track assembly 400, and back into the twister assembly 300 to be restrained by the gripping subassembly 320. The feed stop switch 337 detects the movement of the gripper disc 326 associated with the presence of the wire 102 and signals the location of the wire 102 to the control system 500 to complete the feed cycle.

Typically there will be some length of wire accumulated on the accumulator drum 222 from the previous tension cycle. As best shown in FIG. 25, this accumulation of wire will be payed off from the helical groove 229 of the accumulator drum 222 by the drive wheel 246, with a brief reduction of wire feed rate at the transition point until the accumulator drum 222 rotates into its stop position with the drive wheel 246 adjacent to the tangent guide wheel 236. The feed cycle then continues by drawing the wire 102 from the external wire supply 104 as indicated above. The feed rate ramps down to a slow feed rate as the free end 108 of the wire 102 approaches the twister assembly 300 on its second pass. The slow speed feed continues until the free end 108 energizes the feed stop switch 337 indicating the completion of the feed cycle. If the control system 500 detects that a sufficient length of wire 102 has been fed without triggering the feed stop switch 337 (i.e., a wire misfeed has occurred), the control system 500 halts operation and issues an appropriate error message, such as illuminating a warning light.

The tension cycle is initiated, either manually or by the control system 500, causing the drive motor 242 to rotate the drive wheel 246 in the tension direction 134, withdrawing the wire 102 partially from the track assembly 400. A shown in FIG. 25, the drive motor 242 ramps to high-speed in the tension (accumulate) direction 134. The number of rotations of the drive motor 242 may be counted for reference during the following feed cycle. The high-speed phase is terminated when a minimum loop size has been reached or when the drive motor 242 stalls. If the minimum loop size is encountered the machine will be directed to do one of two possible things depending upon desired machine operation. Either the control system 500 halts operation, or the machine continues as normal by initiation of the twist cycle, thus clearing the empty wire loop from the machine for continued operation.

Tension on the wire causes the gripper disc 326 to impinge upon the second passage of the wire 102*b*, passively increasing its gripping power with increased wire tension. The wire 102 is thus pulled from the wire guide path 402 and is drawn about the one or more objects within the bundling station 106.

Initially the drive wheel 246 is located adjacent to the tangent guide wheel 236. Because the tangent guide wheel 236 is mounted on a clutch 238 that operates freely in only one direction, the tangent guide wheel 236 is unable to rotate relative to the accumulator drum 222 into tension direction 134. The entire accumulator drum 222 rotates in response to the impetus from the drive wheel 246, smoothly laying the wire along the helical groove 229 in the accumulator drum 222. The accumulator drum 222 is forced to move laterally along its axis of rotation between the supports 230 by the wire laying into the groove as the wire proceeds along the helical groove 229.

Wire is wound around the accumulator drum 222 until the drive motor 242 stalls, at which time the drive motor 242 is given a halt command by the control system 500. The halt command causes the drive motor 242 to maintain its position at the time the command was given, thus maintaining tension in the wire 102. The control system 500 may record the amount of wire stored on the accumulator drum 222 by means of a signal from an encoder on the drive motor 242, which may be used during the subsequent feed cycle to determine a feed transition point, that is, a point at which feeding is transitioned from feeding wire stored on the accumulator drum 222 to feeding from the external wire supply 104.

The drive motor 242 maintains the tension in the wire 102 by maintaining its position at the time when the halt command was given by the control system 500. The drive motor stall also initiates the twist cycle in the automatic mode, as described below. After the wire 102 has been severed during the overlapping twist cycle, the tension in the wire 102 may cause the wire to retract a short distance after it is abruptly released. The tension cycle is terminated at the completion of the twist cycle (described below) and the drive motor 242 ceases operation until the start of the next feed cycle.

When the drive motor 242 stalls, the twist cycle is initiated. The head cover 308 opens to allow space for formation of the knot 118. The twister motor 340 applies torque to the twister shaft 339 through the gear reducer 342, rotating the drive gear 338 and ultimately the slotted pinion 332. The guide cam 316 engages the guide cam follower 318, opening the front and rear guide blocks 303, 304 to allow clearance for the knot 118 to be formed. The wire 102 is forced by the rotating pinion 332 to wrap about itself, typically between two and one-half and four times, creating the knot 118 which secures to be wire loop 116. As the twist cycle nears completion, the movable cutter carrier 352 is actuated to sever the wire 102, and the front and rear ejectors 372, 374 are raised, as the head opens, ejecting the wire loop 116 from the twister assembly 300.

As shown in FIG. 24, the total twist cycle is produced by one complete revolution of the twister shaft 339, which is typically a result of several revolutions of the twister motor 340 whose number varies depending upon the gear ratio used in the gear reducer 342. As the twister shaft 339 nears completion of a revolution, all elements of the twister assembly 300 are repositioned to their home positions, ready to reinitiate additional cycles. The home switch 377 detects the position of the ejector cam 378 and signals the control system 500 that a complete revolution has occurred. Upon receiving the signal from the home switch 377, the control system 500 reduces the speed of the twister motor 340 to slow, and a homing adjustment is made (FIG. 25).

The control system 500 may also halt the rotation of the twister motor 340 if an excessive number of rotations of the twister motor 340 is detected. If this occurs, the twister motor 340 is halted with enough clearance to allow the release of the wire 102 or wire loop 116. The control system 500 may then generate an appropriate error message to the operator, such as illuminating a warning lamp. If the twister motor 340 has not faulted, the control system makes a homing adjustment and the twister motor 340 is dormant until required for the next twist cycle.

The wire reject cycle is used to clear any accumulated wire in the event that all wire must be removed from the wire tying machine 100. The wire reject cycle typically operates in the manual mode. The wire reject cycle is initiated by to energizing the drive motor 242, rotating the drive wheel 246 at slow speed in the tension direction 134. Wire fed into the track assembly 400 and the twister assembly 300 is withdrawn and stored about the accumulator drum 222 until the free end 108 is inboard of the exhaust pawl 266. Then the exhaust solenoid 264 is energized to deflect the exhaust pawl 266, and a drive wheel 246 rotation is re-energized in the feed direction 132. The drive wheel 246 continues to run slowly in the feed direction 132 until the manual feed command is released and as long as the wire 102 remains in the machine 100. The wire 102 is exhausted slowly out of the machine 100 along the wire exhaust path 204 (FIG. 8) and onto the floor were it may be easily removed.

The control system 500 advantageously allows important control functions to be programmably controlled and varied. Conventional wire-tying machines utilized control systems which were designed to apply a particular force for a set period of time. The control system 500 of the wire-tying machine 100, however, permits the machine to adapt its performance and specifications to yet undefined requirements. Due to this flexibility, great cost savings may be realized as wire-tying requirements are varied from application to application.

Furthermore, in the case where the drive and twister motors 242, 340 are electric servo-motors, the wire tying machine 100 is fully electric without using hydraulic or pneumatic systems traditionally used in wire-tying apparatus. Elimination of hydraulics reduces the physical dimensions of the machine 100, eliminates the impact of hydraulic fluid spills and the need for hydraulic fluid storage, reduces maintenance requirements by eliminating hydraulic fluid filters and hoses, and reduces mechanical complexity. Also, because electric servo-motors are motion-based systems, as opposed to hydraulic systems that are forced or power-based systems, inherent flexibility in motion control is provided without the need for additional control mechanisms or feedback loops. Another advantage is that the power consumption of a servo-motor system is much less than that of a hydraulic system.

Figure 26:
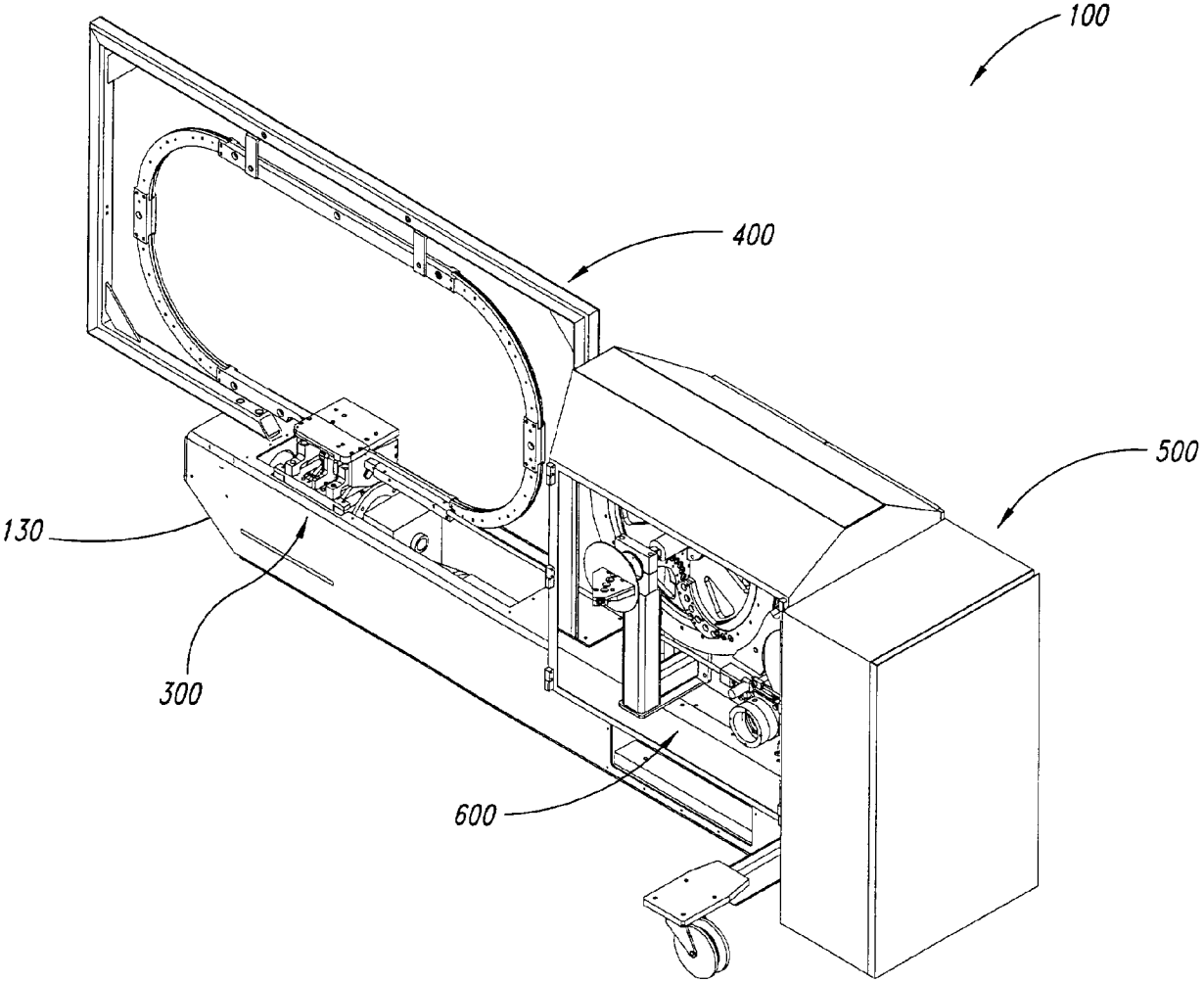
FIG. 26 is a front isometric view of a wire-tying machine incorporating another feed and tension mechanism in accordance with an alternate embodiment of the invention.
Figure 27:
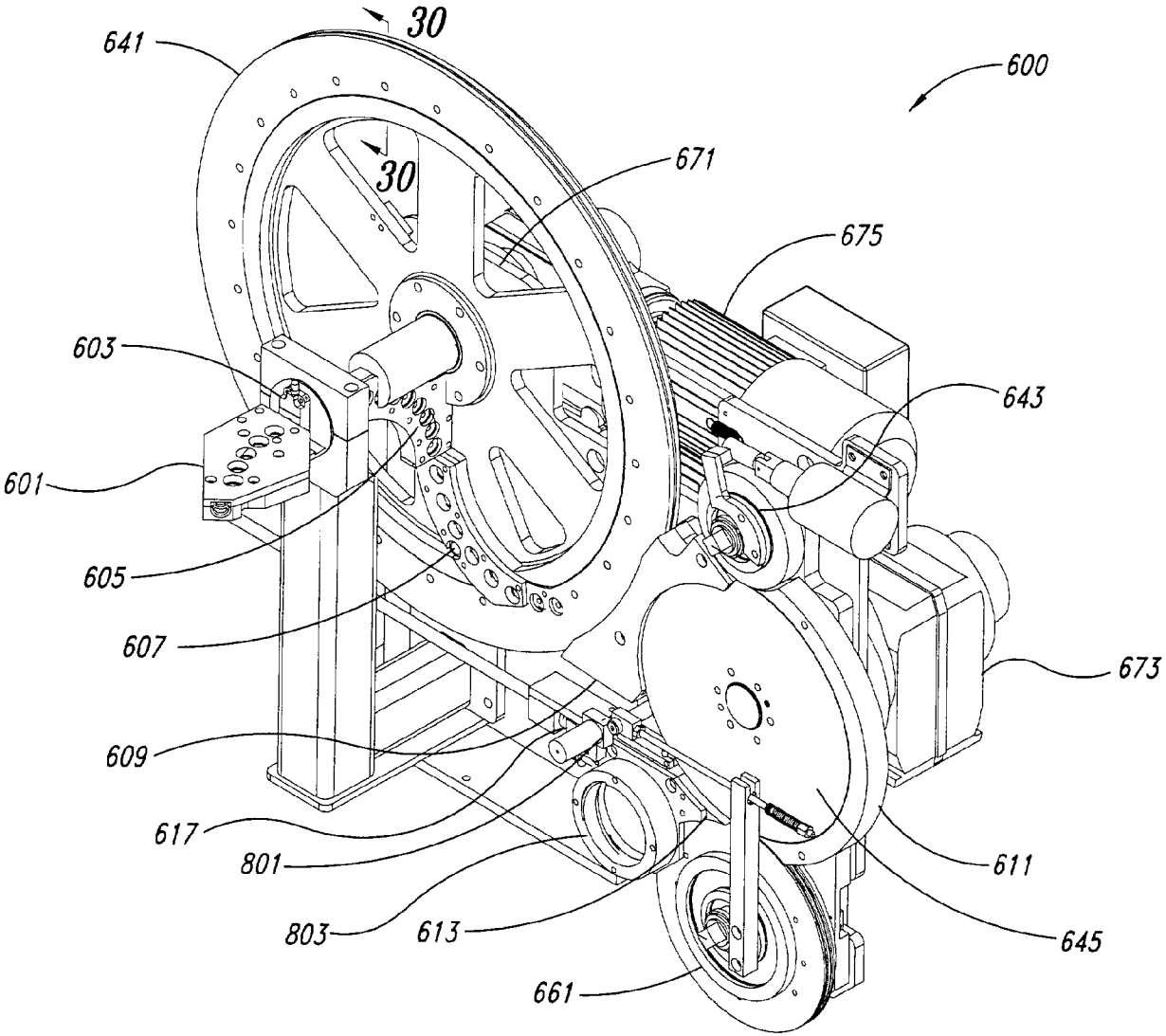
FIG. 27 is a front isometric view of the feed and tension mechanism from the wire-tying machine of FIG. 26.
Figure 28:
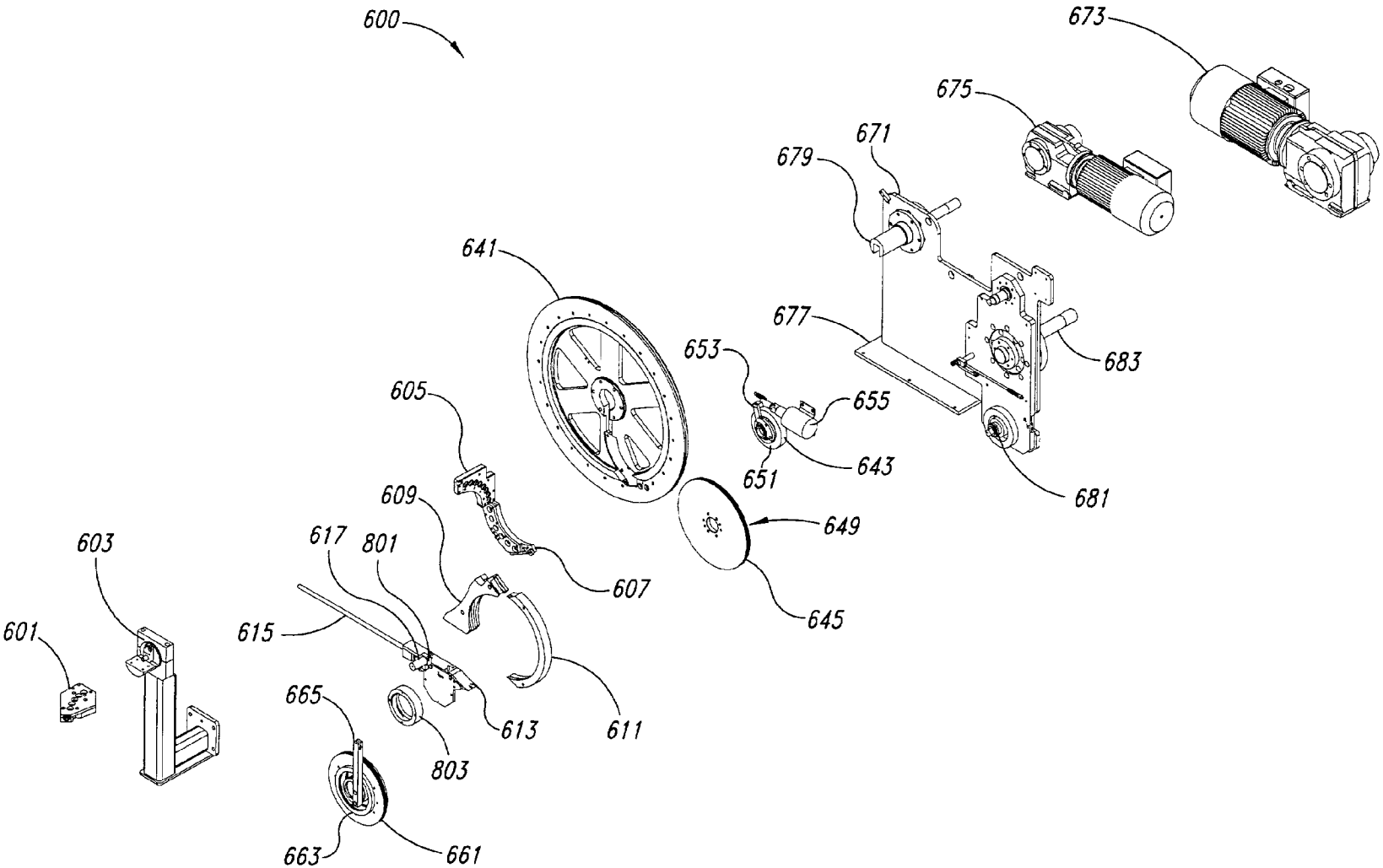
FIG. 28 is an exploded isometric view of the feed and tension mechanism of FIG. 27.

An alternative embodiment of the feed and tension mechanism 600 is illustrated in FIGS. 26–28. To avoid confusion, the structural elements of the mechanism are identified with reference numbers in FIGS. 27 and 28, and the arrows illustrating operational nodes are independently illustrated in FIGS. 38–40.

The feed and tension mechanism 600 has several major assemblies, including a feed and tension wheel, 645, an accumulator wheel 641, a drive system comprising two independently operable motors, a supplementary nip mechanism 643, a primary nip mechanism 661, a wire stripping mechanism 800, and a series of wire sensing devices in communication with a control system. At least some of the aforementioned assemblies also include wire guiding devices for directing and routing the wire through the feed and tension mechanism 600. The feed and tension mechanism 600 further includes a frame 671 that structurally supports the major assemblies and attaches to the wire-tying machine 100.

A feed and tension unit frame 671 provides the attachment points for a feed wheel gearmotor 673, an accumulator gearmotor 675, an accumulator wheel 641, a feed and tension wheel 645, and the upper and lower nip wheels 643, 661. A lower flange 677 of the frame 671 can provide the attachment point to the wire-tying machine 100 through standard mechanical means such as bolts.

As best seen in FIGS. 27 and 28, the feed and tension wheel 645 may be mounted on feed wheel shaft 683 attached to the frame 671. The feed and tension wheel 645 can be proximately located to the accumulator wheel 641, but not in physical contact. The feed and tension wheel 645 is configured with a feed wheel wire groove 649.

Figure 29:
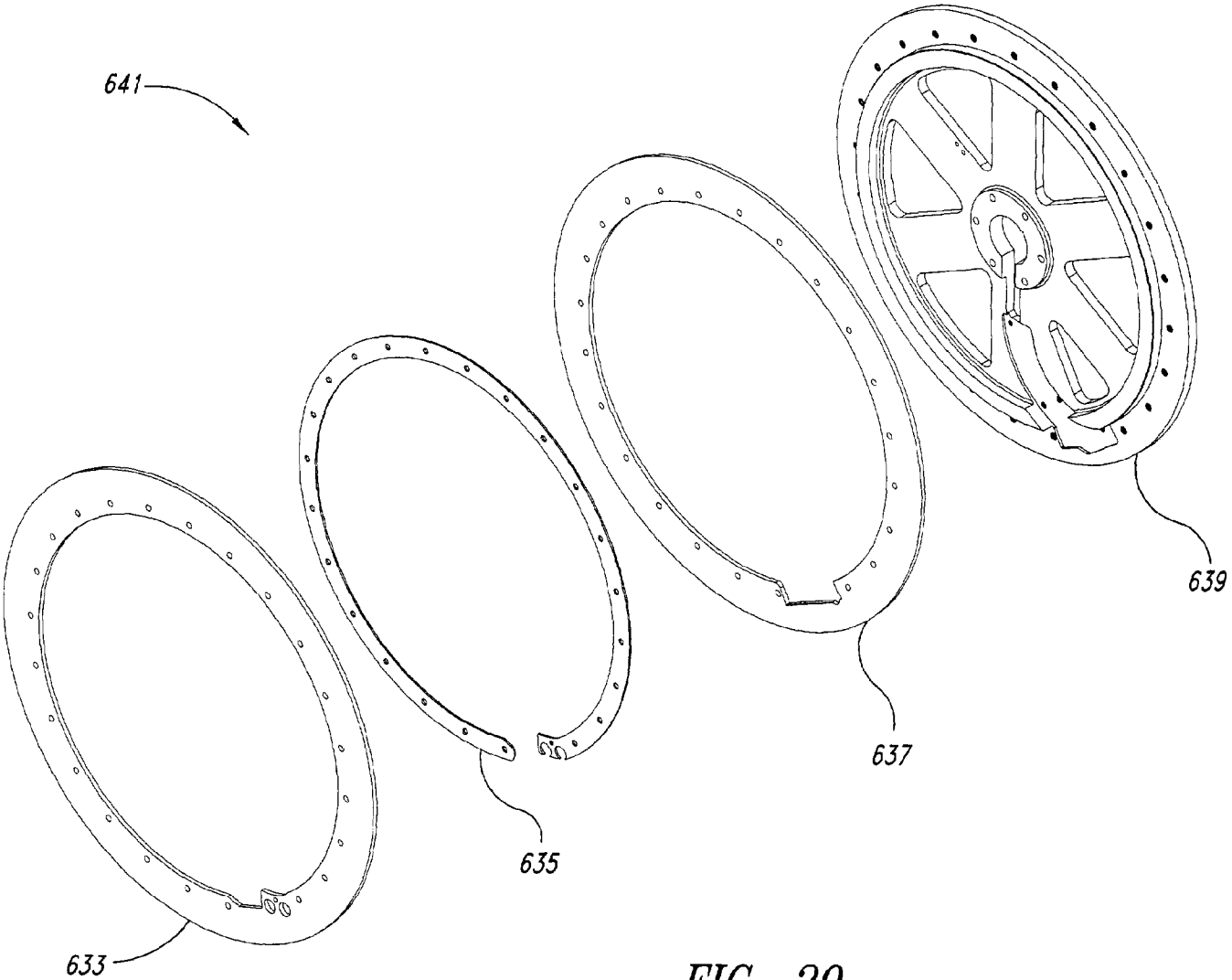
FIG. 29 is an exploded isometric view of an accumulator disk from the feed and tension unit of FIG. 27.
Figure 30:
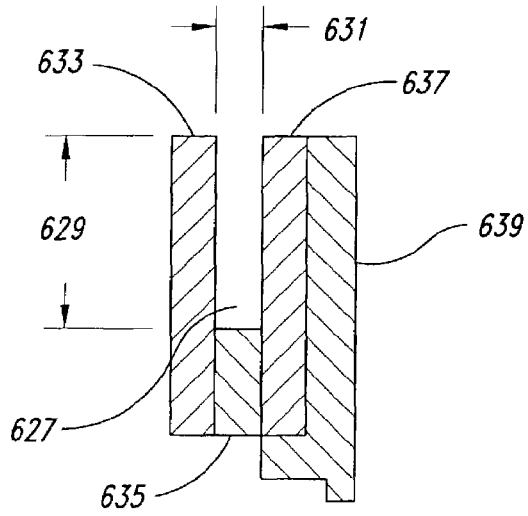
FIG. 30 is a cross-sectional view of a portion of the accumulator disk of FIG. 29, viewed along Section 30—30 of FIG. 27.
Figure 31:
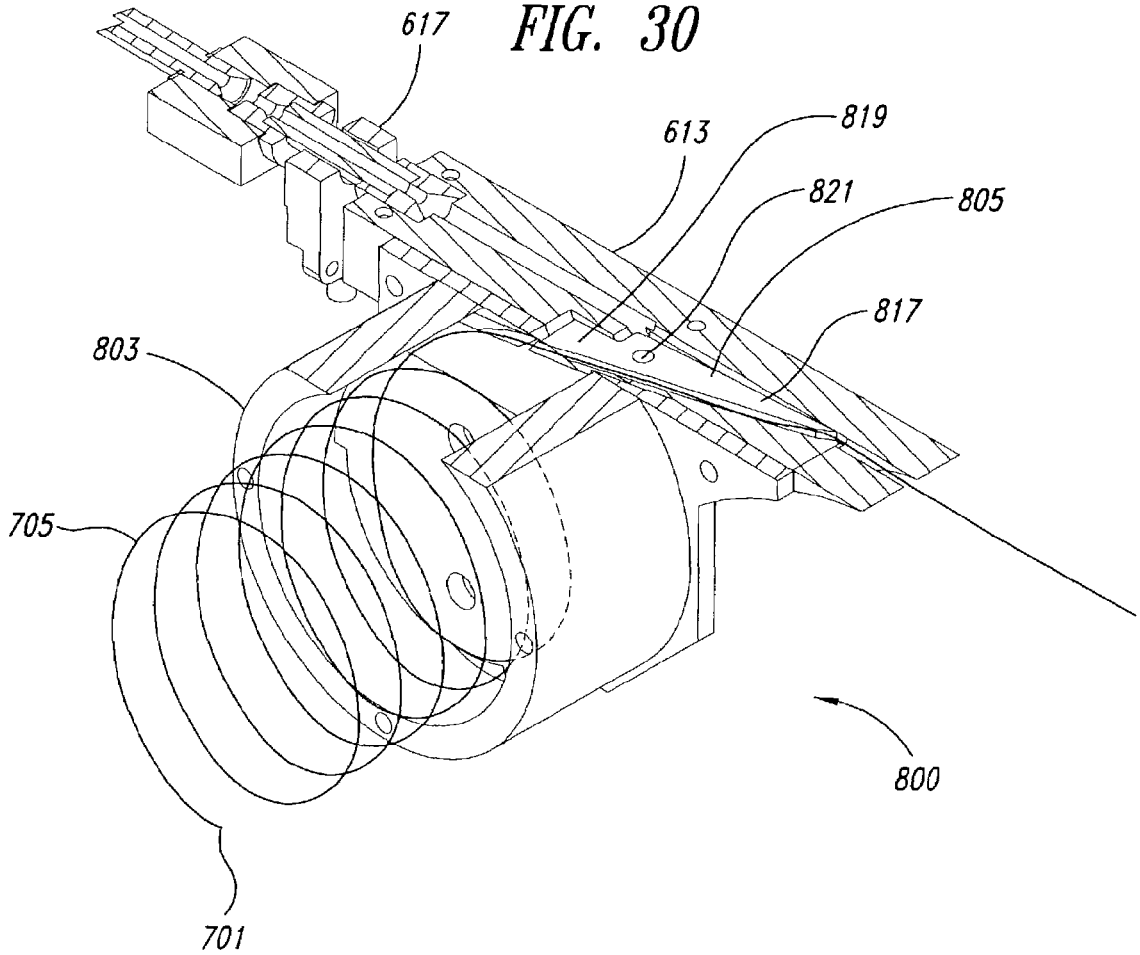
FIG. 31 is an enlarged isometric detail of a wire coiler and wire gate from the feed and tension mechanism of FIG. 28 with the upper portion removed for visibility purposes.

As shown in FIG. 28, the accumulator wheel 641 may be mounted on an accumulator wheel shaft 679 attached to the frame 671. FIG. 29 is an exploded isometric view of the accumulator wheel 641. The accumulator wheel 641 is comprised of several hollow, circular plates and an accumulator hub 639. The accumulator hub 639 can be coupled to the accumulator wheel shaft 679 which may be mounted to the frame 671 with bearings and a bearing block. The remaining components include a spacer 635 sandwiched between inner 637 and outer 633 circular wear plates. The three components can be fastened to the accumulator hub 639 (FIG. 29). Section 30—30 of FIG. 28, an upper portion of the accumulator wheel 641, is shown as FIG. 30. The spacer 635 has a smaller outer diameter relative to the inner 637 and outer 633 wear plates, such that an accumulator groove 627 is formed to receive accumulated wire. The width 631 of the accumulator groove 627 is at least equal to the wire diameter while the depth 629 of the accumulator groove can be deep enough to permit several wraps of wire to be completely captured within the accumulator groove 627.

The next major assembly of the feed and tension mechanism 600 is the drive system, best seen in FIG. 28. The drive system includes two independent motors, an accumulator gearmotor 675 and a feed wheel gearmotor 673. The accumulator gearmotor 675 is located on the opposite side of the frame 671 relative to the accumulator wheel 641. Likewise, the feed wheel gearmotor 673 is located on the opposite side of frame 671 relative to the feed and tension wheel 645.

Figure 38:
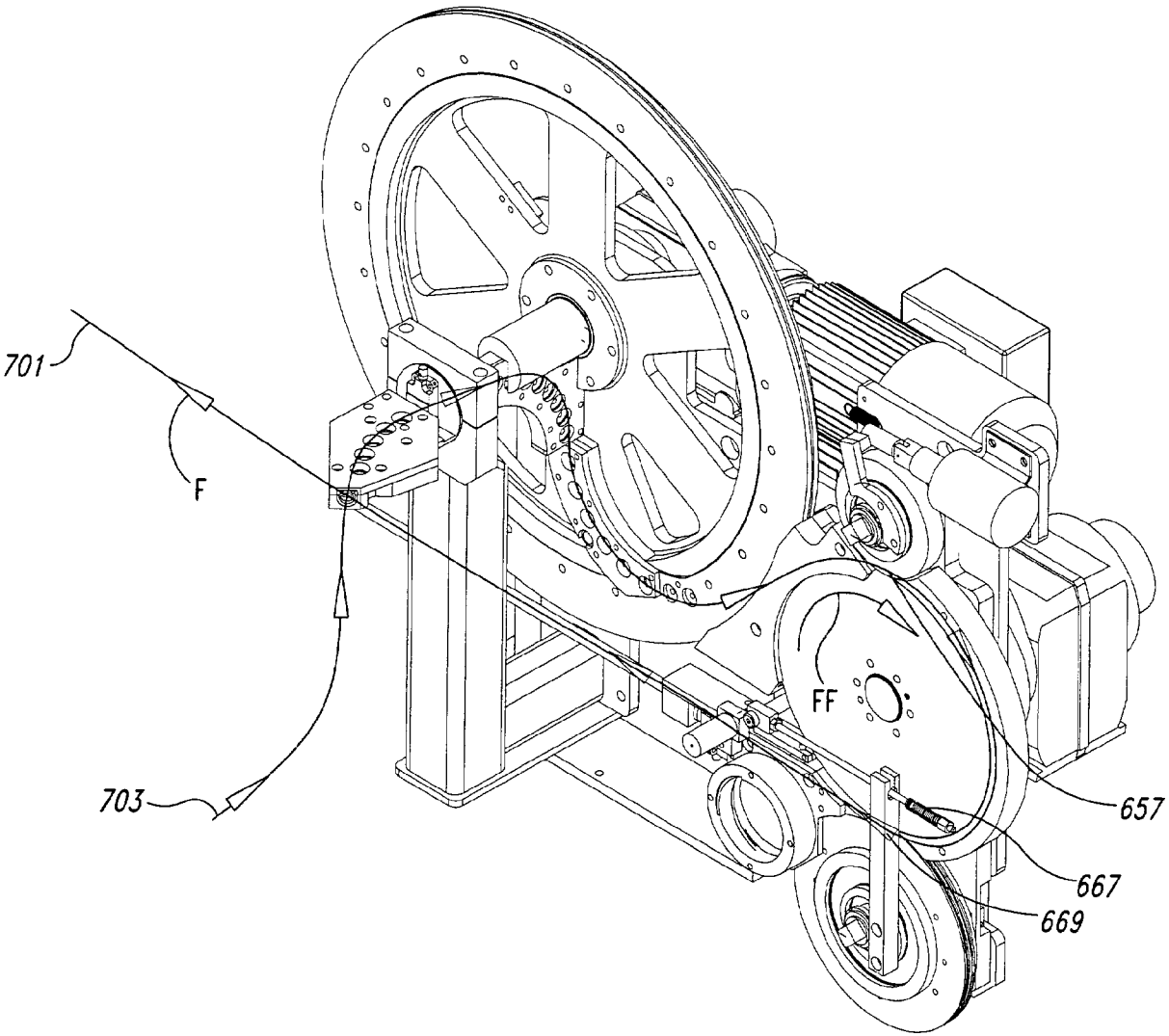
FIG. 38 is a schematic operational view of the feed and tension mechanism during the wire feed cycle.
Figure 39:
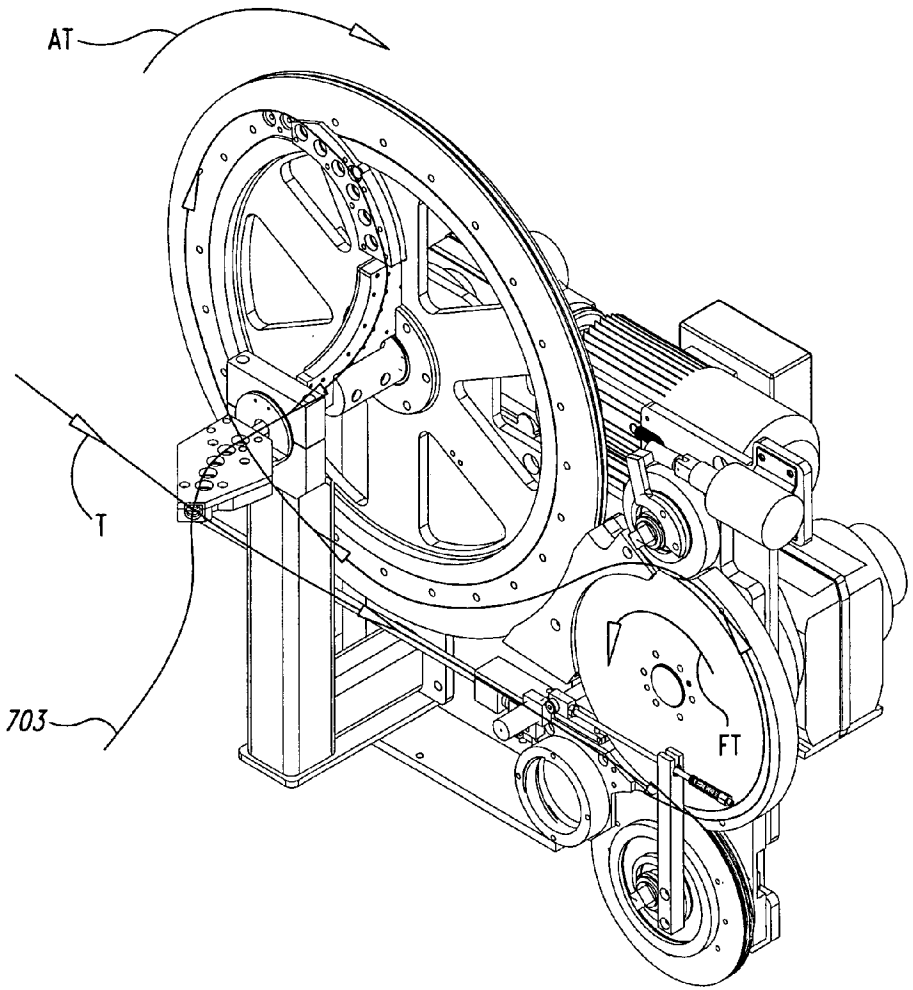
FIG. 39 is a schematic operational view of the feed and tension mechanism during the wire tensioning cycle.
Figure 40:
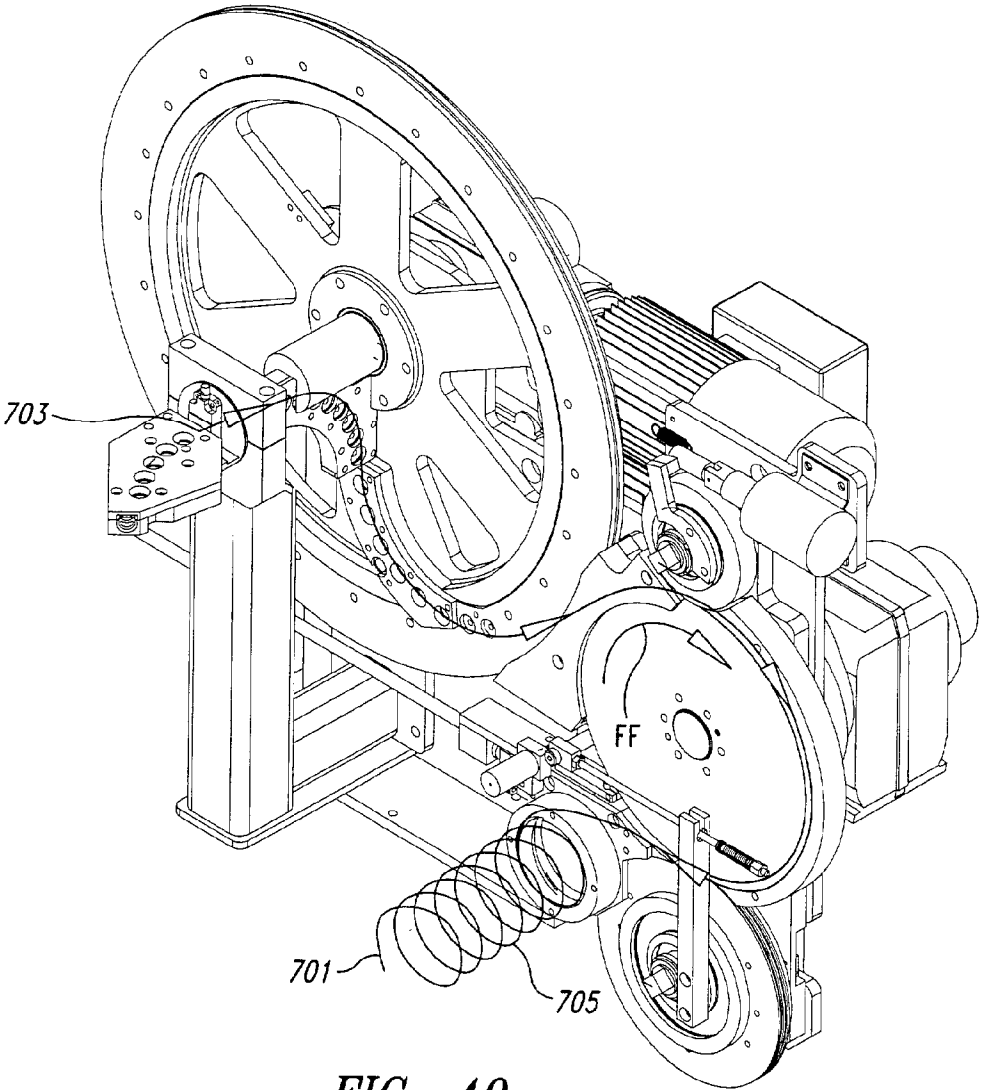
FIG. 40 is a schematic operational view of the feed and tension mechanism during the wire stripping cycle.

As shown in FIGS. 38–40, the accumulator gearmotor 675 drives the rotational movement of the accumulator wheel 641 in an accumulator tension direction "AT" (FIG.

39) and in an opposing accumulator feed direction. The feed wheel gearmotor 673 drives the rotational movement of the feed and tension wheel 645 in both a feed wheel feed direction "FF" and a feed wheel tension direction "FT."

Both the accumulator and feed wheel gearmotors, 675 and 673, can be operated by the control system 500. The control system 500 may utilize closed loop flux vector drive technology or other methods of control as the means of operating and controlling the respective gearmotors.

The supplementary nip mechanism 643 can facilitate the manual insertion of the wire into the feed and tension mechanism 600. The supplementary nip mechanism 643 is rotatably attached to the frame 671 and may be located above the feed and tension wheel 645. The supplementary nip mechanism 643 may be configured with a movable eccentric 651 attached to a lever arm 653. The lever arm 653 may be actuated by a linear actuator 655, such as a solenoid. Energizing of the solenoid 655 moves the lever arm 653 and the eccentric 651 to create contact between the supplementary nip mechanism 643 and the feed and tension wheel 645. The supplementary contact region 657 (FIG. 38) between the supplementary nip mechanism 643 and the feed and tension wheel 645 is the point where the wire becomes frictionally guided by the pinching force of the supplementary nip mechanism 643 impinging against the feed and tension wheel 645.

The next major assembly, which may be located near the bottom portion of the feed and tension wheel 645 as seen in FIG. 27, is the primary nip mechanism 661. The illustrated primary nip mechanism 661 is rotatably and eccentrically affixed to the frame 671. The primary nip mechanism 661 is comprised of a primary nip wheel 663 eccentrically mounted to the primary nip wheel lever arm 665. Motion of the primary nip wheel lever arm 665 causes the primary nip wheel 663 to eccentrically rotate relative to the primary nip mechanism mounting shaft 681 extending out from the frame 671. The primary nip wheel lever arm 665 may be spring 667 actuated as shown in FIG. 38. The purpose of the primary nip mechanism 661 is to apply a pinch force between the primary nip wheel 663 and the feed and tension wheel 645. The nip force at the primary nip contact region 669 can override the frictional engagement at the supplementary contact region 657 and can take primary control of drawing the wire into the feed and tension mechanism 600. The default position of the primary nip mechanism 661 can be in biased contact with the feed and tension wheel 645.

Shown in FIGS. 27 and 28 is the wire stripping mechanism 800. FIG. 40 provides a cutaway view of the wire stripping mechanism 800 showing the extraction path 823 of the wire. Stripping of the wire from the feed and tension mechanism 600 may occur when the wire has not been completely fed around the track assembly 400 (i.e., a misfeed) or when the external wire supply has become depleted and the trailing end of the wire 703 enters the feed and tension mechanism 600.

FIG. 40 illustrates the path of the leading end of wire coming from the feed and tension wheel 645. During stripping, the path is interrupted by the wire strip gate 805.

Figure 32:
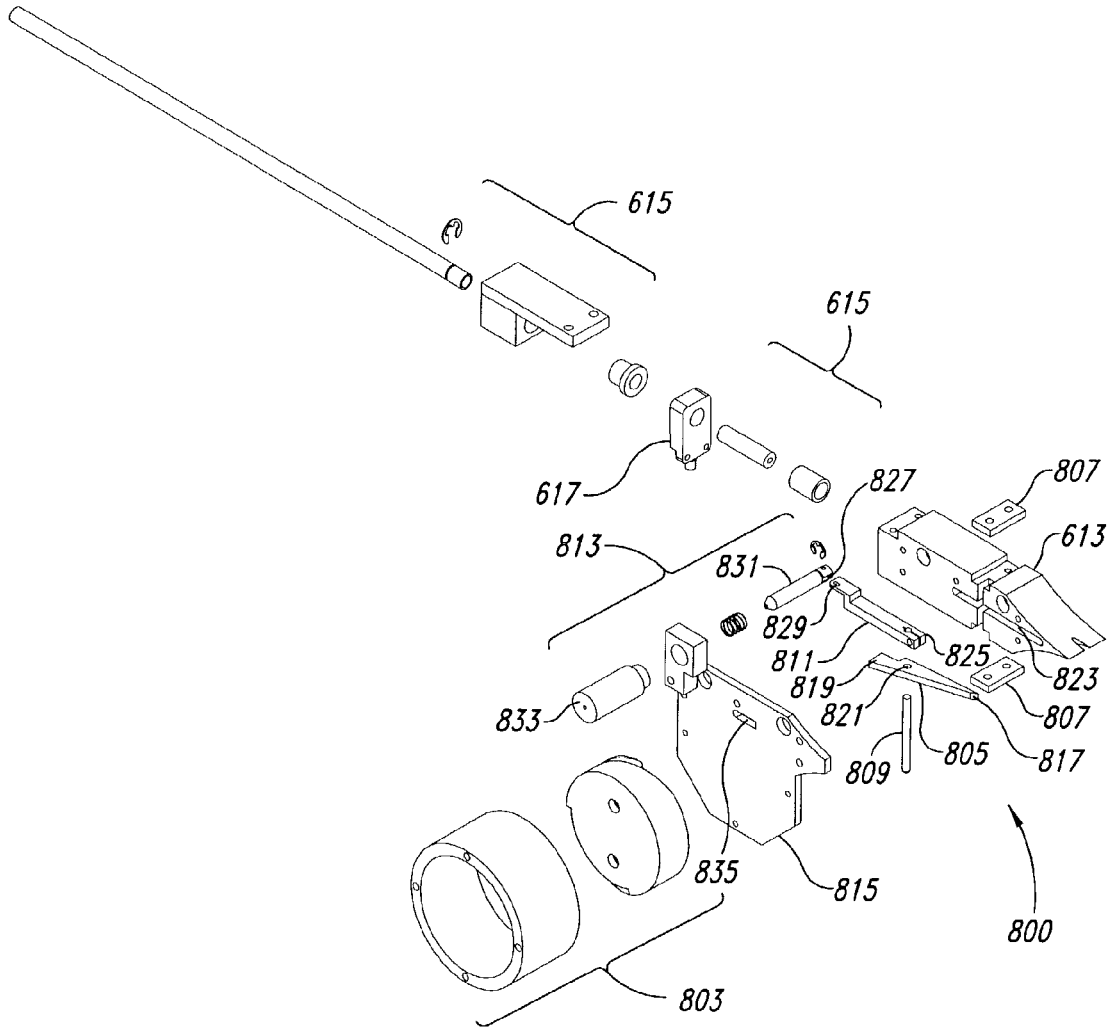
FIG. 32 is an exploded isometric view of the wire coiler and wire gate.

As illustrated in FIG. 32, which provides a detailed breakdown of the wire strip mechanism 800, the wire stripping mechanism 800 can be comprised of several components such as the wire strip gate 805, a lever arm 811, a pivot pin 809, a mounting plate 815, and a gate deflection device 813.

The wire strip gate 805 can be have a first end 817 configured to have a narrow, knife-edged portion and a second end 819 configured with a squared, boxed, flanged, rounded, or rectangular shape. Located between the first end 817 and second end 819 of the wire strip gate 805 can be a pivot slot 821. The wire strip gate 805 may be made from a flat stock of material such as metallic, composite, or plastic with the thickness being approximately equal to or slightly greater than the diameter of the wire. Additionally, the wire strip gate 805 can be configured to have a longitudinal slot (not shown) for more accurately directing the wire into the wire coiler 803. The wire strip gate 805 can be insertable into the wire gate slot 823 of the feed exit guide 613 (FIG. 35).

The lever arm 811 can have a deflection end 829 and a pivot end 825. The deflection end 829 can be received into a plunger slot 827 on the gate deflection device 813. The deflection end 829 of the lever arm 811 and the plunger 831 may be mechanically fastened to prevent any relative motion (FIGS. 33–35).

Figure 33:
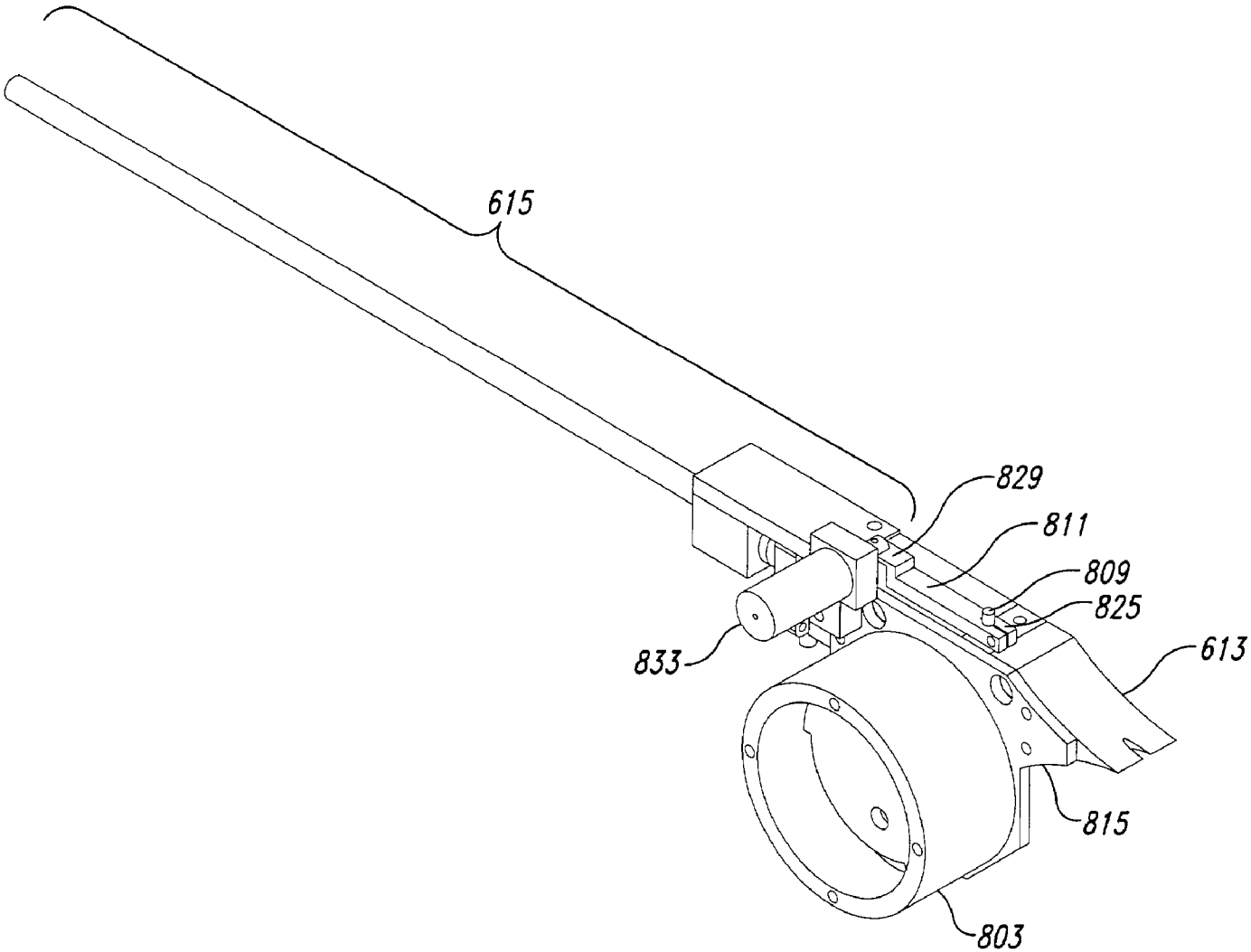
FIG. 33 is an isometric assembly of the wire coiler of FIG. 32.
Figure 34:
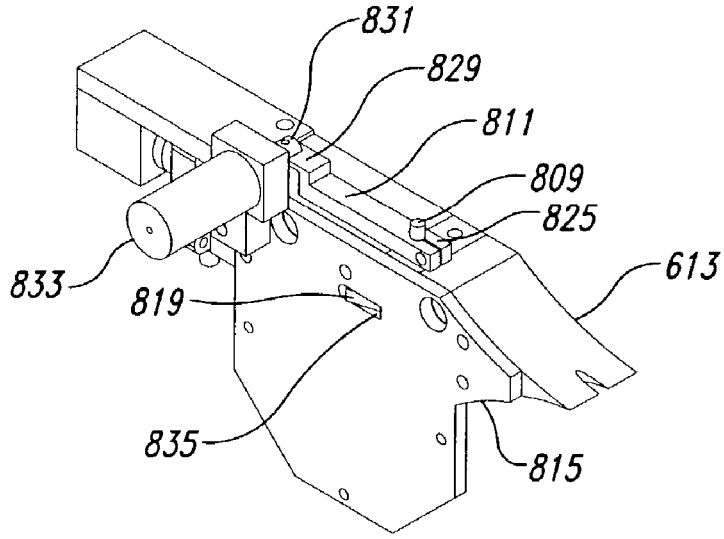
FIG. 34 is the isometric assembly of FIG. 33 with the wire coiler removed for clarity.
Figure 35:
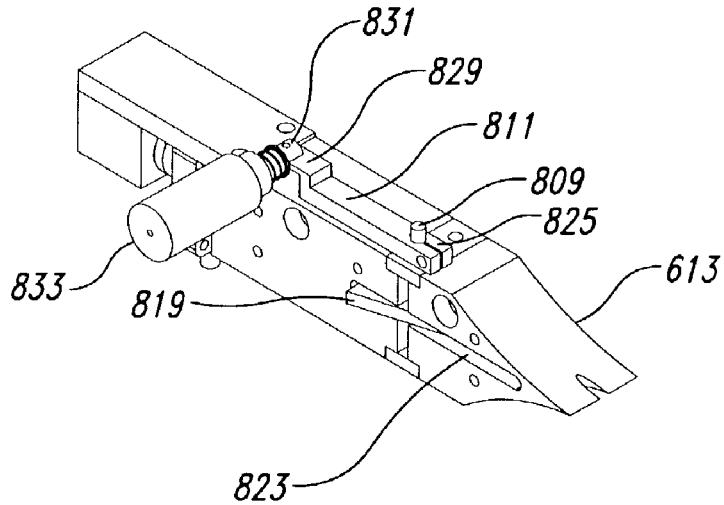
FIG. 35 is the isometric assembly of FIG. 33 with both the wire coiler and a mounting plate removed for clarity.

FIGS. 33–35 illustrate the attachment of the wire strip gate 805 and the lever arm 811 which are connected by the pivot pin 809. One portion of the pivot pin 809 can be clamped into the pivot end 825 of the lever arm 811. Another portion of the pivot pin 809 can be press fit into the pivot slot 821 of the wire strip gate 805. In such an embodiment, any rotation of the lever arm 811 would cause the pivot pin 809 and the wire strip gate 805 to also rotate accordingly. The pivot pin 809 can be inserted through attachment blocks 807 and freely rotatable therein. The blocks 807 can be mechanically mounted to the feed exit guide 613 as depicted in FIG. 32.

Figure 36:
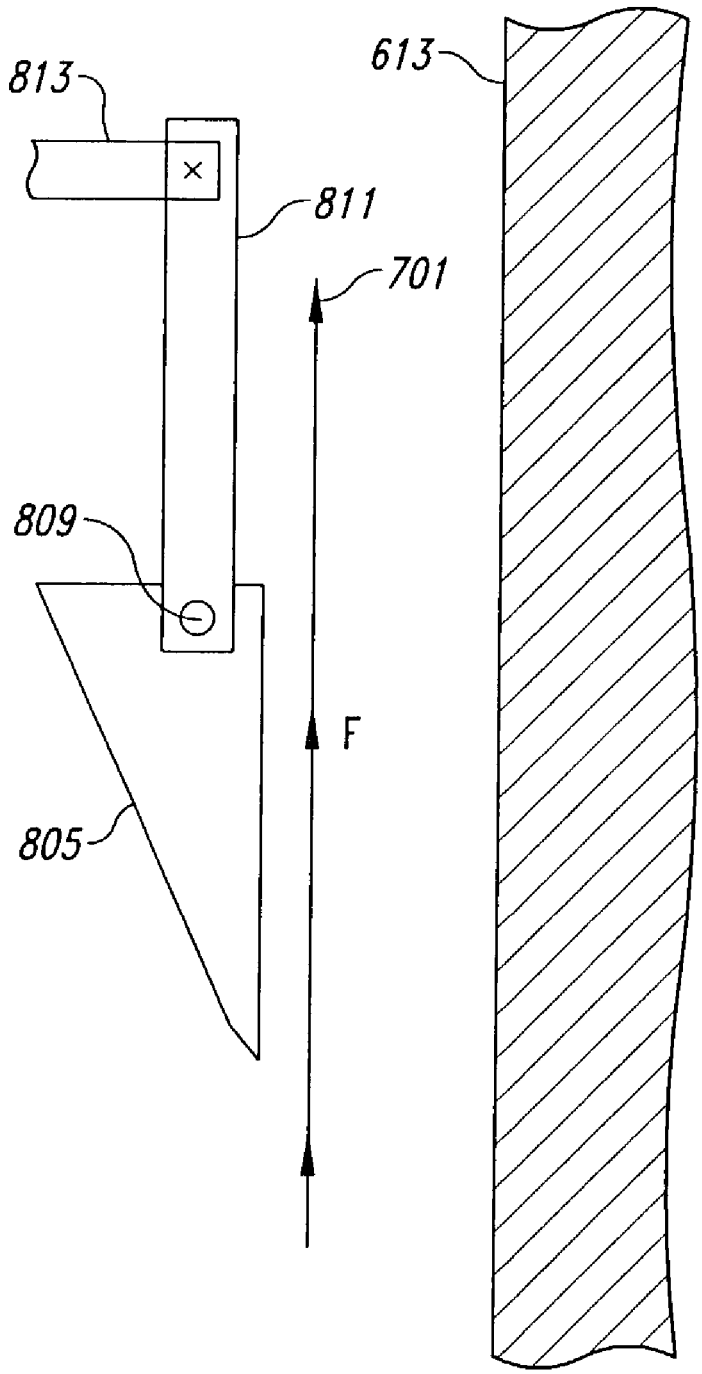
FIG. 36 is a plan view of the wire path with the wire gate of FIG. 32 in the "non-stripping" mode.
Figure 37:
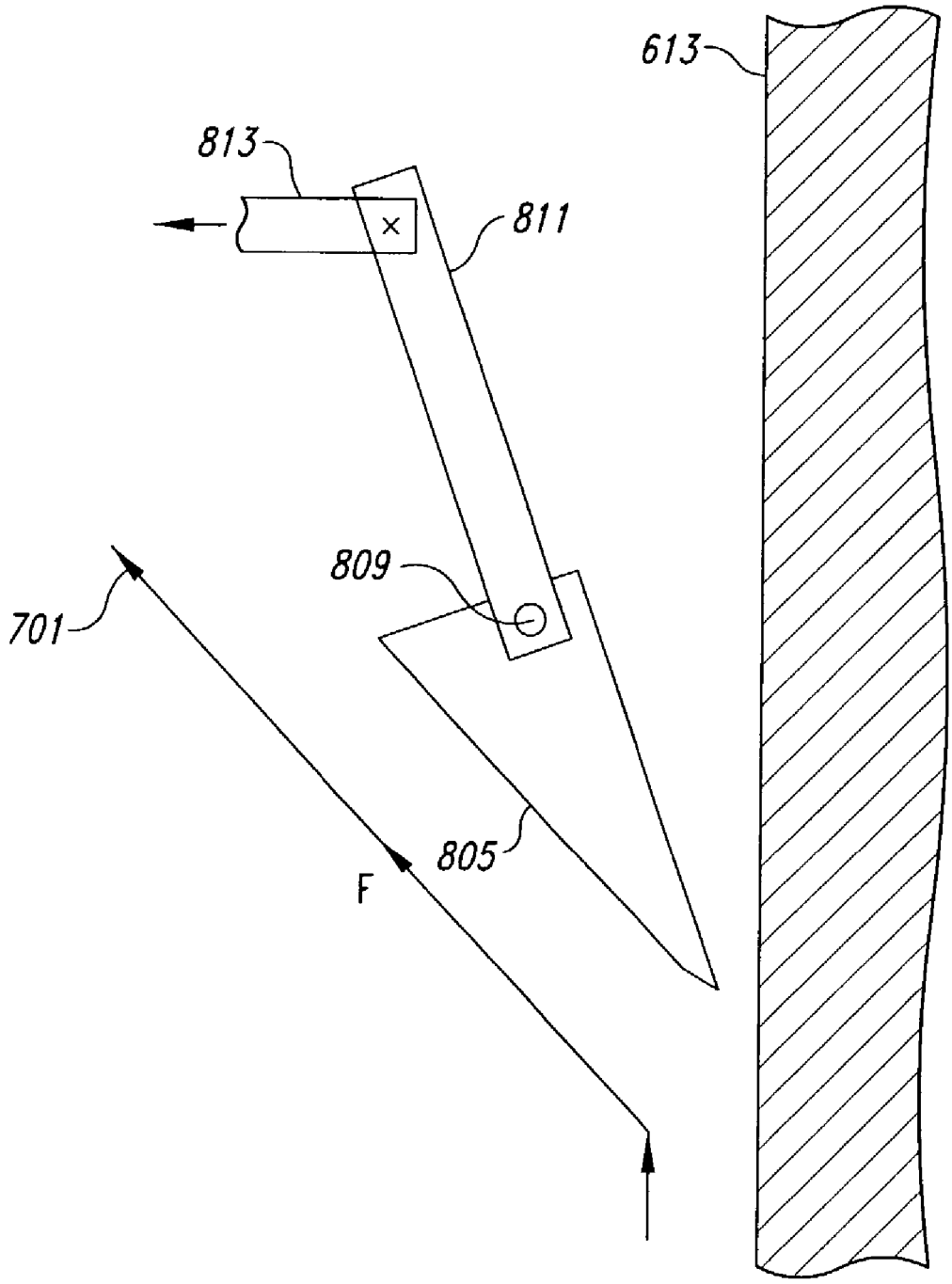
FIG. 37 is a plan view of the wire path with the wire gate of FIG. 32 in the "stripping" mode.

The wire strip gate 805, being rotatably affixed to the lever arm 811 through the pivot pin 809, can be configured such that first end 817 of the wire strip gate 805 can be deflected into and out of the wire gate slot 823 by the gate deflection device 813. The gate deflection device 813 can be a stripper solenoid 833 with a slotted plunger 831. The slotted plunger 831 can have a lever arm attach slot 827 wherein the deflection end 829 of the lever arm 811 can be inserted. In such an embodiment, actuation of the stripper solenoid 833 causes the first end 817 of the wire strip gate 805 to either block or clear the wire path within the feed exit guide 613. For example, the stripper solenoid 833 can be energized to cause the slotted plunger 831 to pull on the lever arm 811, thereby rotating the wire gate first end 817 into the path of the wire to reroute the leading end of the wire 701 into the wire coiler as shown schematically in FIG. 37. The wire strip gate 805 in the non-stripping mode is shown in FIG. 36, the stripper solenoid non-energized, where the leading end of the wire 701 bypasses the wire strip gate 805 in the feed direction "F" to the track assembly 400.

The mounting plate 815 permits the attachment of the gate deflection device 813 and the wire coiler 803 to the feed exit guide 613. As illustrated in FIG. 34, the mounting plate 815 captures the wire strip gate 805 within the wire path. The mounting plate 815 can be configured with a release slot 835 to permit the attachment of the slotted plunger 831 with the second end 819 of the wire strip gate 805 and to allow the wire strip gate 805 to freely rotate within the wire gate slot 823 (FIGS. 34 and 35).

Once the wire strip gate 805 has impeded the wire path, the leading end of the wire 701 is directed out of the feed exit guide 613 as shown in FIG. 40. Referring back to FIG. 33, a wire coiler 803 for accepting the extracted wire, can be connected adjacent to the feed exit guide 613 with a mounting plate 815. The wire coiler 803 may be cylinder-shaped with an internal helical groove. It is possible to either partially or fully encompass the helical groove to restrain the leading end of the wire 701 as it exits from the wire strip gate 805. The helical groove of the wire coiler 803 forms the extracted wire into a manageable coil as it is driven from the feed and tension mechanism 600 so the waste wire can be easily removed by the operator.

The wire sensing devices such as the wire present switch 601 and the feed tube switch 615 are comprised of a loop proximity sensor that detects metal. The respective switches include a ceramic tube passing through the center of the sensor that guides the wire and protects the sensor.

The wire guiding devices are instrumental in directing and routing the wire during each operational cycle, especially the threading of the machine. For clarification purposes, the wire guiding devices will be described in their sequential relationship to the threading operation of the mechanism 600 from start to finish. The wire guiding devices include an adjustable entry guide 601, an axial-to-radial guide 605 mounted on the accumulator shaft 679 proximately located to the accumulator wheel 641, a radial-to-tangential guide 607 mounted on the accumulator wheel 645 and distally located from the accumulator shaft 679, a transfer guide 609 located between the accumulator wheel 641 and feed and tension wheel 645 and can be mounted on the frame 671, a feed wheel guide 611 which may be attachable to the frame 671 and circumferentially directs the wire around the feed wheel 645, a feed exit guide 613 located downstream of the feed wheel guide 611 for directing the wire tangentially away from the feed wheel 645, and finally a feed tube 615 attached to the feed exit guide 613 for projecting the wire linearly in the direction of the track assembly.

The feed and tension mechanism 600 can perform at least four operations, initial threading of wire into a wire-tying machine 100, tensioning and accumulating wire during bundling of one or more objects, subsequent threading and feeding of wire into a track assembly 400 after an initial tensioning operation, and stripping wire from the mechanism in the event of a system jam or an out of wire signal.

For purposes of clarity, the discussion of the operational cycles of the feed and tension mechanism 600 will follow the path of the wire. The first operation is to initially thread the wire into an empty feed and tension mechanism 600. Threading of the feed and tension mechanism 600, shown schematically in FIG. 38, commences with a leading end of a wire 701 being manually inserted into an adjustable entry guide 601 and pushed past the "wire present" switch 603. The adjustable entry guide 601 is configured to readily receive the leading end of the wire 701 from any location adjacent to the entry side of the machine. The illustrated wire present switch 603 is located down stream of the adjustable entry guide 601. The wire present switch 603 detects the presence of the wire 701 and signals the control system 500 to start the feed wheel gearmotor 673. A wire present signal is also supplied to the supplementary nip wheel 643 to engage the feed and tension wheel 645, and ultimately the wire, in a feed direction "FF" (FIG. 38). The wire present switch 603 can continue to provide a wire present indication to the control system 500 as long as wire is located within the perimeter of the switch.

With manual force still being applied to the wire, the leading end of the wire 701 passes the wire present switch 603 and into the wire guiding components attached to the accumulator wheel 641. Specifically these wire guiding components are the axial-to-radial guide 605 and the radial-to-tangential guide 607 which, working in combination, direct the wire toward the feed and tension wheel 645. The leading end of the wire 701 enters the axial-to-radial guide 605 along the centerline of the accumulator disk shaft 679, but does not pass through the accumulator wheel 641. The axial-to-radial guide 605 routes the wire from an axial to a radial direction with respect to the accumulator wheel 641; whereas the radial-to-tangential guide 607 receives the leading end of the wire 701 and further directs the wire toward the feed and tension wheel 645.

The passage of the wire just downstream of the radial-to-tangential guide 607 can be further directed by another wire guiding component, the transfer guide 609, located between the accumulator wheel 641 and the feed and tension wheel 645. The transfer guide 609 contains the wire as it exits from the radial-to-tangential guide 607 and it circumferentially directs the leading end of the wire 701 into the feed wheel groove 649.

As the leading end of the wire 701 exits the transfer guide 609, it contacts the supplemental nip mechanism 643. Recalling that the supplemental nip wheel 643 is already engaged and the feed wheel 645 had already been commanded to rotate, the wire becomes drawn into the supplemental contact region 657 (i.e., FIG. 38). The contact between the supplemental nip mechanism 643 and the feed and tension wheel 645 causes the entering wire to become frictionally drawn through the contact region 657. From this point forward during the threading operation, the engagement of the supplemental nip mechanism 643 with the feed wheel 645 augments the manually threading of the mechanism 600.

As the lead end of the wire 701 is frictionally drawn through the supplemental contact region 657, the wire is further directed by another wire guiding component, the feed wheel guide 611. The wire, having a tendency to straighten upon leaving the supplemental contact region 657 is circumferentially contained by the feed wheel guide 611 as the wire progresses around the feed wheel 645 in the feed direction FF.

Reaching the bottom portion of the feed and tension wheel 645, the leading end of the wire encounters the primary contact region 669 created by the primary nip mechanism 661 being biased against the feed wheel 645. The purpose of the primary nip mechanism 661 is to apply a pinch force between the primary nip wheel 663 and the feed and tension wheel 645. The nip force at the primary nip contact region 669 can override the frictional engagement at the pinch force at the supplemental contact region 657 and can take primary control of feeding the wire. The default position of the primary nip mechanism 661 can be in biased contact with the feed and tension wheel 645.

The leading end of the wire 701, upon being drawn through the primary nip contact region 669, now enters the feed exit guide 613. The feed exit guide 613 directs the wire into the feed tube 615. Prior to entering the feed tube 615, the leading end of the wire 701 may be detected by a feed tube switch 617. The purpose of the illustrated feed tube switch 617 during the threading operation is to detect the leading end of the wire 701 and to provide the control system 500 with another wire present signal. The wire present signal received from the feed tube switch 617 can instruct the control system 500 (FIG. 26) to disengage the supplemental nip mechanism 643 by de-energizing the upper nip wheel solenoid 655. As previously stated, the primary nip contact region 669 can provide sufficient frictional engagement of the wire such that the supplemental nip contact region 657 is no longer needed and continued contact would only increase heat within the mechanism 600 and cause component wear. The feed tube switch 617 can also detect the leading end of a wire 701 in order to reset the twister assembly 300 (FIG. 26) to its home position in the event of an error.

The feed tube 615 directs the wire to an outlet region, such as the track entry subassembly 420, for execution of a bundling operation as discussed in connection with the foregoing embodiment. The wire present signal received from the feed tube switch 617 can instruct the control system 500 to transition from threading to feeding and accordingly notify the operator. At this point, the operator will no longer manually feed wire into the feed and tension mechanism 600 and will activate the feed cycle. The feed cycle allows the feed wheel gearmotor 673 to increase the speed of the feed wheel 645 in the feed direction "FF" until the wire has been completely routed around the track entry subassembly 420, which completes the initial threading operation.

With the feed and tension mechanism loaded with wire, the tensioning operation may be commenced. One or more objects can be placed in the track assembly 400 to be bundled. The feed and tensioning mechanism can be controlled to tension the wire around the objects. The tensioning operation is schematically illustrated in FIG. 39. Several components within the feed and tension mechanism 600 can work together to effectuate sufficient tensioning of the wire and to accumulate any excess wire during the process. The excess wire is created because the perimeter of the one or more objects being bundled is less than that of the track assembly 400 opening where the wire resides just prior to the tensioning operation.

The actual tensioning of the wire around the one or more bundled objects requires that the excess wire be drawn from the track assembly 400 (FIG. 39) and accumulated on the accumulator wheel 641. One purpose of the accumulator wheel 641 is to accumulate and store the excess wire that is tensioned from the track assembly 400 until the wire is needed for another bundle.

With the feed and tension wheel 645 being rotated in their respective tension directions, "FT" and "AT" (FIG. 39), the wire is tensioned (i.e., drawn) back from the track assembly 400. The accumulator wheel 641 is driven by the accumulator gearmotor 675 in the accumulator tension direction "AT" (FIG. 39). The wire drawn from the track assembly by the frictional engagement of the primary nip contact region 669 can be directed to the rotating accumulator wheel 641 into the accumulator groove 627 by the transfer guide 609 during tensioning. The(transfer guide(609, being affixed to the frame 671, directs the wire from the feed and tension wheel 645 into the accumulator groove 627.

The tensioning operation can be halted by presetting the feed wheel gearmotor 673 to stall at a predetermined torque level once the wire is sufficiently tight around the bundle of objects. The predetermined torque level may be set by the operator based on the objects to be bundled, the wire diameter, and/or the strength of the wire. The control system 500 detects the feed wheel gearmotor 673 stall and holds the motor in position while the wire is twisted, cut and ejected.

The accumulated wire stored on the accumulator wheel 641 may now be utilized for a subsequent bundling operation and fed into the track assembly 400 after the initial tensioning operation. The subsequent bundling operation commences with the accumulator wheel 641 and feed and tension wheel 645 being simultaneously driven in the feed direction 691. The wire drawn from the accumulator wheel 641 initially unwinds from the accumulator groove 627 being directed tangentially from the lower portion of the accumulator wheel 641 through the transfer guide 609 and onto the feed wheel 645. Once the stored wire has been depleted from the accumulator wheel 641, the accumulator wheel 641 stops in its home position such that the wire can once again be drawn from the external wire supply through the adjustable entry guide 601. The accumulator disk home position (shown in FIG. 38) is the position of the accumulator wheel 641 during the initial, manual loading of the wire such that the feed path of the radial-to-tangent guide 607 lines up with the feed path of the transfer guide 609. From this point forward, the subsequent feeding operation is identical to the initial threading operation discussed above.

The final operation, stripping wire from the feed and tension mechanism 600, occurs when the external wire supply is depleted or a severing of the wire, either of which causes the trailing end of the wire 703 to be pulled through the adjustable entry guide 601 and past the wire present switch 603. The wire present switch 603, upon detecting no wire present, will signal the control system 500 and all mechanical operations can be halted. The control system 500 can also send a message to the operator that the machine is out of wire.

The control system 500 may direct the operator to halt all operations and immediately strip the wire from the machine or it may direct the operator to tension the wire, tie the wire around the present objects, and then halt all operations. The latter situation occurs when the wire has been completely fed around the track assembly 400 at the same instant the wire present switch 603 has detected the trailing end of the wire 703.

The wire stripping operation is schematically illustrated in FIG. 40. The stripping of the wire when the wire has not been completely fed around the track assembly 400 can be accomplished when the operator presses a "wire strip" button or similar feature on the control panel. This action signals the control system 500 to drive both the accumulator gearmotor 675 and the feed wheel gearmotor 673 in their respective tension directions, AT and FT, respectively; thereby drawing the leading end of the wire 701 in the tension direction, T, back from the track assembly 400 (FIG. 39). Once the leading end of the wire 701 reaches the primary nip contact region 669, the control system 500 can actuate the gate deflection device 813 (FIG. 32), such as the stripper solenoid 833 previously discussed, which, in turn, rotates the wire strip gate 805 into the path of the wire located within the feed exit guide 613 (FIG. 32). The wire strip gate 805 is located within the feed exit guide 613 just upstream from the feed tube 615.

Upon the leading end of the wire 701 reaching the primary nip contact region 669, the control system 500 halts operation and drives the feed and tension wheel 645 in the feed direction "FF". The leading end of the wire 701, upon reaching the wire strip gate 805 (FIG. 32), is directed out of the operating direction "F" and into the wire coiler 803 (FIG. 32). The wire coiler 803 forms the extracted wire into a manageable coil as it is driven from the feed and tension mechanism 600 so the waste wire can be easily removed by the operator. As the trailing end of the wire 703 passes the primary nip contact region 669, the primary nip mechanism 661 may cease rotating due to the lack of frictional engagement required between the primary nip wheel 663, the wire, and the feed and tension wheel 645. The control system 500, upon detecting that the primary nip wheel 663 is not turning could halt all machine functions and provide a message to the operator to remove the waste wire. At this point, the operator grasps the coiled waste wire 705, removes it, and discards it.

It is important to understand that the feed and tension mechanism 600 just described has many advantages and may even be operated without certain components. For example, the supplemental nip wheel 643 as described above certainly assists the manual threading of the machine by frictionally engaging the wire and drawing it further around the feed and tension wheel 645. However, it is entirely possible that the supplemental nip wheel 643 could be disregarded and the operator would still be able to manually feed the wire to the point of the primary nip contact region 669 near the bottom of the feed and tension wheel 645. The advantage of having the supplemental nip wheel 643 present and operational is that it augments the force required to thread the wire and it pulls the wire into the feed and tension mechanism 600, reducing the likelihood of wire kinking or buckling and reducing the amount of effort that would be required from an operator.

The present invention significantly reduces the amount of manual threading of the wire. Prior art mechanisms required that the entire machine be manually threaded which was not only time consuming, but also created a greater likelihood of jammed or kinked wire.

The wire guiding components, the adjustable entry guide 601, the axial-to-radial guide 605, the radial-to-tangential guide 607, the transfer guide 609, the feed wheel guide 611, the feed exit guide 613, and the feed tube 615, are configured to advantageously limit and reduce the amount and magnitude of bends in the wire during threading and the components are abutted or joined to permit the leading end of the wire 701 to make smooth transitions during threading. Additionally, the radial-to-tangential guide 607 can prevent the wire from becoming bent when the wire is tensioned and accumulated on the accumulator wheel 641.

The accumulator wheel 641, being an active, rotational storage device, provides significant advantages over the prior art. Prior art devices utilized passive accumulators where the wire was essentially fed into a captive void. The capacity of the passive accumulator had to be custom-sized for a given track size. If the passive accumulator was made too small then the wire would become lodged and difficult to redraw from the accumulator during the start of a subsequent feeding cycle. In contrast, an accumulator made too large violated spatial constraints for the machine. In addition, the prior art accumulators could allow wire to escape the open end of the accumulator if too much wire was tensioned back. The accumulator wheel 641 of the present invention is a cost-effective, easily manufactured component that also provides a greater wire storage capacity. The width of the spacer 635, being approximately equivalent to the diameter of wire 631, ensures that the wire will coil on top of itself during the accumulation cycle and thus prevent crossed or twisted wire within the accumulator groove 627. The sequentially stacked wire in the accumulator groove 627 can also be monitored and tracked by the control system 500. Although the accumulator wheel 641 with a machined helical groove, described in the opening of the detailed description, may adequately perform the accumulation function, the machining of the helical groove can be time consuming and costly.

Another advantage and unique feature of this embodiment of the feed and tension mechanism 600 is the wire stripping operation. Prior art machines required the operator to manually extract the wire from the machine. The present invention, however, automatically evacuates the wire as directed from the operator. The less interaction between the operator and the wire reduces opportunities for injury. Likewise, the extracted wire is advantageously coiled by the wire coiler 803 into a helical pattern 705. The extracted wire is compact and easily manageable.

Another advantage of this embodiment of the feed and tension mechanism 600 is the use of independent gearmotors to drive the accumulator wheel 641 and the feed and tension wheel 645, respectively. The two independent gearmotors, 675 and 673, permit both wheels to be operated independently which means driven in different directions and/or at different speeds. With both motors controllable and integrated with the control system 500, the operator retains great flexibility in changing operational cycles or optimizing the machine for different types of bundling operations.

The detailed descriptions of the above embodiments are not exhaustive descriptions of all embodiments contemplated by the inventors to be within the scope of the invention. Indeed, persons skilled in the art will recognize that certain elements of the above-described embodiments may variously be combined or eliminated to create further embodiments, and such further embodiments fall within the scope and teachings of the invention. It will also be apparent to those of ordinary skill in the art that the above-described embodiments may be combined in whole or in part with prior art methods to create additional embodiments within the scope and teachings of the invention.

Thus, although specific embodiments of, and examples for, the invention are described herein for illustrative purposes, various equivalent modifications are possible within the scope of the invention, as those skilled in the relevant art will recognize. The teachings provided herein of the invention can be applied to other methods and apparatus for wire-tying bundles of objects, and not just to the methods and apparatus for wire-tying bundles of objects described above and shown in the figures. In general, in the following claims, the terms used should not be construed to limit the invention to the specific embodiments disclosed in the specification. Accordingly, the invention is not limited by the foregoing disclosure, but instead its scope is to be determined by the following claims.

What is claimed is:

1. A feed and tension mechanism for use with a wire-tying machine, comprising:

an accumulator wheel to accept wire during tensioning of the wire about one or more objects;

a wire guide rotationally mounted to the accumulator wheel and positioned to receive and route the wire;

a feed wheel to receive the wire from the wire guide and directing the wire to an outlet region;

a primary nip mechanism biasly engaged against the feed wheel to form a primary nip contact region to frictionally engage the wire;

a feed wheel gearmotor to rotationally drive the feed wheel;

an accumulator gearmotor to rotationally drive the accumulator wheel independent of the feed wheel; and a supplemental nip mechanism being controllably movable into and out of contact with the feed wheel to selectively aid the threading of the wire into the feed and tension mechanism.

2. The mechanism of claim 1 wherein the supplemental nip mechanism is eccentrically-rotationally mounted to the frame.

3. The mechanism of claim 1 wherein the supplemental nip mechanism is controllably movable into and out of contact with the feed wheel by a solenoid.

4. A feed and tension mechanism for use with a wire-tying machine, comprising:

an accumulator wheel to accept wire during tensioning of the wire about one or more objects;

a wire guide rotationally mounted to the accumulator wheel and positioned to receive and route the wire;

a feed wheel to receive the wire from the wire guide and directing the wire to an outlet region;

a primary nip mechanism biasly engaged against the feed wheel to form a primary nip contact region to frictionally engage the wire;

a feed wheel gearmotor to rotationally drive the feed wheel;

an accumulator gearmotor to rotationally drive the accumulator wheel independent of the feed wheel;

an adjustable entry guide to initially accept wire into the feed and tension mechanism; the wire guide comprised of an axial-to-radial guide and a radial-to-tangential guide, the respective guides attached to the accumulator wheel to direct the wire toward the feed wheel;

a transfer guide and a feed wheel guide to direct the wire circumferentially around the feed wheel; and a feed wheel exit guide and a feed tube to direct the wire tangentially and linearly towards a track assembly.

5. The mechanism of claim 1, further comprising a wire present switch positioned to detect the leading end of the wire before the wire enters the accumulator wheel, the wire present switch configured to transmit a signal to a control system to indicate that the wire is present.

6. The mechanism of claim 5 wherein the wire present switch is a ioop proximity sensor that detects metal and further includes a ceramic tube passing through the center of the sensor that guides the wire and protects the sensor.

7. The mechanism of claim 5 wherein the wire present switch remains on until after a trailing end of wire moves past the wire present switch.

8. The mechanism of claim 1, further comprising:

an adjustable entry guide connected upstream from the wire present switch to aid the manual insertion of the leading end of wire into the feed and tension mechanism.

9. The mechanism of claim 1 wherein the accumulator wheel comprises a spacer positioned between an inner and an outer wall, the outer diameter of the spacer being smaller than the outer diameters of the walls, thus forming a groove to collect and contain the wire during tensioning.

10. The mechanism of claim 9 wherein the width of the groove is selected to be approximately equivalent to the wire diameter thus allowing the wire to be radially stacked within the groove during accumulation.

11. A feed and tension mechanism for use with a wire-tying machine, comprising:

an accumulator wheel to accept wire during tensioning of the wire about one or more objects;

a wire guide rotationally mounted to the accumulator wheel and positioned to receive and route the wire;

a feed wheel to receive the wire from the wire guide and directing the wire to an outlet region;

a primary nip mechanism biasly engaged against the feed wheel to form a primary nip contact region to frictionally engage the wire;

a feed wheel gearmotor to rotationally drive the feed wheel;

an accumulator gearmotor to rotationally drive the accumulator wheel independent of the feed wheel; and wherein the wire guide at the outlet region comprises a feed exit guide located adjacent to the feed wheel to route the wire tangentially away from the feed wheel and further comprises a feed tube connected to the feed exit guide for directing the wire to a track assembly.

12. The mechanism of claim 1, further comprising:

a feed tube switch that detects a leading end of the wire and transmits a detection signal to a control system commanding the disengagement of the supplemental nip mechanism.

13. A feed and tension mechanism for use with a wire-tying machine, comprising:

an accumulator wheel to accept wire during tensioning of the wire about one or more objects;

a wire guide rotationally mounted to the accumulator wheel and positioned to receive and route the wire;

a feed wheel to receive the wire from the wire guide and directing the wire to an outlet region;

a primary nip mechanism biasly engaged against the feed wheel to form a primary nip contact region to frictionally engage the wire;

a feed wheel gearmotor to rotationally drive the feed wheel;

an accumulator gearmotor to rotationally drive the accumulator wheel independent of the feed wheel; and a wire coiler selectively engageable with the feed and tension mechanism, the wire coiler having an internal helical groove for coiling an amount of extracted wire as the extracted wire is driven from the feed and tension mechanism.

14. The mechanism of claim 1 wherein a spring generates a biasing force on the primary nip mechanism a spring force of the spring selected to accept a leading end of the wire into the primary nip contact region.

15. The mechanism of claim 1 wherein the wire-tying machine is a bailing machine.

16. A method for threading a wire into a feed and tension mechanism on a wire-tying machine, the method comprising:

inserting the wire into a wire guide until the wire directly triggers a switch; and commanding a drive wheel and a nip mechanism into operative engagement using a signal generated from the switch, a contact pressure between the drive wheel and the nip mechanism sufficient to feed the wire along a feed path.

17. The method of claim 16, further comprising:

manually moving the wire past the switch until the wire is received by the drive wheel and the nip mechanism.

18. The method of claim 16 wherein the nip mechanism is a supplemental nip mechanism, and wherein feeding the wire comprises feeding the wire from the supplemental nip mechanism to a primary nip mechanism.

19. A system for feeding a length of wire into a wire-tying track and for withdrawing at least some of the wire from the wire-tying track to tension the wire around one or more objects, the system comprising:

feed and tension wheel controllable to operate in a feeding direction to feed the length of wire toward the wire-tying track, and a tensioning direction opposite the feeding direction to draw at least a portion of the length of wire away from the wire-tying track;

an accumulator wheel having at least one guide attached thereon oriented to direct the length of wire toward the feed and tension wheel when the accumulator wheel is in a feeding orientation, the accumulator wheel being rotatable and having an outer circumferential groove configured to receive at least some of the length of wire while the feed and tension wheel rotates in the tensioning direction to accumulate the portion of the length of wire; and a supplemental nip mechanism positioned adjacent to the feed and tension wheel to receive the wire from the accumulator wheel, the supplemental nip mechanism is controllable to move between an engaged position and a disengaged position, the engaged position puts the supplemental nip mechanism in contact with the feed and tension wheel to facilitate the manual insertion of the wire into the system, the disengaged position provides a space between the supplemental nip mechanism and the feed and tension wheel.

20. The system of claim 19, further comprising:

a wire present switch to detect the length of wire upon entry into the system and to transmit a detection signal to a control system, the detection signal provided to move the supplemental nip mechanism into the engaged position.

21. The system of claim 20, further comprising:

a feed tube switch to detect the completion of a threading operation and provide a signal to command the supplemental nip mechanism to move into the disengaged position.

22. The system of claim 19 wherein the accumulator wheel comprises a spacer positioned between an inner and an outer wall, the outer diameter of the spacer being smaller than the outer diameters of the walls, thus forming a groove to collect and contain the wire during tensioning.

23. The mechanism of claim 22 wherein the width of the groove is selected to be approximately equivalent to the wire diameter thus allowing the wire to be radially stacked within the groove during accumulation.

24. A system for assisting an operator in threading a length of wire onto a wire-tying machine, the system comprising:

a feed and tension wheel operable in a feeding direction to feed the length of wire toward the wire-tying track, and operable in a tensioning direction, which is opposite the feeding direction, to draw at least a portion of the length of wire away from the wire-tying track;

a transfer guide configured to route the length of wire toward the feed and tension wheel, the transfer guide oriented to facilitate the receipt of the wire at a circumferential surface at the outer perimeter of the feed and tension wheel; and a wire present switch positioned to guide the wire into the transfer guide, the wire present switch having a sensor configured to generate a signal when the wire is present, the signal initiating a rotationof the feed and tension wheel in the feeding direction.

25. The system of claim 24, further comprising a supplemental nip mechanism being controllably movable into and out of contact with the feed and tension wheel to selectively aid the threading of the wire into the wire-tying machine.

26. The system of claim 24 wherein the supplemental nip mechanism is eccentrically-rotationally mounted to a frame.

27. The system of claim 26 wherein the supplemental nip mechanism is controllably movable into and out of contact with the feed and tension wheel by a solenoid.

28. The system of claim 24 wherein the wire present switch signal further commands a supplemental nip mechanism to engageably contact the feed and tension wheel.

29. The system of claim 28, further comprising a feed tube switch for detecting the completion of a threading operation and thereby commanding the disengagement of the supplemental nip mechanism.

* * * * *

UNITED STATES PATENT AND TRADEMARK OFFICE

CERTIFICATE OF CORRECTION

PATENT NO. : 6,968,779 B2
DATED : November 29, 2005
INVENTOR(S) : David R. Doyle et al.

It is certified that error appears in the above-identified patent and that said Letters Patent is hereby corrected as shown below:

Column 29,
Line 23, “ioop” should read -- loop --.
Line 30, “from the” should read -- from a --.

Column 32,
Line 11, “rotationof” should read -- rotation of --.

Signed and Sealed this

Twenty-first Day of March, 2006

JON W. DUDAS
*Director of the United States Patent and Trademark Office*